US010625310B2

(12) United States Patent
Denton

(10) Patent No.: US 10,625,310 B2
(45) Date of Patent: Apr. 21, 2020

(54) WASHING DEVICE FOR A PORTABLE TOILET

(71) Applicant: Bradley Denton, Minooka, IL (US)

(72) Inventor: Bradley Denton, Minooka, IL (US)

( * ) Notice: Subject to any disclaimer, the term of this patent is extended or adjusted under 35 U.S.C. 154(b) by 250 days.

(21) Appl. No.: 15/916,420

(22) Filed: Mar. 9, 2018

(65) Prior Publication Data

US 2018/0257115 A1 Sep. 13, 2018

Related U.S. Application Data

(60) Provisional application No. 62/469,485, filed on Mar. 9, 2017.

(51) Int. Cl.
*B08B 3/14* (2006.01)

(52) U.S. Cl.
CPC ..... *B08B 3/14* (2013.01)

(58) Field of Classification Search
CPC ..... B08B 3/14; B08B 9/0826; B08B 3/02; B08B 9/0821
USPC ..... 134/104.4, 104.2, 104.1, 166 R, 169 R, 134/115, 201
See application file for complete search history.

(56) References Cited

U.S. PATENT DOCUMENTS 3,203,437 A * 8/1965 Faust ..... B08B 9/0826 134/148
3,881,950 A * 5/1975 Pettit ..... B08B 9/0826 134/115 R
4,694,846 A * 9/1987 Bouchard ..... B65F 7/005 134/115 R
6,336,239 B1 * 1/2002 Cooper ..... B08B 9/0808 134/104.2
7,846,263 B1 * 12/2010 Marcantel ..... B08B 9/093 134/104.2
8,118,948 B1 * 2/2012 Szabo ..... B08B 3/026 134/111
8,511,325 B2 * 8/2013 Gingras ..... B08B 9/0826 134/115 R

* cited by examiner

*Primary Examiner* — Justin M Jonaitis
(74) *Attorney, Agent, or Firm* — Donald G. Flaynik

(57) ABSTRACT

A washing device for a portable toilet includes a portable toilet lifting member that pivotally elevates a portable toilet from a substantially vertical position and rotates the portable toilet until disposed in a substantially horizontal position in a portable toilet washing enclosure. An access door of the portable toilet is unlocked and allowed to open when the portable toilet is horizontally positioned in the portable toilet washing enclosure. A portable toilet access aperture is orientated to enable internal washing members for the portable toilet that are disposed inside the portable toilet washing enclosure to discharge a liquid within an internal chamber of the portable toilet to ultimately clean the internal chamber and a toilet tank inside the internal chamber. The portable toilet washing enclosure also includes external washing members for washing external walls and a base portion of the portable toilet. The washing device further includes a conveyor apparatus capable of serially moving a plurality of vertically disposed portable toilets to the portable toilet lifting member, and serially moving a plurality of vertically disposed washed portable toilets from the portable toilet lifting member.

43 Claims, 43 Drawing Sheets

WASHING DEVICE FOR A PORTABLE TOILET

This Utility Application is based on Provisional Application 62/469,485 filed on Mar. 9, 2017.

BACKGROUND OF THE INVENTION

1. Field of the Invention

The present invention relates to a washing device for a portable toilet, and more particularly, to a washing device that elevates and rotates a portable toilet from a vertical position on a conveyor assembly to a substantially horizontal position that has a slight slope that promotes gravitational liquid flow from a bottom portion of the portable toilet. The substantially horizontally positioned portable toilet is disposed inside a portable toilet washing enclosure, such that a toilet door is allowed to open downward, thereby exposing the internal components of the portable toilet to allow cleaning elements inside the enclosure to spray a cleaning liquid upward inside the portable toilet; whereupon, the cleaning liquid gravitationally falls to the bottom of the enclosure into a floor portion that promotes collection and recycling of the cleaning liquid. After the portable toilet is cleaned and disinfected, the portable toilet is rotated from the washing enclosure and returned a vertical position upon the conveyor assembly; whereupon, the conveyor assembly moves the cleaned portable toilet to a storage area until ultimately being transported for use at a preselected location.

2. Background of the prior art

Prior art portable toilet cleaning and disinfecting methods and systems position a used portable toilet in a vertical ("upright or standing") position at a cleaning site, then use a suction hose to remove solid waste from a toilet tank inside an inner chamber of the portable toilet. A pressurized liquid containing chemical cleaning agents is then sprayed upon the internal walls, ceiling and inside the toilet tank to clean and disinfect these areas of the inner chamber. The pressurized liquid ultimately falls to the bottom of the portable toilet via gravity; whereupon, the liquid is vacuumed from the portable toilet and the inner chamber is allowed to dry. The "cleaned" portable toilet is transported to a selected location for use.

The problem with the prior art cleaning and disinfecting systems is that a liquid residue containing chemical agents remains inside the toilet tank or upon the floor of the portable toilet, resulting in the contamination of the land area that a bottom surface of the portable toilet is disposed upon. Further, because the portable toilet is cleaned in a vertical position, relatively small portions of the toilet tank waste remain in the toilet tank and/or engaged by the pressurized liquid and are ultimately splash upon portions of the inner chamber of the portable toilet, thereby creating a potential health hazard. Another problem with the prior art cleaning and disinfecting systems is that the liquids used to clean and disinfect are not reused and ultimately are shipped to another site for treatment and disposal. Yet another problem with prior art portable toilet cleaning systems and devices is that they require relatively large amount of water to clean the portable toilets. Still another problem with prior art portable toilet cleaning systems is that a relatively large amount of time is required to sufficiently clean the portable toilet because of the need to vacuum out the waste from the toilet tank, then again vacuum the liquid from the portable toilet that was used to clean the vertically disposed portable toilet.

Another problem with cleaning the portable toilets in a vertical position is that it requires manual labor to begin and complete the cleaning process, thereby preventing the use of a mechanized conveyor system that feeds "used" portable toilets to a computer controlled cleaning system that receives and removes a used portable toilet from a portable toilet feed portion of a conveyor system; that removes the used toilet from the system; that cleans the used toilet; that places the now clean toilet back on a portable toilet removal portion of the conveyor system; and that ultimately transports the clean portable toilet to a location where the clean toilet can be transported to a site for use.

A portable toilet cleaning method and device is required that cleans the portable toilet by multiple cleaning nozzles that discharge pressurized liquids containing cleaning and disinfecting chemicals into the inner chamber of the portable toilet, such that all toilet tank waste and cleaning liquids flow downward from the toilet tank and from the bottom portion of the portable toilet, through the aperture of the open door, and upon a floor portion of the portable toilet washing enclosure. The liquid disposed upon the floor portion of the portable toilet washing enclosure is collected, cleaned of contaminants, and pumped to a storage tank for re-use for cleaning the next portable toilet supplied by a computer controlled conveyor system.

SUMMARY OF THE INVENTION

It is an object of the present invention to overcome many of the disadvantages associated with prior art portable toilet cleaning device, systems and methods. A principal object of the present invention is to provide a method and device for lifting and pivoting a used waste containing portable toilet in a substantially horizontally position with the door of the portable toilet open and on the "bottom" side of the horizontally disposed toilet. A feature of the method and device for horizontally positioning the portable toilet is a pivoting lifting frame upon which a portable toilet is detachably secured such that the lifting frame lifts and rotates the portable toilet irrespective of the amount of waste in the toilet tank of the portable toilet. An advantage of the method and device for horizontally positioning the portable toilet, that includes a slight downward slope, is that all contents in an inner chamber of the portable toilet are allowed to drain via gravity from the portable toilet. Another advantage of the method and device for horizontally positioning the portable toilet is the resulting flow of the waste and liquid from the inner chamber of the portable toilet through an aperture provided by the open door, thereby removing all waste and liquid from the portable toilet without having to use a vacuum hose.

Another object of the present invention is to provide a portable toilet washing enclosure for receiving a horizontally positioned used portable toilet such that the used portable toilet can be washed and disinfected without any waste or liquid escaping the enclosure. A feature of the method and device is to snugly insert the substantially horizontally disposed portable toilet in an aperture in a top portion of the washing enclosure. Another feature of the method and device is to provide multiple nozzles that discharge a pressurized liquid containing a disinfecting chemical into all portions of the inner chamber of the substantially horizontally disposed portable toilet while the portion of the portable toilet having the exposed inner chamber is encased by the washing enclosure such that no liquid can escape the washing enclosure. An advantage of the method and device is that the liquid used to clean and disinfect the inner chamber of the portable toilet can be collected, cleaned and stored for reuse without having any of the liquid escape from the washing enclosure and pollute the area where the washing enclosure is located.

Yet another object of the present invention is to provide an input conveyor system to supply and move multiple, vertically disposed used portable toilets to the pivoting lifting frame such that a single portable toilet is ultimately disposed upon the pivoting lifting frame. A feature of the method and device is to provide a hydraulic cylinder to move a frame member of the input conveyor system that includes a pivoting flipper member for engaging a bottom portion of a portable toilet. The flipper member pushes the portable toilet on rails until a preselected portable toilet engages the pivoting frame lifting; whereupon, the operation of the input conveyor system stops and the lifting operation of the lifting frame becomes the only system that operates. An advantage of the method and device is that the entire operation of the input conveyor, lifting frame, placing the portable toilet in a horizontal position in the washing enclosure, cleaning the portable toilet and replacing the portable toilet in a vertical position is controlled by a computer system that operates without manual oversight.

Still another object of the present invention is to provide an output conveyor system to remove multiple, vertically disposed cleaned portable toilets from the lifting frame such that for every cleaned vertically disposed portable toilet removed from the pivoting lifting frame, a previously cleaned portable toilet is moved toward a storage area for cleaned portable toilets. A feature of the method and device is to provide a hydraulic cylinder to move a frame member of the output conveyor system that includes a pivoting flipper member for engaging a bottom portion of a portable toilet. The flipper member pushes the portable toilet on rails of the output conveyor until a cleaned portable toilet engages an end portion of the output conveyor system; whereupon, the operation of the output conveyor system continues and the cleaned portable toilet engaging the end portion of the output conveyor system is manually removed from the output conveyor and stored in a preselected area. An advantage of the method and device is that the entire operation of the output conveyor with the cleaned portable toilets disposed upon the output conveyor is independently controlled, without manually oversight, by the same computer system that operates the input conveyor, lifting frame and cleaning operation of the portable toilet inside the washing enclosure. The only manual contribution to the entire operation of the method and device of the present invention is the operation of a forklift to elevate a selected used portable toilet and dispose the selected used portable toilet upon the input conveyor, and the operation of a forklift to elevate a selected cleaned portable toilet above the output conveyor and dispose the cleaned portable toilet in a preselected storage area until transporting the cleaned portable toilet to a use site.

Briefly, the invention provides a washing device for a portable toilet that includes:

a portable toilet lifting member that elevates a portable toilet from a substantially vertical position and rotates the portable toilet until disposed in a substantially horizontal position in a portable toilet washing enclosure, such that an access door of the portable toilet is open and a portable toilet access aperture of the portable toilet is orientated to enable internal washing members in said portable toilet washing enclosure to discharge a liquid within an internal chamber of the portable toilet to ultimately clean the internal chamber and a toilet tank disposed inside said internal chamber;

an external washing member in said portable toilet washing enclosure for discharging said liquid upon predetermined external wall portions of the portable toilet when the portable toilet is disposed in said substantially horizontal position inside said portable toilet washing enclosure;

a first apparatus for supplying said liquid to said internal washing members in said portable toilet washing enclosure when the portable toilet is disposed in said substantially horizontal position inside said portable toilet washing enclosure;

a second apparatus for supplying said liquid to said external washing member in said portable toilet washing enclosure when the portable toilet is disposed in said substantially horizontal position inside said portable toilet washing enclosure;

a third apparatus for controlling predetermined parameters of said liquid supplied to said internal washing members in said portable toilet washing enclosure via said first apparatus;

a fourth apparatus for controlling predetermined parameters of said liquid supplied to said external washing member in said portable toilet washing enclosure via said second apparatus; and a liquid collection and liquid purifying apparatus for recycling liquid from the washed portable toilet to a liquid storage member, whereby, liquid used to wash a portable toilet horizontally disposed in said portable toilet washing enclosure is gravity urged upon a floor portion of said liquid collection and liquid purifying apparatus, said liquid ultimately being returned to said liquid storage member, the portable toilet ultimately being washed and removed from said portable toilet washing enclosure; whereupon, said portable toilet lifting member returns the cleaned portable toilet to a substantially vertical position, the cleaned portable toilet being transported to storage via manually operated equipment.

Further, the invention provides a washing device for portable toilets that includes:

a portable toilet lifting member that elevates a portable toilet from a substantially vertical position and rotates the portable toilet until disposed in a substantially horizontal position in a portable toilet washing enclosure, such that an access door of the portable toilet is open and a portable toilet access aperture of the portable toilet is orientated to enable internal washing members in said portable toilet washing enclosure to discharge a liquid within an internal chamber of the portable toilet to ultimately clean the internal chamber and a toilet tank disposed inside said internal chamber;

an external washing member in said portable toilet washing enclosure for discharging said liquid upon predetermined external wall portions of the portable toilet when the portable toilet is disposed in said substantially horizontal position inside said portable toilet washing enclosure;

a first apparatus for supplying said liquid to said internal washing members in said portable toilet washing enclosure when the portable toilet is disposed in said substantially horizontal position inside said portable toilet washing enclosure;

a second apparatus for supplying said liquid to said external washing member in said portable toilet washing enclosure when the portable toilet is disposed in said substantially horizontal position inside said portable toilet washing enclosure;

a third apparatus for controlling predetermined parameters of said liquid supplied to said internal washing members in said portable toilet washing enclosure via said first apparatus;

a fourth apparatus for controlling predetermined parameters of said liquid supplied to said external washing member in said portable toilet washing enclosure via said second apparatus;

a liquid collection and liquid purifying apparatus for recycling liquid from the washed portable toilet to a liquid storage member, whereby, liquid used to wash a portable toilet horizontally disposed in said portable toilet washing enclosure is gravity urged upon a floor portion of said liquid collection and liquid purifying apparatus, said liquid ultimately being returned to said liquid storage member, the portable toilet ultimately being washed and removed from said portable toilet washing enclosure; whereupon, said portable toilet lifting member returns the cleaned portable toilet to a substantially vertical position, the cleaned portable toilet being transported to storage via manually operated equipment;

a portable toilet input conveyor for horizontally moving at least one vertically disposed portable toilet from a first position on said conveyor apparatus to a vertical position on said portable toilet lifting member, thereby positioning the vertically disposed portable toilet for pivotal movement to a horizontal position inside said portable toilet washing enclosure; and a portable toilet output conveyor for horizontally moving a washed vertically disposed portable toilet from said portable toilet lifting member to a second vertical position on said conveyor apparatus, whereupon, the washed vertically disposed portable toilet is removed from said portable toilet output conveyor to a place of storage.

Also, the invention provides a portable toilet washing device that includes:

a portable toilet lifting member that elevates a portable toilet from a substantially vertical position and rotates the portable toilet until disposed in a substantially horizontal position in a portable toilet washing enclosure, such that an access door of the portable toilet is open and a portable toilet access aperture of the portable toilet is orientated to enable internal washing members in said portable toilet washing enclosure to discharge a liquid within an internal chamber of the portable toilet to ultimately clean the internal chamber and a toilet tank disposed inside said internal chamber; and a liquid collection and liquid purifying apparatus for recycling liquid from the washed portable toilet to a liquid storage member, whereby, liquid used to wash a portable toilet horizontally disposed in said portable toilet washing enclosure is gravity urged upon a floor portion of said liquid collection and liquid purifying apparatus, said liquid ultimately being purified and returned to said liquid storage member, the cleaned portable toilet being removed from said portable toilet washing enclosure by said portable toilet lifting member; whereupon, said portable toilet lifting member vertically disposes the portable toilet upon a predetermined site proximate to said portable toilet washing enclosure, thereby enabling the portable toilet to be manually removed to a storage area until transported to a location for use.

BRIEF DESCRIPTION OF THE DRAWINGS

The foregoing invention and its advantages may be readily appreciated from the following Detailed description of the preferred embodiment, when read in conjunction with the accompanying drawings in which.

DESCRIPTION OF THE PREFERRED EMBODIMENT

Figure 9:
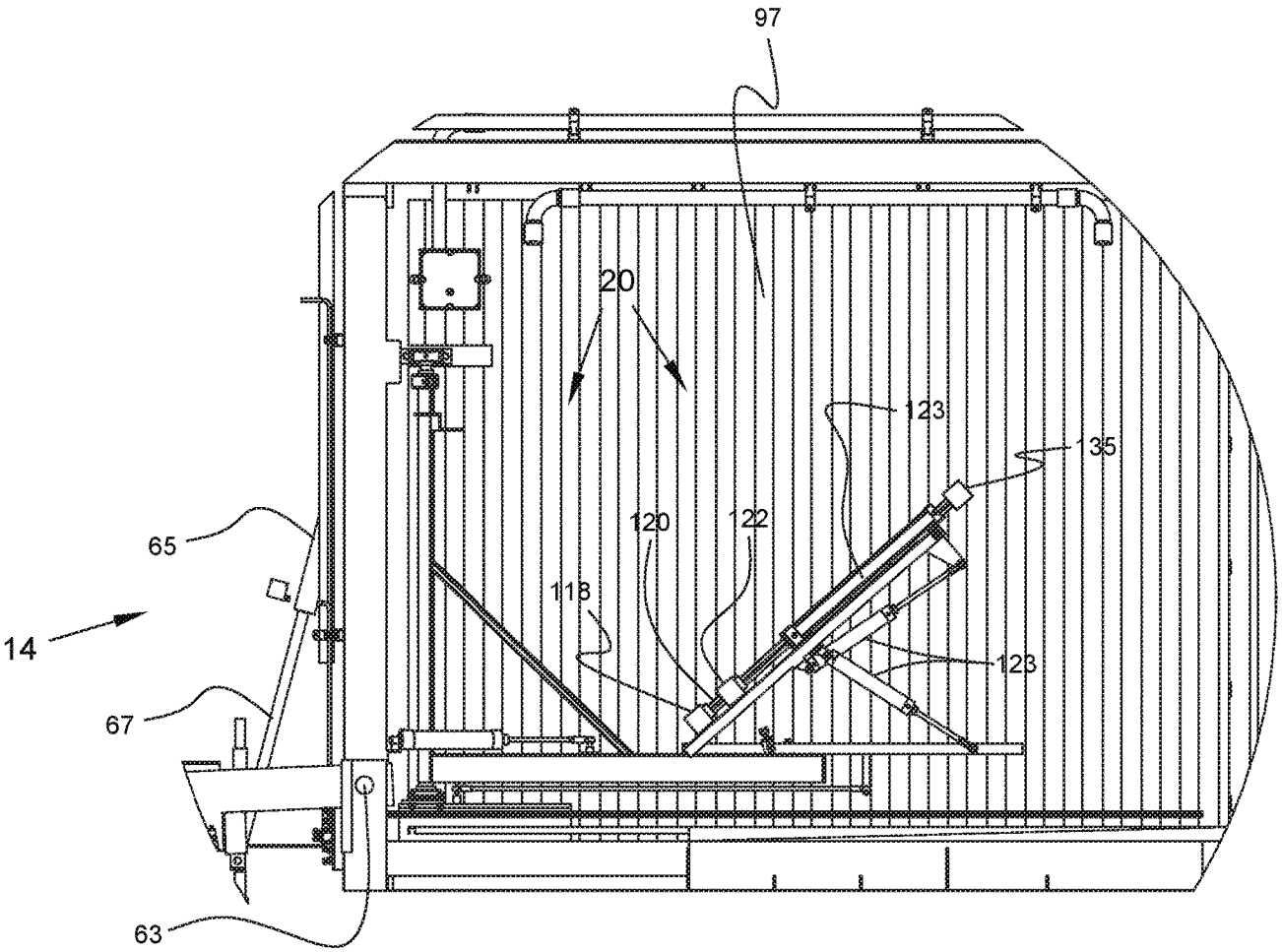
FIG. 9 is the cut-away view of FIG. 8, but with spray nozzles added.
Figure 10:
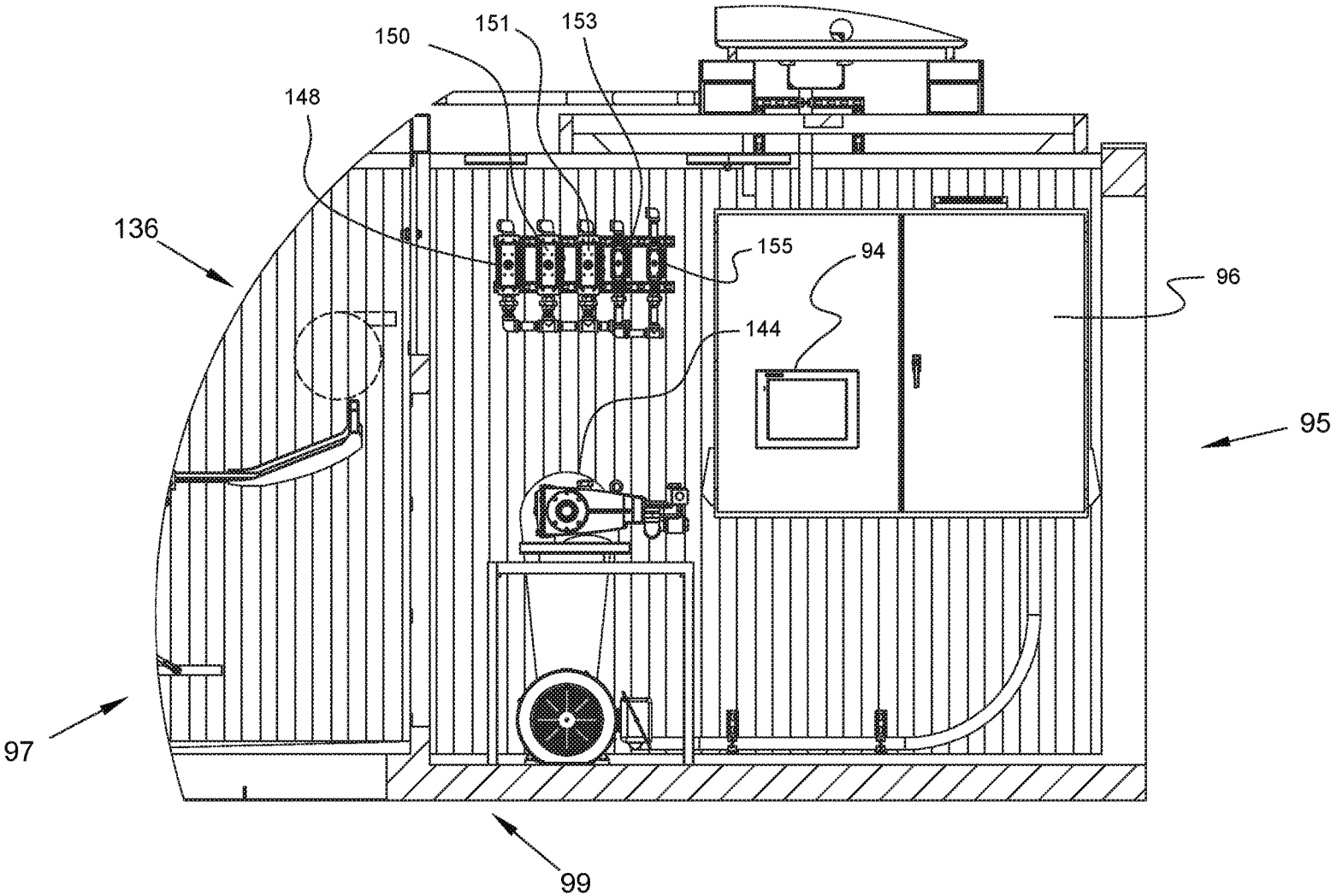
FIG. 10 is cut-away view of a left section of a dry portion of the washing enclosure of the device of FIG. 1.
Figure 11:
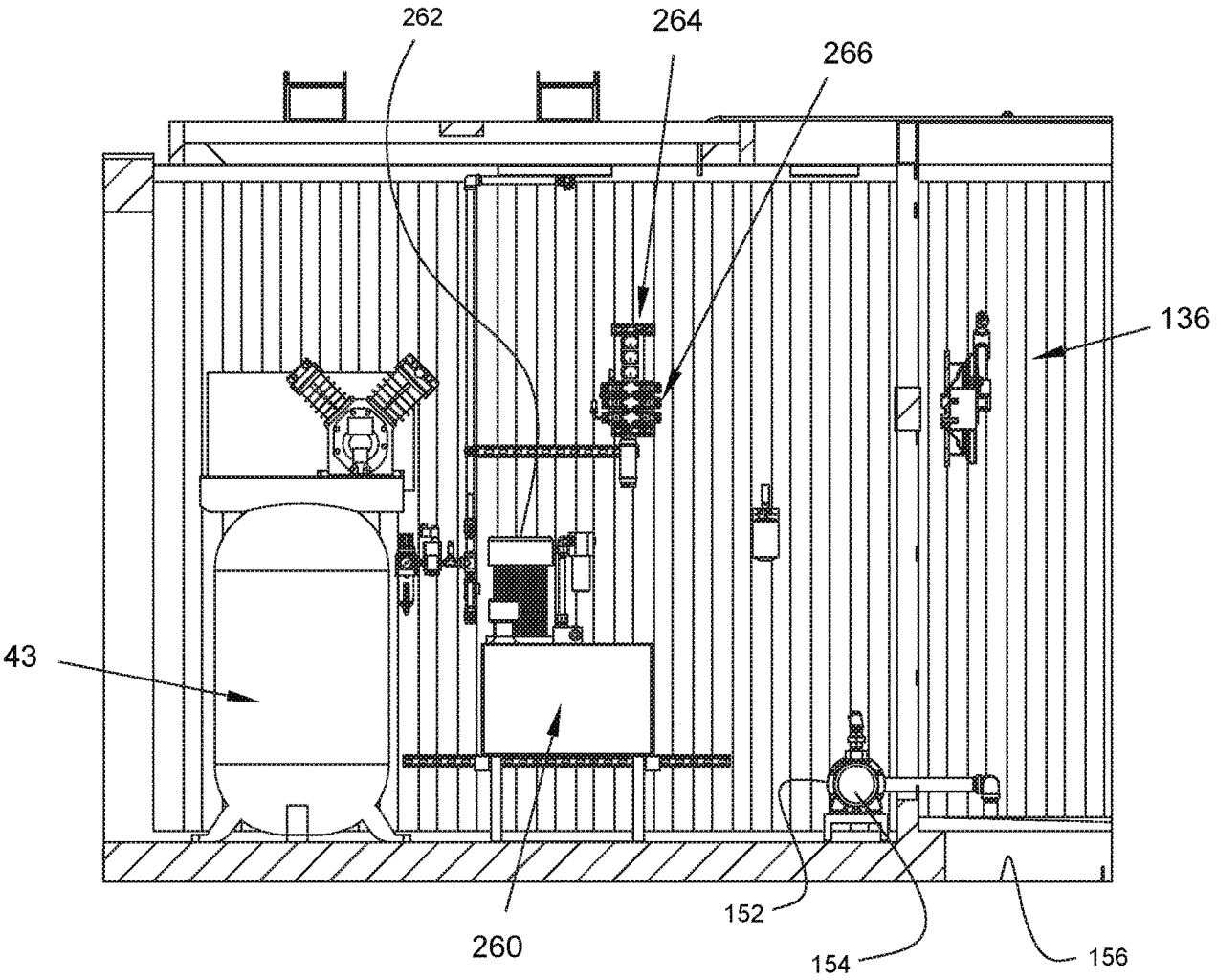
FIG. 11 is a cut-away view of a right section of the dry portion of the washing enclosure of the device of FIG. 1.
Figure 12:
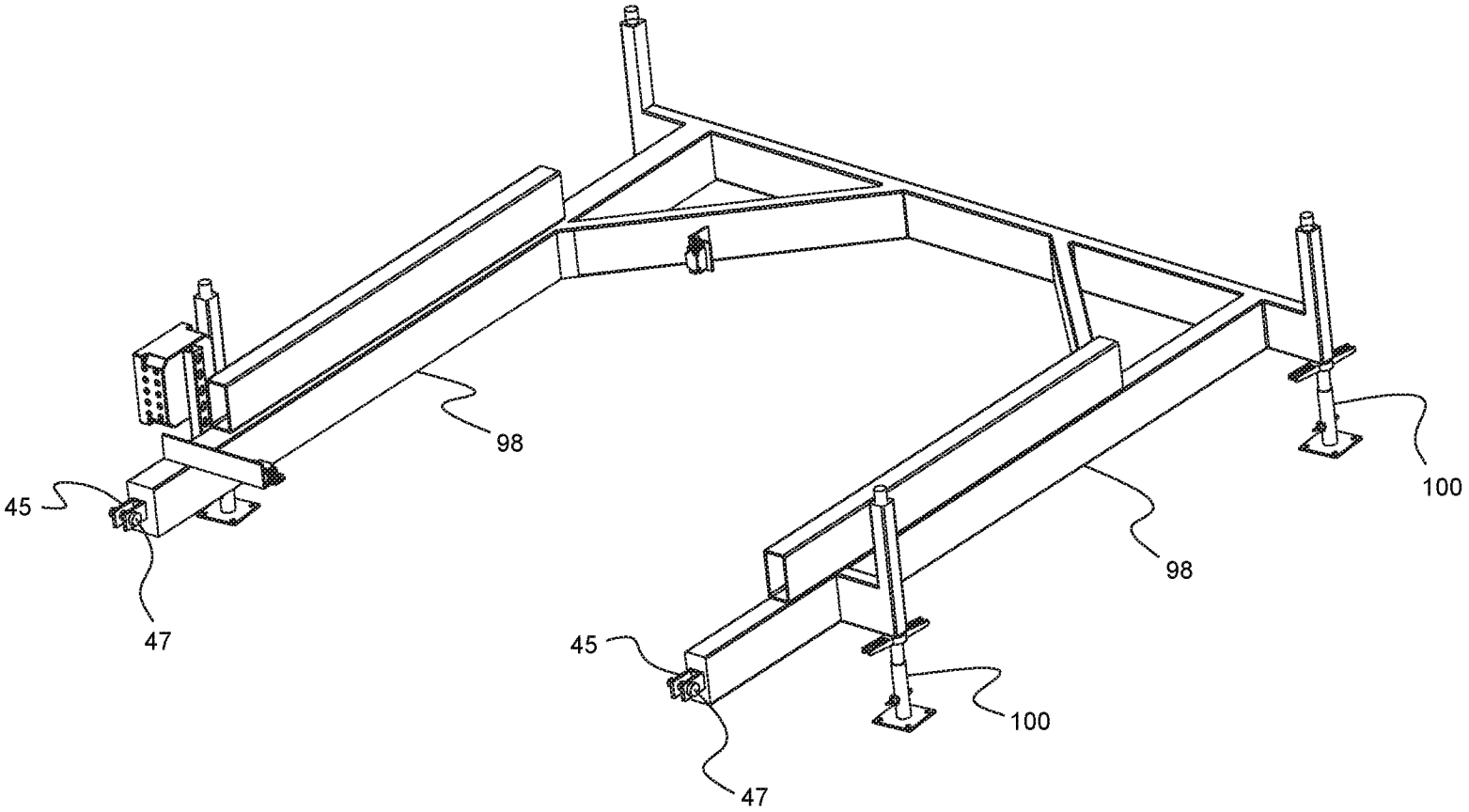
FIG. 12 is a perspective view of a base frame of a portable toilet lifting member of the device of FIG. 1.
Figure 13:
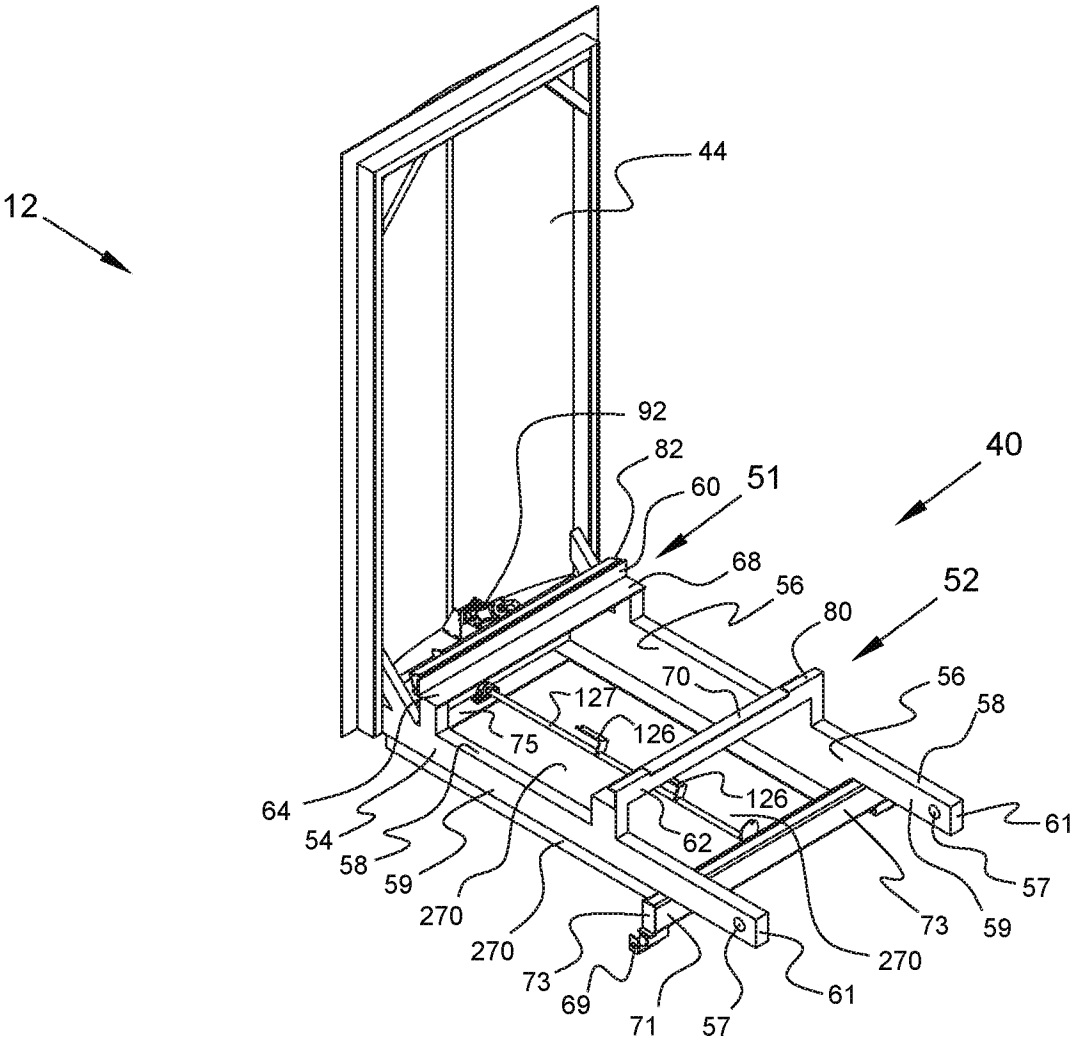
FIG. 13 is a perspective view of a lifting frame that is disposed upon but unconnected to the base frame of FIG. 12.
Figure 14:
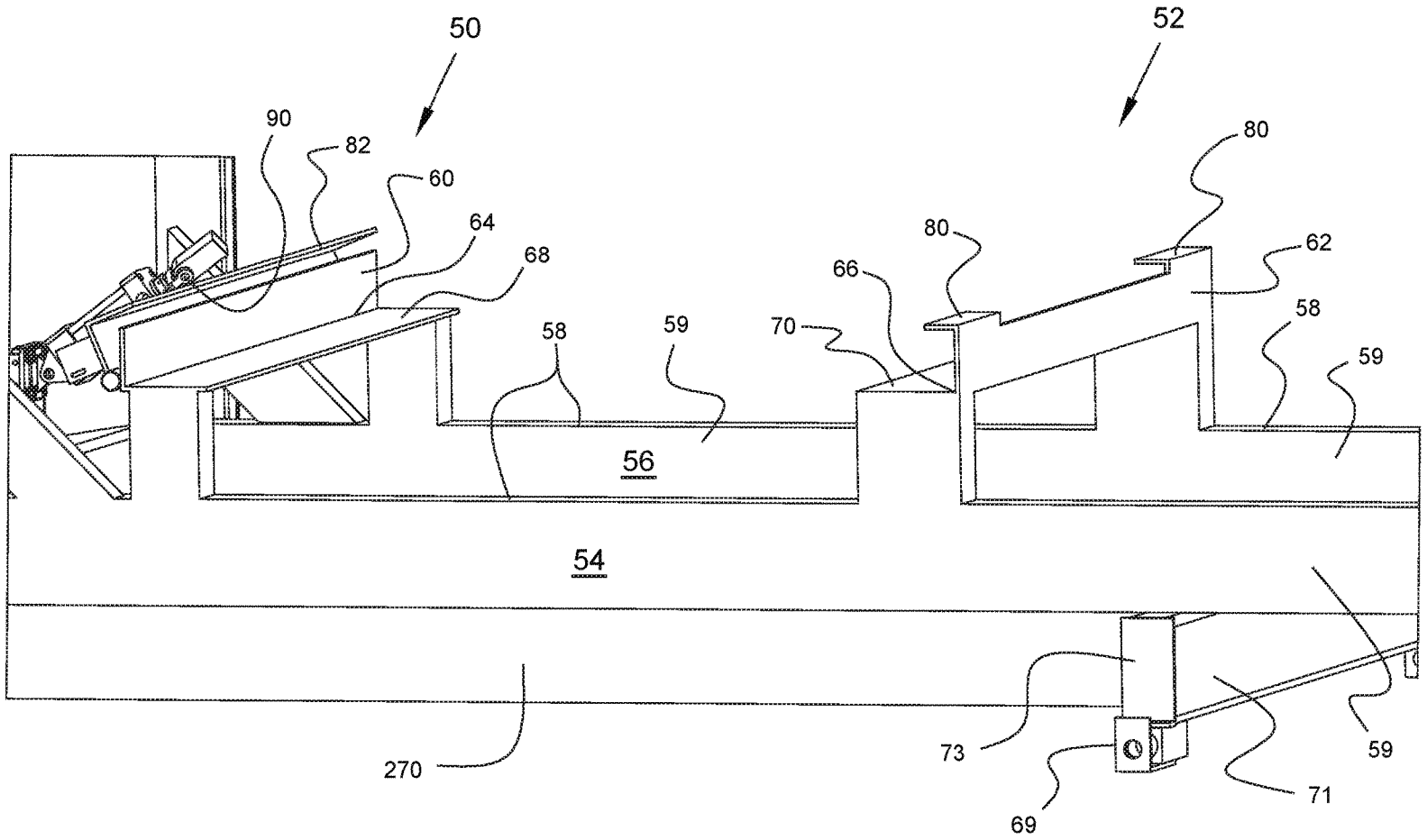
FIG. 14 is a perspective view of a clamping mechanism in an open position for the portable toilet that ultimately is secured to a mounting portion of the lifting frame of FIG. 13.
Figure 15:
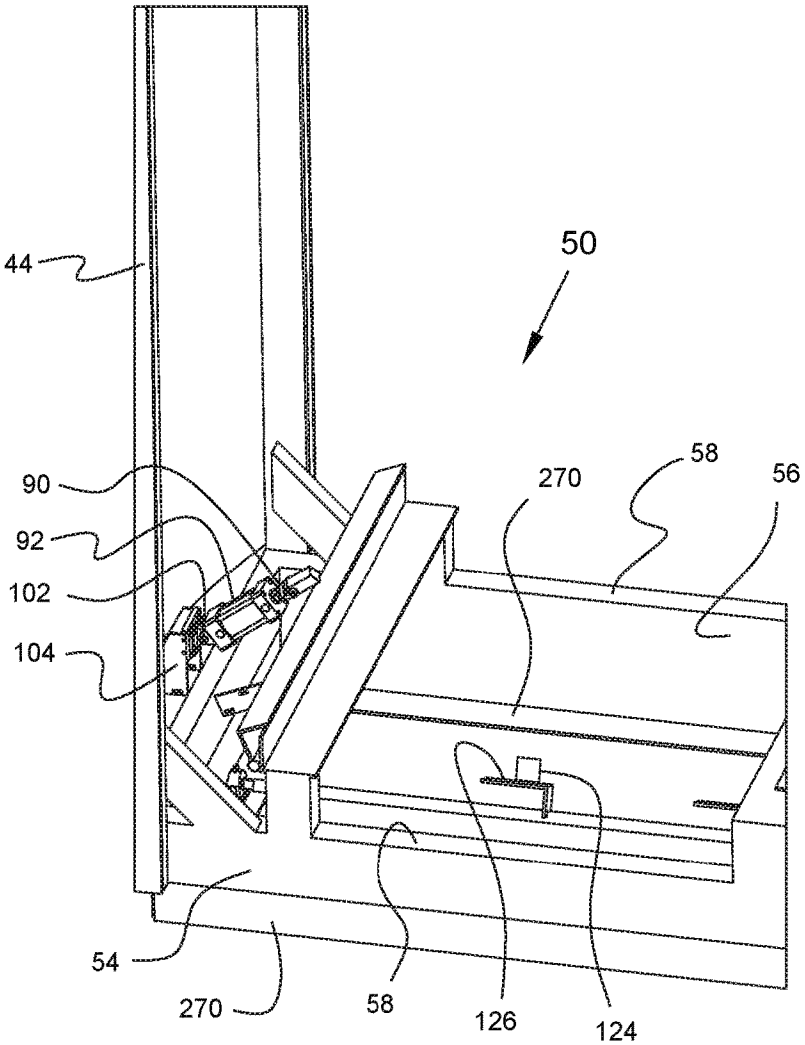
FIG. 15 is a perspective view of a portable toilet retaining portion of the lifting frame of FIG. 13.
Figure 16:
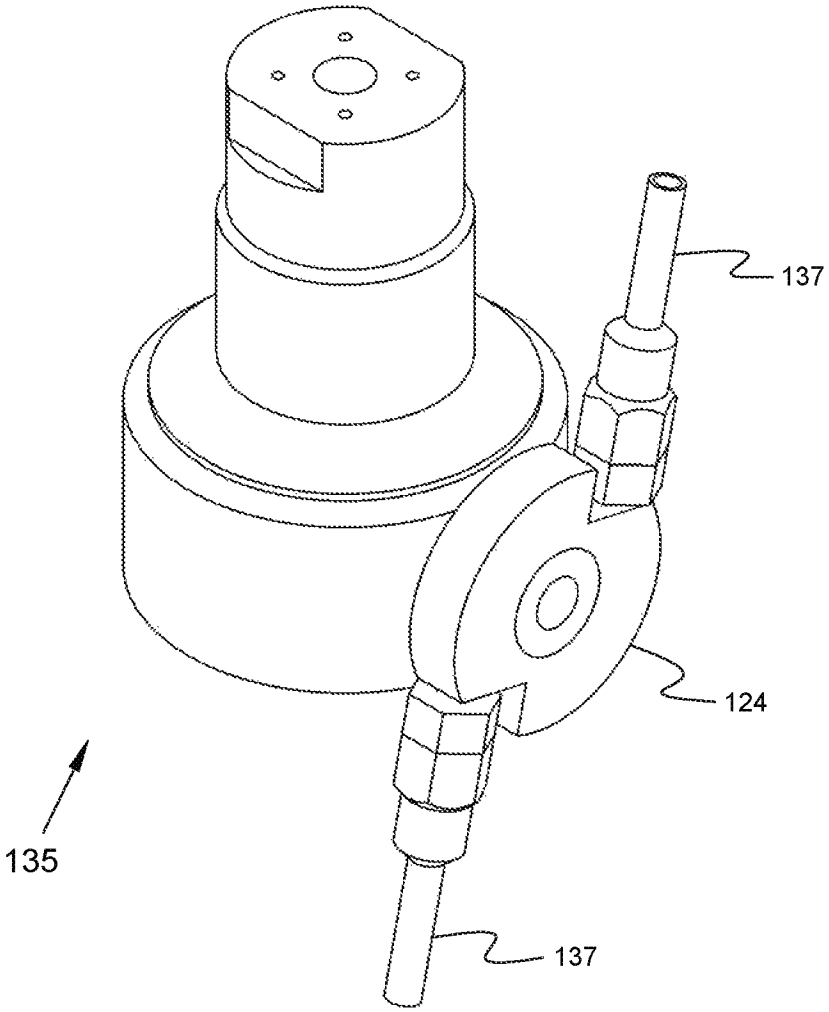
FIG. 16 is a perspective view of a spray nozzle for both a bottom or skid portion of the portable toilet and the toilet tank inside the portable toilet.
Figure 17:
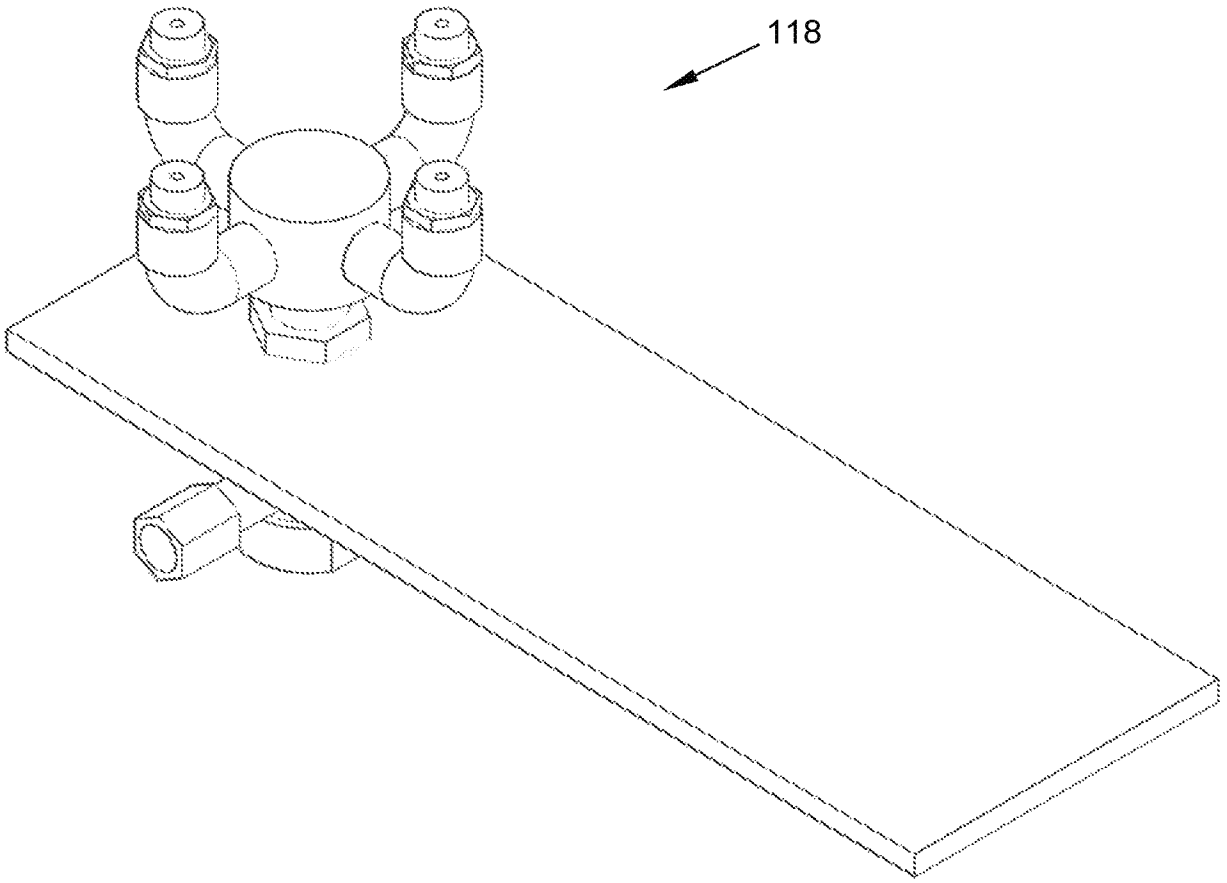
FIG. 17 is a perspective view of a toilet seat spray nozzle.
Figure 18:
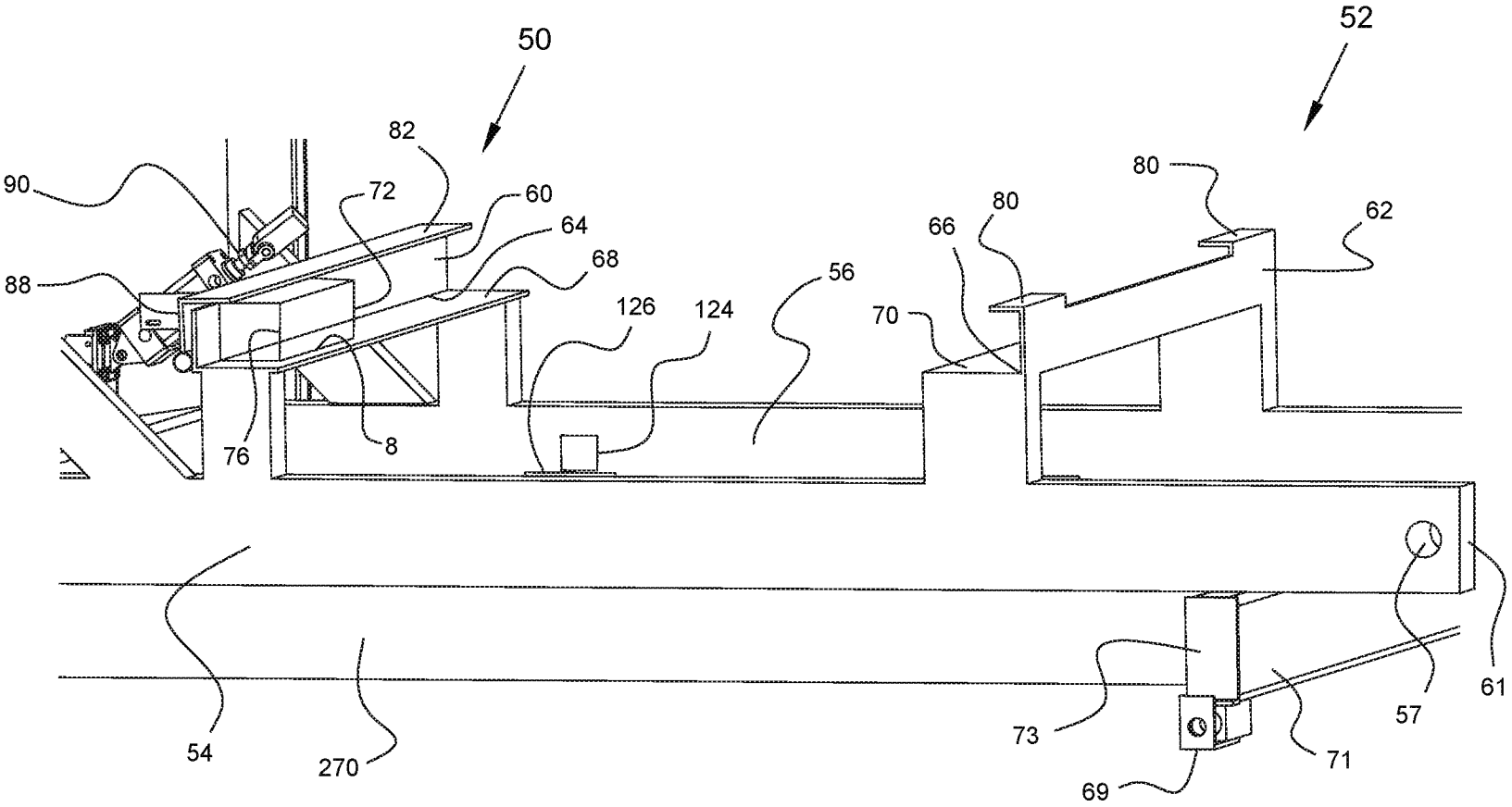
FIG. 18 is a perspective view of a clamping mechanism of FIG. 14, but in a closed position, thereby securing a depicted bottom portion of the portable toilet to the lifting frame.
Figure 19:
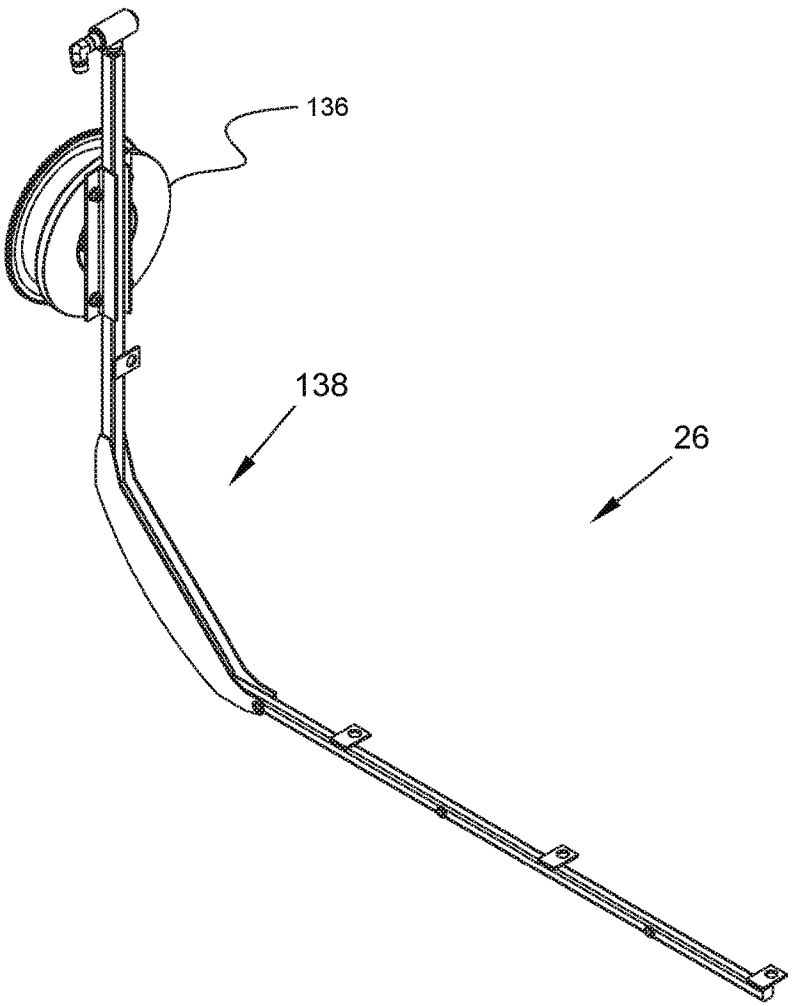
FIG. 19 is a perspective view of a boom for positioning spinner nozzles adjacent to outer walls of the portable toilet.
Figure 20:
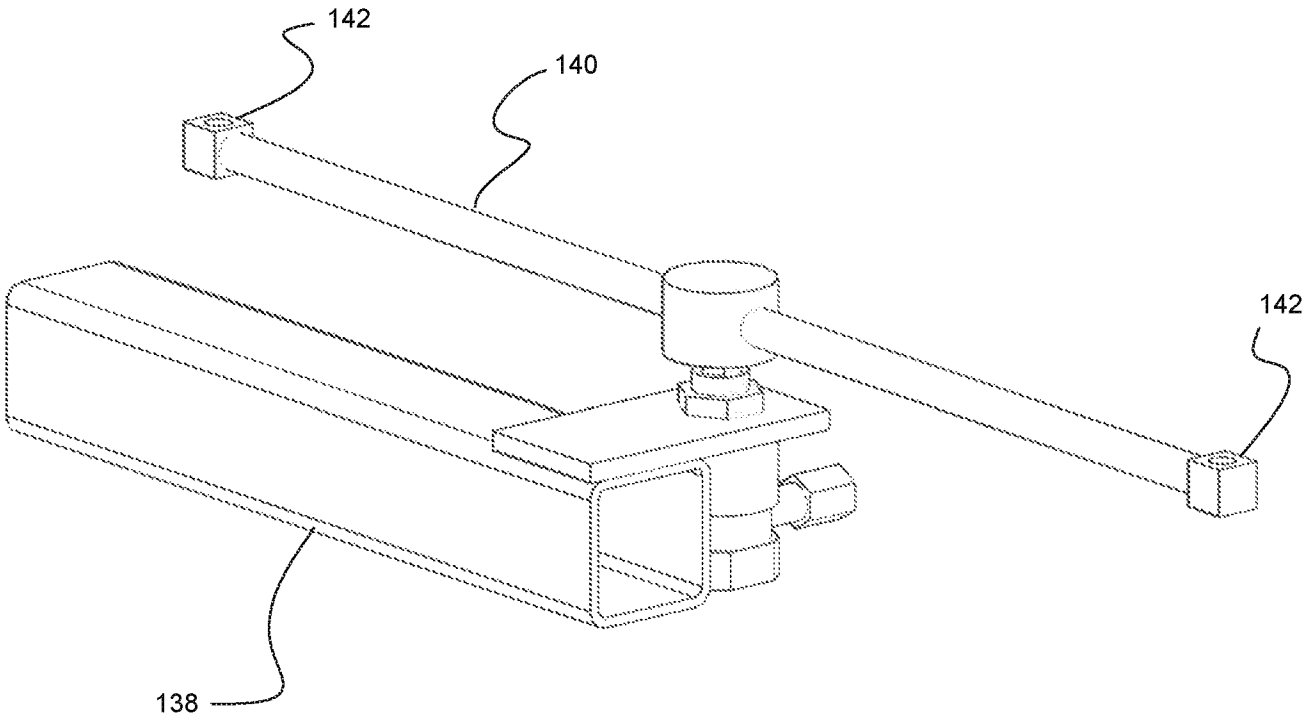
FIG. 20 is a perspective view of a spinner nozzle connected to a portion of a boom for positioning the spinner nozzle to wash outer walls of the portable toilet.
Figure 21:
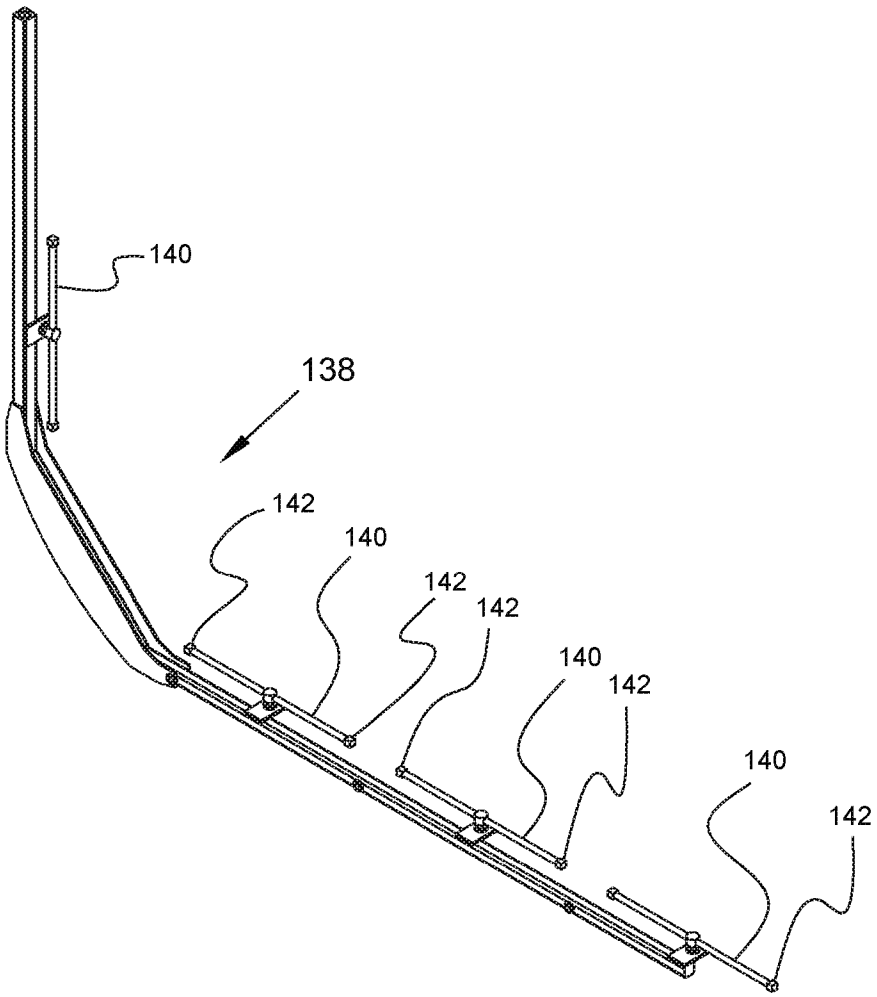
FIG. 21 is a perspective view of the boom of FIG. 19, but with multiple spinner nozzles attached to the boom.

Referring now to the drawings, and in particular to FIGS. 1-8, a washing device for portable toilets 8 in accordance with the present invention is denoted as number 10. The washing device 10 includes a portable toilet lifting member 12 that elevates a portable toilet 8 (see FIG. 5) from a substantially vertical position and rotates the portable toilet 8 until disposed in a substantially horizontal position in a portable toilet washing enclosure 14. An access door 16 of the portable toilet 8 is unlocked and allowed to open when the portable toilet 8 is horizontally positioned, and a portable toilet access aperture 18 of the portable toilet 8 is orientated to enable internal washing members 20 (FIG. 9) inside said portable toilet washing enclosure 14 to discharge a liquid (not depicted) within an internal chamber 22 of the portable toilet 8 to ultimately clean the internal chamber 22 and a toilet tank 39 inside the internal chamber 22. The washing device 10 further includes a conveyor apparatus 24 having elements for serially moving a plurality of vertically disposed portable toilets 8 to the portable toilet lifting member 12.

The washing device 10 further includes:

an external washing member 26 in the portable toilet washing enclosure 14 for discharging the liquid upon predetermined external wall portions of the portable toilet 8 when the portable toilet 8 is disposed in the substantially horizontal position inside the portable toilet washing enclosure 14;

a first apparatus for supplying liquid to the internal washing members 20 in the portable toilet washing enclosure 14 when the portable toilet 8 is disposed in a substantially horizontal position inside the portable toilet washing enclosure 14;

a second apparatus for supplying liquid to the external washing members 26 in the portable toilet washing enclosure 14 when the portable toilet 8 is disposed in a substantially horizontal position inside the portable toilet washing enclosure 14;

a third apparatus for controlling predetermined parameters of liquid supplied to the internal washing member 20 in the portable toilet washing enclosure 14 via the first apparatus 28;

a fourth apparatus for controlling predetermined parameters of liquid supplied to the external washing member 26 in the portable toilet washing enclosure 14 via the second apparatus 30; and a liquid collection and liquid purifying apparatus 36 for recycling liquid from the washed portable toilet 8 to a liquid storage member 38, whereby, a portable toilet 8 that has had biodegradable waste removed from a toilet tank 39 before the portable toilet 8 is elevated and horizontally disposed in the portable toilet washing enclosure 14, is washed by the internal and external washing members 20 and 26, whereupon, the liquid used to wash the portable toilet 8 is gravity urged from the portable toilet 8 and upon the liquid collection and liquid purifying apparatus 36. The liquid wash is ultimately returned to the liquid storage member 38. In the event that any solid materials are disposed in the liquid collection and liquid purifying apparatus 36, the solid material is removed manually or by vacuum truck from the liquid collection and liquid purifying apparatus 36. After the portable toilet 8 has completed a wash cycle, the now clean and disinfected portable toilet 8 is removed from the portable toilet washing enclosure 14 via the portable toilet lifting member 12 returning the portable toilet 8 to the original vertical position lineally aligned with the conveyor apparatus 24.

Referring to FIGS. 1-15, and 18, the portable toilet lifting member 12 fabricated from structural steel and capable of supporting a portable toilet 8 weighing substantially about one-hundred and seventy-five pounds when water and solid waste material is removed from the toilet tank 39, includes a lifting frame 40 pivotally connected to a cooperating frame portion 42 of the portable toilet washing enclosure 14. The portable toilet lifting member 12 includes a ceiling member 44 configured and dimensioned to snugly insert into a cooperating aperture 46 (substantially about nine feet longitudinally and five feet laterally) in a ceiling portion 48 of said portable toilet washing enclosure 14. The ceiling member 44 is pivotally inserted into the cooperating aperture 46 in the ceiling portion 48 as the portable toilet 8 is pivoted and horizontally disposed into the portable toilet washing enclosure 14, thereby preventing the washing liquid from escaping the enclosure 14 via the aperture 46 as the portable toilet 8 is washed with the liquid, resulting in the area outside the enclosure 14 remaining substantially dry throughout the portable toilet 8 washing cycle.

The lifting frame 40 includes parallel first and second portable toilet support members 50 and 52 integrally and transversely joined to top portions 58 of parallel first and second lifting members 54 and 56. The first and second lifting members 54 and 56 include apertures 57 through side walls 59 of pivot ends 61 of the first and second lifting members 54 and 56. The apertures 57 detachably receive cooperating cylindrically configured pivot pegs 63 integrally joined to the frame portion 42 of the washing enclosure 14. The pivot pegs 63 are dimensioned to snugly insert into the apertures 57 a sufficient depth that maintains the pivot pegs 63 inside the apertures 57 throughout the pivoting action of elevating a portable toilet 8 from a vertical position to a horizontal position inside the enclosure 14.

The pivoting motion is achieved by two hydraulic cylinders 65 sized (via methods well known to those of ordinary skill in the art) to pivot the portable toilet lifting member 12, with a one hundred and seventy-five pound portable toilet 8 disposed upon the lifting member 12, when extended cylinder rods 67 connected to rod connecting members 69 secured to lower end portions 71 of an inner member 73 of the lifting frame 40, are hydraulically urged into the cylinders 65. As a result of the pivoting motion, the inner member 73 and an outer member 75 of the lifting frame 40 are elevated and separated from the base frame 98 until the portable toilet 8 is horizontally disposed into the washing enclosure 14 via the aperture 46 in the ceiling portion 48 of the enclosure 14, such that the ceiling member 44 of the lifting frame 40 is substantially planar with the ceiling portion 48. The cylinders 65 are connected to upper portions 67 of the frame portion 42 of the washing enclosure 14. Hydraulic cylinders are used to control portions of the washing device 10 outside the enclosure 14. Pneumatic or air cylinders are used to control portions of the washing device 10 inside the enclosure 14. The air for the pneumatic cylinders is supplied by a compressor system 43 having pressure and volume sized for all the pneumatic cylinders via methods well known to those of ordinary skill in the art. Using pneumatic cylinders inside the enclosure 14, prevents hydraulic oil from contaminating the water used to clean the portable toilet 8, and maintains sufficient force to enable the computer controlled pneumatic cylinders to position respective water discharge members and nozzles at optimum locations for cleaning all internal and external surfaces of the portable toilet 8.

The first and second portable toilet 8 support members 50 and 52 are separated substantially about forty-two inches and include portable toilet first and second retaining walls 60 and 62 vertically joined to respective outer longitudinal edge portions 64 and 66 of corresponding horizontally disposed first and second plate portions 68 and 70 that ultimately engage cooperating top walls 72 and 74 of bottom portions 76 and 78 of the portable toilet 8. The first and second retaining walls 60 and 62 are separated a distance sufficient to allow a portable toilet 8 to be disposed between the first and second retaining walls 60 and 62 when the portable toilet 8 is disposed upon the first and second plate portions 68 and 70.

The lifting frame 40 includes two locking plates 80 integrally and substantially horizontally joined to the second retaining wall 62 such that the two locking plates 80 retain a corresponding base or bottom portion 78 of the vertically orientated portable toilet 8 disposed upon the second support member 52. The lifting member 12 further includes a portable toilet retaining portion 82 pivotally secured to a first end 84 of the pivoting lifting frame 40. The portable toilet retaining portion 82 is disposed in a first position 86 that allows a portable toilet 8 to be slid upon the first and second support members 50 and 52. The portable toilet retaining portion 82 is ultimately pivoted to a second position 88 (see FIG. 18) that locks a corresponding bottom portion 76 of the portable toilet 8 upon the first support member 50, thereby maintaining the position of the portable toilet 8 upon the first and second support members 50 and 52 of the lifting frame 12, irrespective of the portable toilet 8 being pivoted from a substantially vertical position to a substantially horizontal position inside the portable toilet washing enclosure 14. The portable toilet retaining portion 82 is pivotally urged from a non-retaining position 86 to a retaining position 88 via a stem portion 90 of a hydraulic drive cylinder 92 that ultimately returns to a non-retaining position 88 after the portable toilet 8 has been cleaned and returned to a vertical position outside the portable toilet washing enclosure 14. The drive cylinder 92 is controlled by a preprogrammed computer system 94 inside a weather proof enclosure 96 inside the washing enclosure 14. The computer control system 94 together with other system control members, including but not limited to input and output modules inside the enclosure 96, are disposed in a "dry" portion 95 of the washing enclosure 14 that is isolated from the "wet" portion 97 of the washing enclosure 14 that houses all the members that discharge liquid to wash the portable toilet 8. The dry and wet portions 95 and 97 are isolated via a plastic "curtain" 99 dimensioned to internal portions of the enclosure 14 such that the curtain 99 extends from floor to ceiling, and from wall to wall of the enclosure 14, thereby preventing liquid from entering the dry portion 95 that includes electrical components.

The first and second lifting members 54 and 56 are supported via a base frame 98 configured and dimensioned to support the first and second lifting members 54 and 56. The base frame 98 configuration and dimensions allow the base frame 98 to be disposed between predetermined portions of the portable toilet conveyor apparatus 24. The base frame 98 of the portable toilet lifting member 12 includes elevation members 100 for vertically positioning the base frame 98 at a predetermined elevation that cooperates with the elevation of the conveyor apparatus 24 and the portable toilet washing enclosure 14, thereby horizontal alignment between the base frame 98, conveyor apparatus 24 and the washing enclosure 14. The elevation members 100 are manually positioned to a predetermined elevation. Alternatively, elevation members can be positioned to a predetermined elevation by the computer control system 94. The elevation members 100 can be detachably or integrally connected to the base frame 98 via connectors well known to those of ordinary skill in the art.

The hydraulic drive cylinder 92 includes a securing member 102 rotationally secured to an anchor member 104 that is secured to the lifting frame 40 such that the rod or stem 90 of the cylinder 92 is able pivotally urge the portable toilet retaining portion 82 to a position that engages a cooperating top portion 72 of a bottom portion 76 of the portable toilet 8, thereby securing and retaining the portable toilet 8 to the first and second support members 50 and 52 of the portable toilet lifting frame 40 when the portable toilet 8 is pivoted to a horizontal position inside the portable toilet washing enclosure 14. The pivoting or rotation of the lifting frame 40 with a portable toilet 8 disposed upon the lifting frame 40 in a substantially vertical position, is achieved by the two lifting hydraulic cylinders 65 described above lifting the first and second lifting members 54 and 56 of the lifting frame 40, such that the back portion 114 of the frame 40 pivots or otherwise rotates until the portable toilet 8 is inserted into the enclosure aperture 46 of the ceiling member 44 in the washing enclosure 14 the lifting frame 40.

Referring to FIGS. 1-5, 9-11, 16, 17 and 19-21, the washing device for portable toilets 10 further includes a toilet seat elevation spray member 118 secured to a computer controlled toilet seat spray pneumatic cylinder 120 assembly that ultimately positions the toilet seat spray member 118 inside the internal chamber 22 of the portable toilet 8 when the portable toilet 8 is disposed in a substantially horizontal position inside the portable toilet washing enclosure 14. The toilet seat spray member 118 includes four nozzles that ultimately direct a liquid cleaning mixture upon a toilet seat (not depicted) engaging a top surface portion of a toilet tank 39 inside the internal chamber 22 of the portable toilet 8. The liquid directed against the toilet seat via the spray member 118 has sufficient pressure (substantially about 1200 psi at ambient temperature) at a liquid flow discharge rate of twelve gallons per minute to urge the toilet seat to pivot into a substantially horizontal position where the toilet seat is held for fifteen seconds, resulting in a total liquid quantity of four gallons being discharged into the internal chamber 22 by the spray member 118 for the respective portable toilet 8. While the spray member 118 pivots the toilet seat, the spray member 118 simultaneously pre-soaks the inside of the internal chamber 22 during the same fifteen second time span that the spray member 118 discharges liquid.

After the fifteen seconds have elapsed for the toilet spray member 118 to discharge liquid, the spray member 118 is retracted to its original position, and a three nozzle toilet tank wash spray member 122 is disposed inside the toilet tank 39 in the portable toilet 8 via a pneumatic cylinder (not depicted) controlled by the computer system 94 inside the enclosure 96 secured to a wall inside the dry portion 95 of the wash enclosure 14. The toilet tank wash spray member 122 discharges a liquid cleaning mixture of water and soap into the toilet tank 39 for thirty seconds at a flow rate of six gal per minute at a pressure 1200 psi at ambient temperature, resulting in a total liquid volume of three gallons being discharged into the toilet tank 39.

Simultaneously with the insertion of the spray member 118 into the toilet tank 39, skid nozzles 124 secured to angle irons 126 integrally joined to a bar 127 secured to an inner side wall of the inner member 73 of the lifting frame 40 and an inner side wall of an outer member 75 of the lifting frame 40, discharge the same water and soap mixture as the wash spray member 22 at a pressure of 1200 psi at ambient temperature, and a flow rate of eight gallons per minute for each skid nozzle 124 for thirty seconds, resulting in a total liquid volume of eight gallons of the water and soap being discharged for both skid nozzles 124 during the thirty seconds the skid nozzles 124 emit a spray. All the liquid wash emitted from the toilet spray member 118, toilet tank wash spray member 122 and the skid nozzles 124 clean and disinfect the bottom portions 76 and 78 of the portable toilet 8, and the internal chamber 22 and the toilet tank 39 inside the internal chamber 22. The liquid wash from the toilet spray member 118, toilet tank wash spray member 122 and skid nozzles 124 is gravity urged into receiving recess 128 disposed in a front portion 130 of a floor portion 132 of the portable toilet washing enclosure 14.

The toilet seat spray member 118 includes at least one nozzle 134 and preferably four rotating nozzles 134 that direct liquid to displace the toilet seat inside the portable toilet 8. The nozzles 134 ultimately direct liquid to engage portions of the internal chamber 22 besides the toilet seat of the portable toilet 8. Further, one or all of the nozzles 134 can be manually adjustable to direct liquid spray in multiple directions to predetermined portions of the chamber 22 of the portable toilet 8.

The washing device for portable toilets 10 further includes an internal chamber power washer member 135 having two rotating nozzles 137 that discharge a water-soap mixture upon the entire surface area of the internal chamber 22 of the portable toilet 8. The positioning of the power washer member 135 is achieved by a multiple hydraulic cylinder assembly (not depicted) well known to those of ordinary skill in the art and controlled by the computer system 94. Each nozzle 137 of the power washer member 135 discharges the water-soap mixture at a flow rate of 8 gallons per minute at a temperature of two hundred degrees Fahrenheit for thirty seconds, resulting in a total of eight gallons being discharged upon the surface of the internal chamber 22. The relatively high temperature of the water-soap mixture "opens" the pores of the plastic that forms the portable toilet 8, thereby maximizing the cleaning capability of the water-soap mixture when spraying the portable toilet 8 and removing liquid and solid residue from the inside and outside of the portable toilet 8.

Simultaneously with the operation of the internal chamber power washer member 135 upon the internal chamber 22 of the portable toilet 8, the external washing member 26 for the portable toilet 8 when the portable toilet 8 is horizontally disposed in the portable toilet washing enclosure 14 discharges the same two hundred degree Fahrenheit water-soap mixture liquid upon predetermined external portions of the portable toilet 8 when the portable toilet 8 is disposed in the substantially horizontal position inside the portable toilet washing enclosure 14. The external washing member 26 includes a rotary drive member 136 connected to at least one boom 138 and preferably multiple booms 138 having at least one and preferably a plurality of rotating spinner members 140 each having at least one nozzle 142 and preferably two nozzles 142 secured to the spinner member 140.

The rotating spinner member 140 directs the liquid from the nozzle 142 upon external portions of a portable toilet 8. The rotary drive member 136 positions one or more booms 138 adjacent to predetermined exterior surface portions of the portable toilet 8. The preferred external washing member 26 configuration includes one boom 138 having four rotating spinner members 140 with each spinner member 140 having two nozzles 142 (a total of eight nozzles 142) that discharge a water-soap mixture at a flow rate of two gallons per minute for one minute, resulting in a total of sixteen gallons of the water-soap mixture being discharged upon the external surface of the portable toilet 8. The relatively high temperature of the water-soap mixture when sprayed upon the outside walls of the portable toilet 8 opens the pores of the plastic outside walls and increases the quantity of liquid and solid residue removed from the outside walls.

After the water-soap mixture cleaning cycles for the power wash member 135 and the external washing member 26 have competed, the power wash member 135 and the external washing member 26 simultaneously discharge a disinfectant upon the internal chamber 22 and outer walls of the portable toilet 8. The total disinfectant discharged upon the internal chamber 22 and outer walls of the portable toilet 8 is two gallons. The total water-soap mixture and disinfectant discharged upon the portable toilet 8 by all five washing members or nozzles (external washing member 26, toilet spray member 118, toilet tank wash spray member 122, skid nozzles 124 and power wash member 135) is forty gallons.

The first apparatus for supplying liquid to the internal washing member 20 in the portable toilet washing enclosure 14 when the portable toilet 8 is disposed in a substantially horizontal position inside said portable toilet washing enclosure 14, includes a water storage member or tank 38 containing substantially two hundred and forty gallons of water at the beginning of the first portable toilet 8 to be washed. The first portable toilet 8 requires forty gallons to complete the wash cycle. All forty gallons of water is gravity urged into water receiving apertures 128 in the enclosure floor 132. The forty gallons includes soap and disinfectants mixed with the forty gallons. Another forty gallons accumulates in the floor 132 with the washing of the second portable toilet 8.

As a third portable toilet 8 is washed by the device 10, another forty gallons of water falls into the water receiving apertures 128; however, a discharge pump 152 recycles the water-soap-disinfectant mixture from the water receiving apertures 128 back to the water storage tank 38 via a high water limit switch (not depicted) disposed in a liquid removal section 176 of the floor 132 energizing a motor 154 that rotates the pump 152. The limit switch has a high water level set point corresponding to one hundred gallons of water-soap-disinfectant in the floor 132. The limit switch ultimately energizes the motor 154 when the water volume in the floor 132 exceeds one hundred gallons, resulting in the motor 154 urging the pump 152 to remove the water mixture from the liquid removal section 176 to the water storage tank 38, thereby maintaining substantially one hundred gallons of liquid in the floor 132 and one hundred and forty gallons of water containing soap and disinfectant in the tank 38, with a relatively small amount of water being lost to leakage from the portable toilet washing enclosure 14.

The first apparatus for supplying liquid to the internal washing members 20 in the portable toilet washing enclosure 14 when the portable toilet 8 is disposed in a substantially horizontal position inside the portable toilet washing enclosure 14, includes a relative high pressure water pump 144 driven by an electric motor 146 both being disposed in a dry portion 95 of the washing enclosure 14. The high pressure water pump 144 discharges water at substantially about 1200 psi through a first water control valve 148 that directs water to the toilet seat spray member 118 disposed in the portable toilet washing enclosure 14. The water is supplied by the water or liquid storage tank 38, which is elevated upon and secured to a top portion of the portable toilet washing enclosure 14. The first water control valve 148 is open and closed by an electronic signal from the computer system 94 in the enclosure 96. The computer system 94 together with the first water control valve 148 also controls the positioning and water discharge time operation time for the toilet seat spray member 118.

The first apparatus for supplying liquid to the internal washing members in the portable toilet washing enclosure 14 when the portable toilet 8 is disposed in a substantially horizontal position inside the portable toilet washing enclosure 14, further includes a third water control valve 151 that directs 1200 psi water to the external washing member 26 while being rotationally disposed about the portable toilet. The rotating external washing member f26 discharges water upon the outer walls of the portable toilet 8 via the rotary drive and boom members 136 and 138. The third water control valve 151 also directs water to the power washer member 135 disposed inside the internal chamber 22 of the portable toilet 8 while the toilet 8 is horizontally disposed inside the toilet washing enclosure 14. The third water control valve 151 is open and closed by an electronic signal from the computer system 94 in the enclosure 96. The computer system 94 together with the third water control valve 151 also controls the positioning and water discharge time for both the external washing member 26 and the internal power washer member 135.

The second apparatus for supplying liquid to the external washing members 26 in the portable toilet washing enclosure 14 when the portable toilet is disposed in a substantially horizontal position inside the portable toilet washing enclosure 14, includes a second water control valve 150 that directs 1200 psi water to the toilet tank wash spray member 122 when the spray member 122 is inside the toilet tank 39. The second water control valve 150 also directs 1200 psi water to the skid nozzles 124 adjacent to the bottom portion of the portable toilet 8 when the toilet 8 is horizontally disposed inside the toilet washing enclosure 14. The second water control valve 150 is open and closed by an electronic signal from the computer system 94 in the enclosure 96. The computer control system 86 together with the second water control valve 150 controls the positioning and water discharge time for both the toilet tank wash spray member 122 and the skid nozzles 124.

The third apparatus for controlling predetermined parameters of the liquid supplied to the internal washing member 20 in the portable toilet washing enclosure 14 via the first apparatus, includes a computer 94 having first inputs and first outputs (not depicted) for controlling liquid parameters, including but not limited to pressure and flow, for washing the internal chamber 22 of the portable toilet 8.

The fourth apparatus for controlling predetermined parameters of said liquid supplied to the external washing member 26 in the portable toilet washing enclosure 14 via the second apparatus, includes a computer 94 having second inputs and second outputs (not depicted) for controlling liquid parameters, including but not limited to pressure and flow, for washing external portions of the portable toilet 8.

The liquid collection and liquid purifying apparatus 36 for recycling liquid from the washed portable toilet 8 to the liquid storage tank 38 includes a recycle pump 152 driven by an electric motor 154 controlled by a level switch (not depicted) in a floor portion 156 of the portable toilet washing enclosure 14. The recycle pump 152 ultimately removes liquid from the floor portion 156 and urges the liquid to the elevated liquid storage tank 38, whereupon, the liquid is ultimately used to clean a portable toilet 8.

Figure 22:
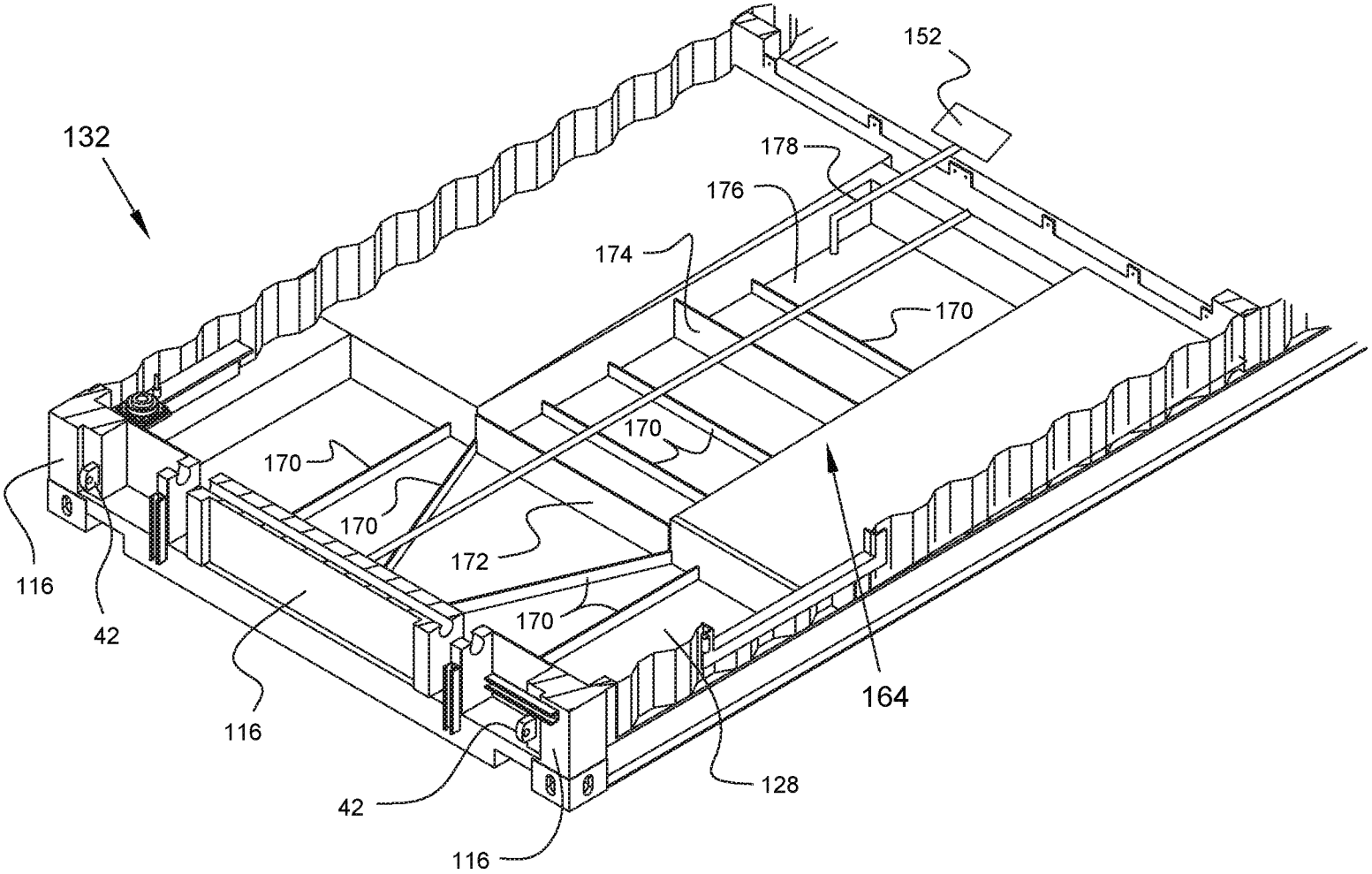
FIG. 22 is a perspective view of a floor of the wet portion of the washing enclosure of the device of FIG. 1.
Figure 23:
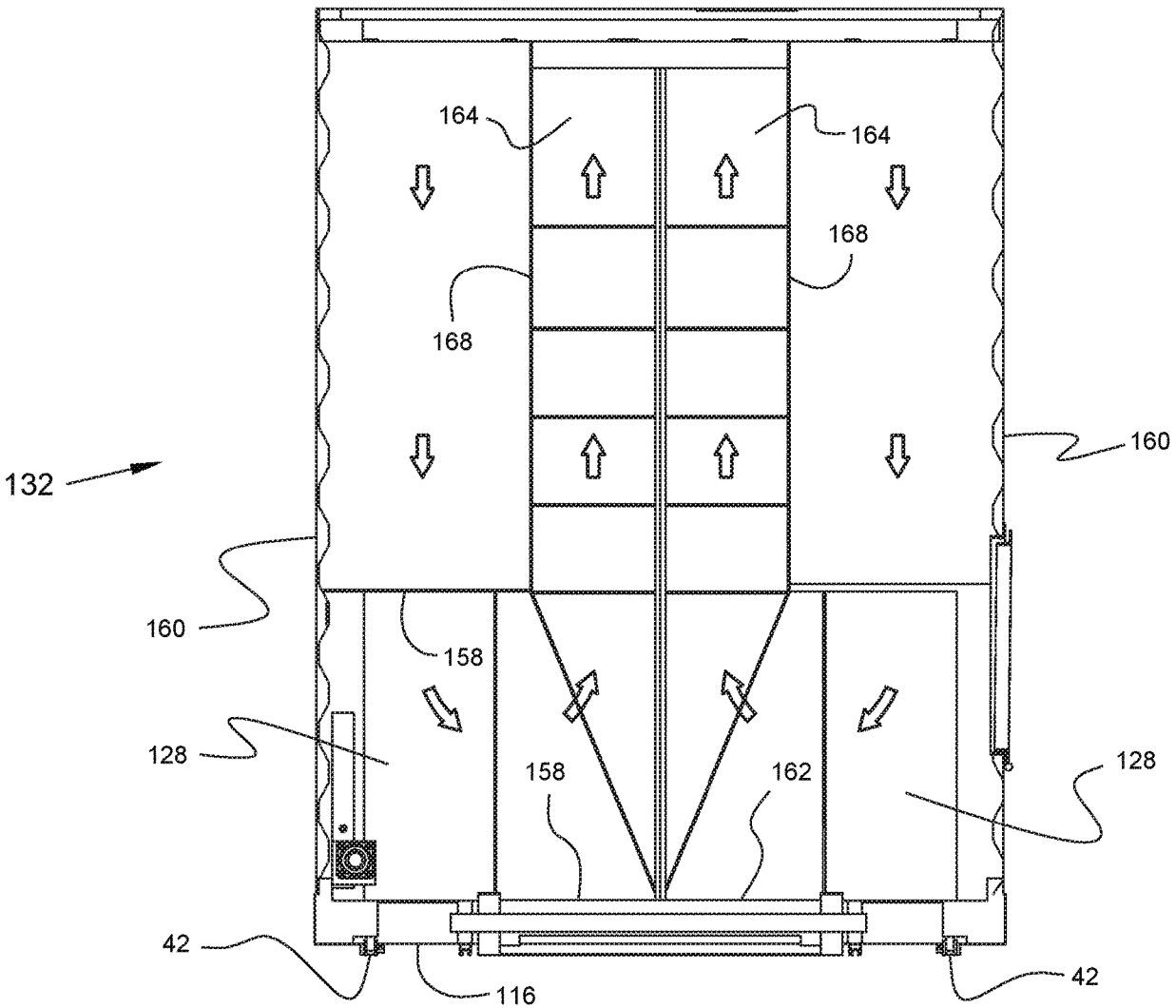
FIG. 23 is a top view of the floor of FIG. 22.
Figure 24:
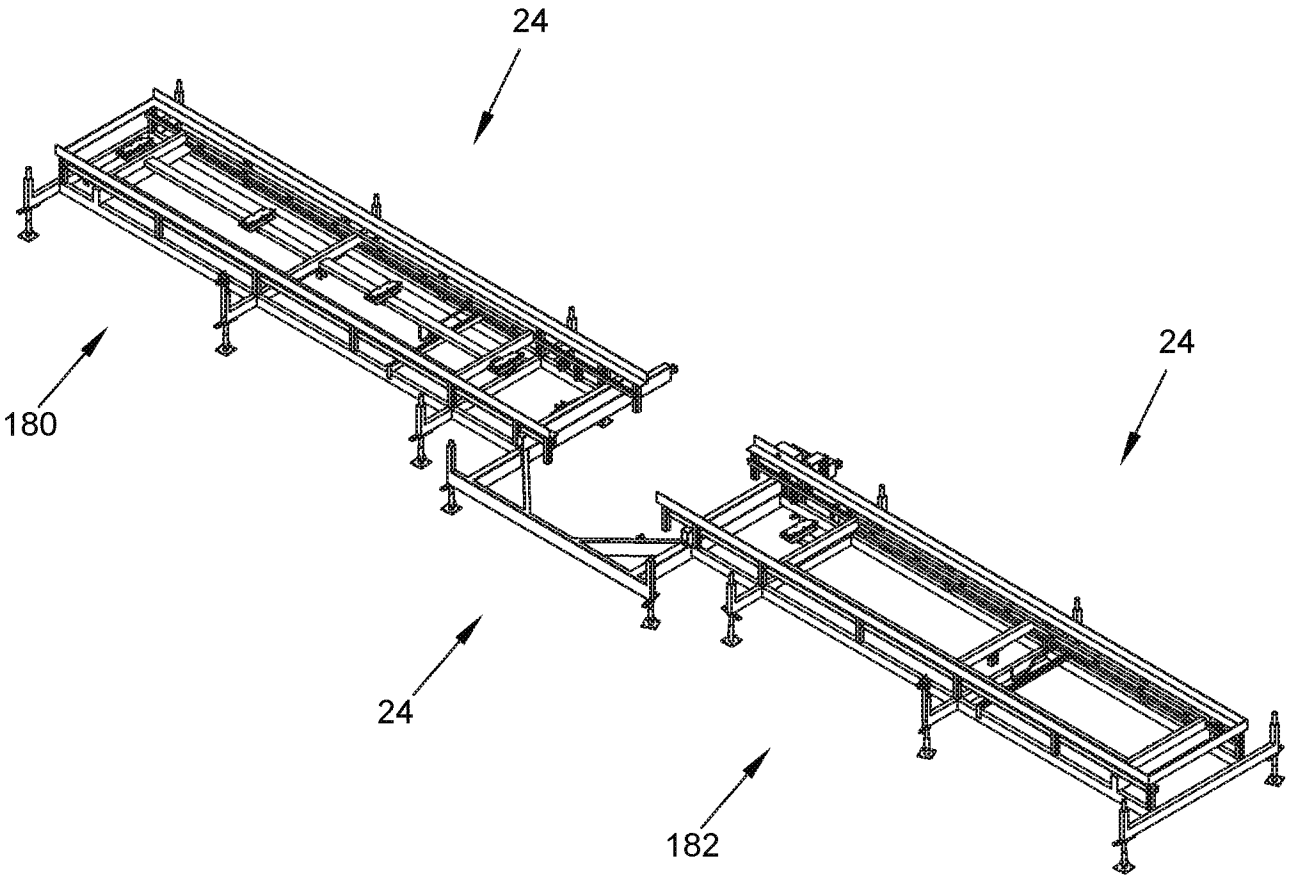
FIG. 24 is the perspective view of the conveyor portion of FIG. 7, but with no portable toilets disposed on the conveyor portion.
Figure 25:
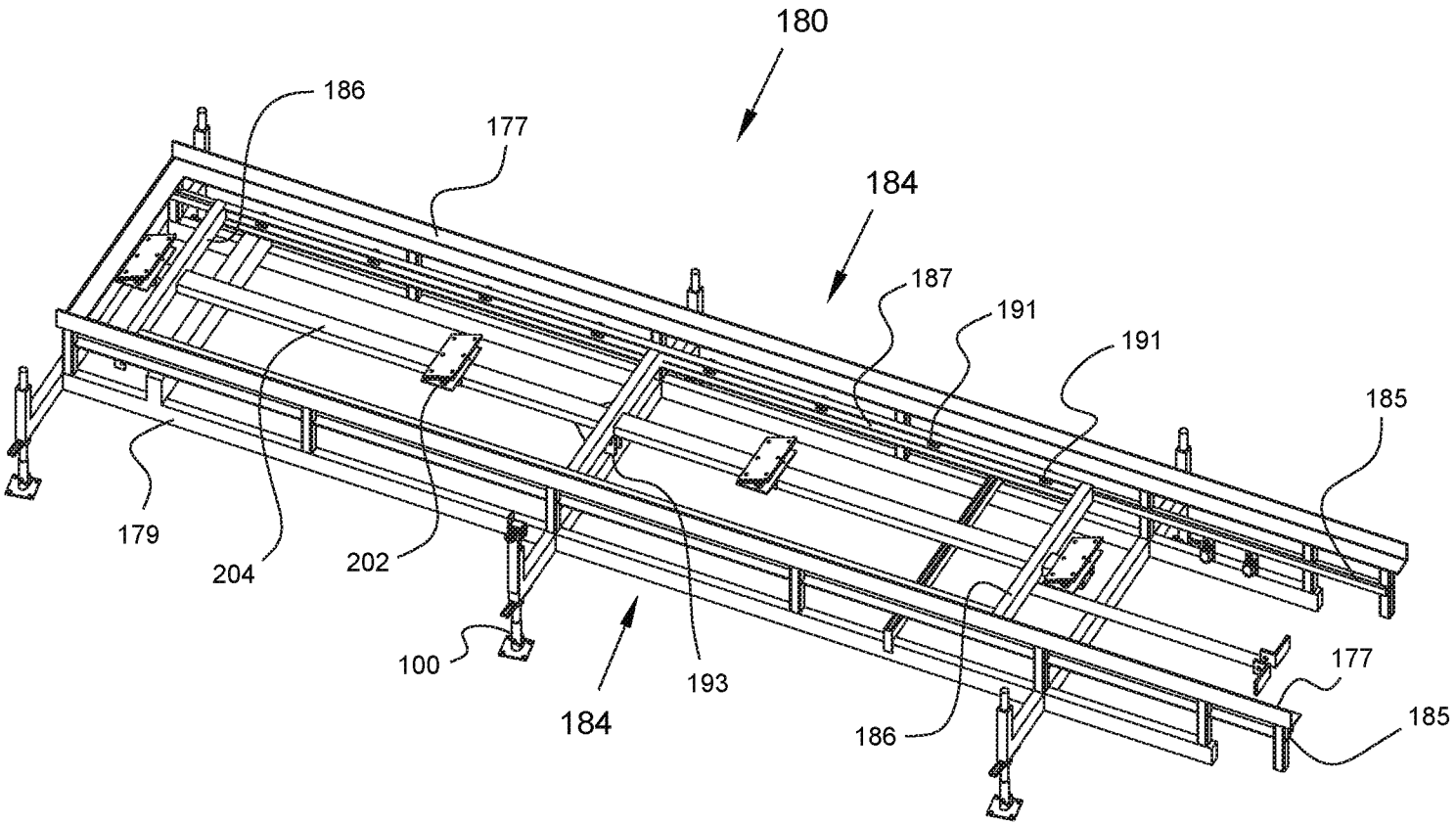
FIG. 25 is a perspective view of a portable toilet input conveyor of the device of FIG. 1.
Figure 26:
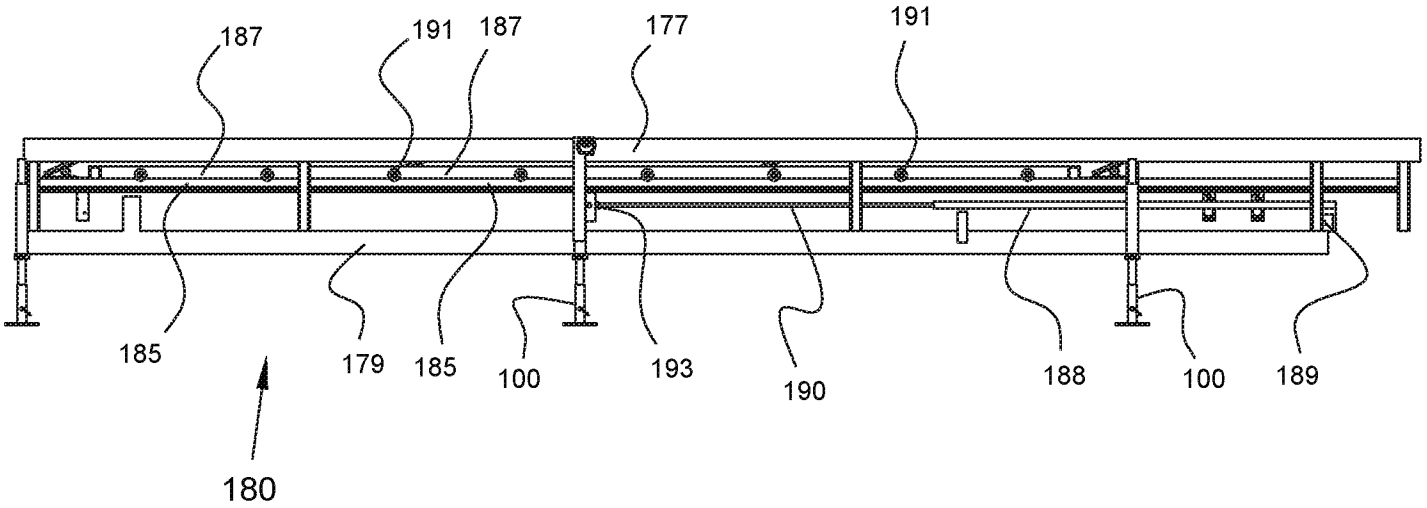
FIG. 26 is a side elevation view of the input conveyor of FIG. 25.
Figure 27:
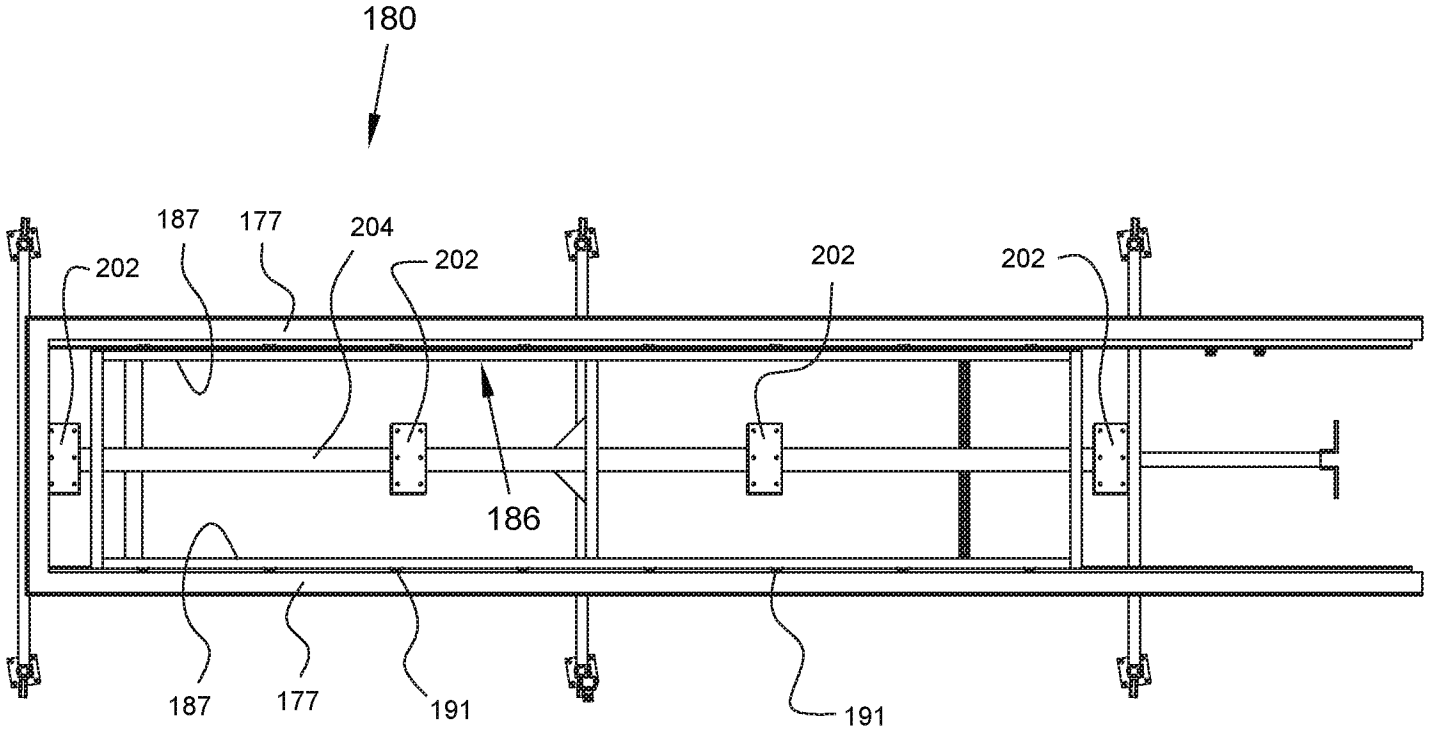
FIG. 27 is a top view of the input conveyor of FIG. 26.
Figure 28:
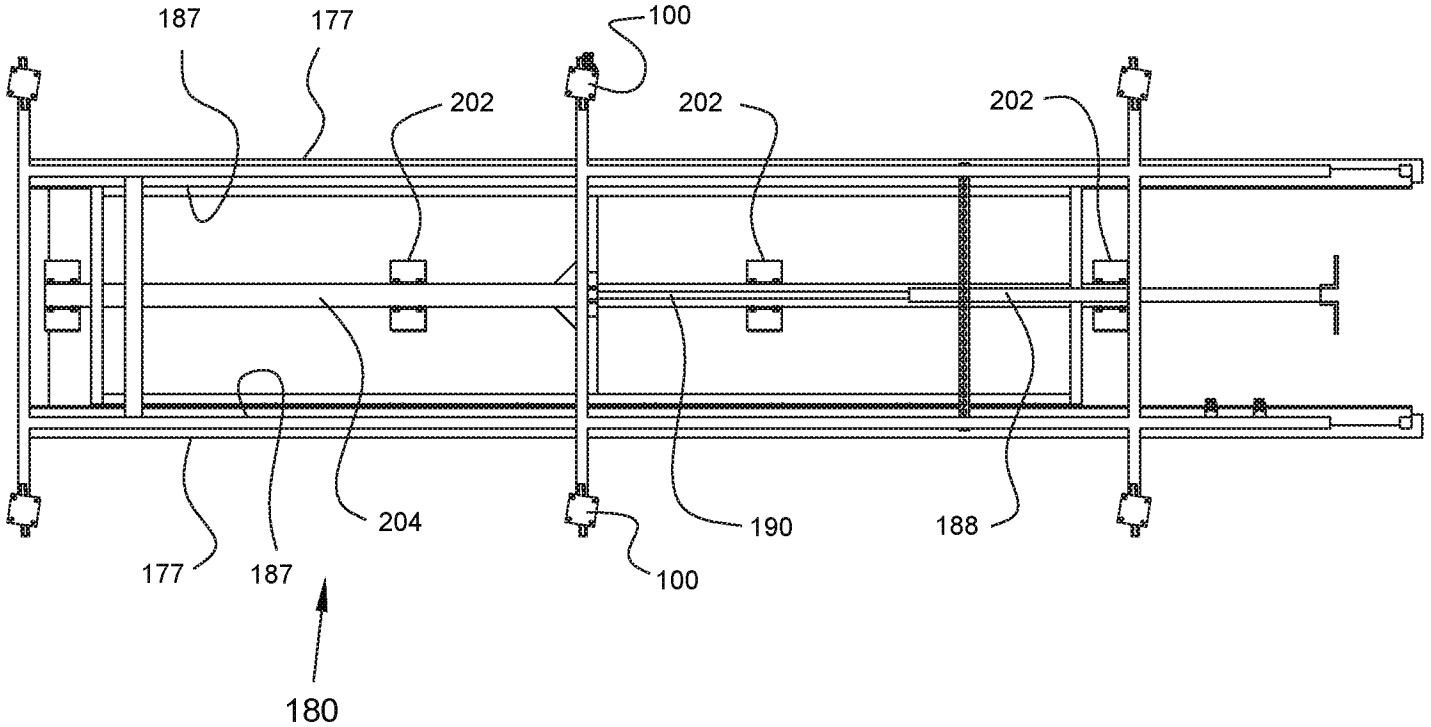
FIG. 28 is a bottom view of the input conveyor of FIG. 27.
Figure 29:
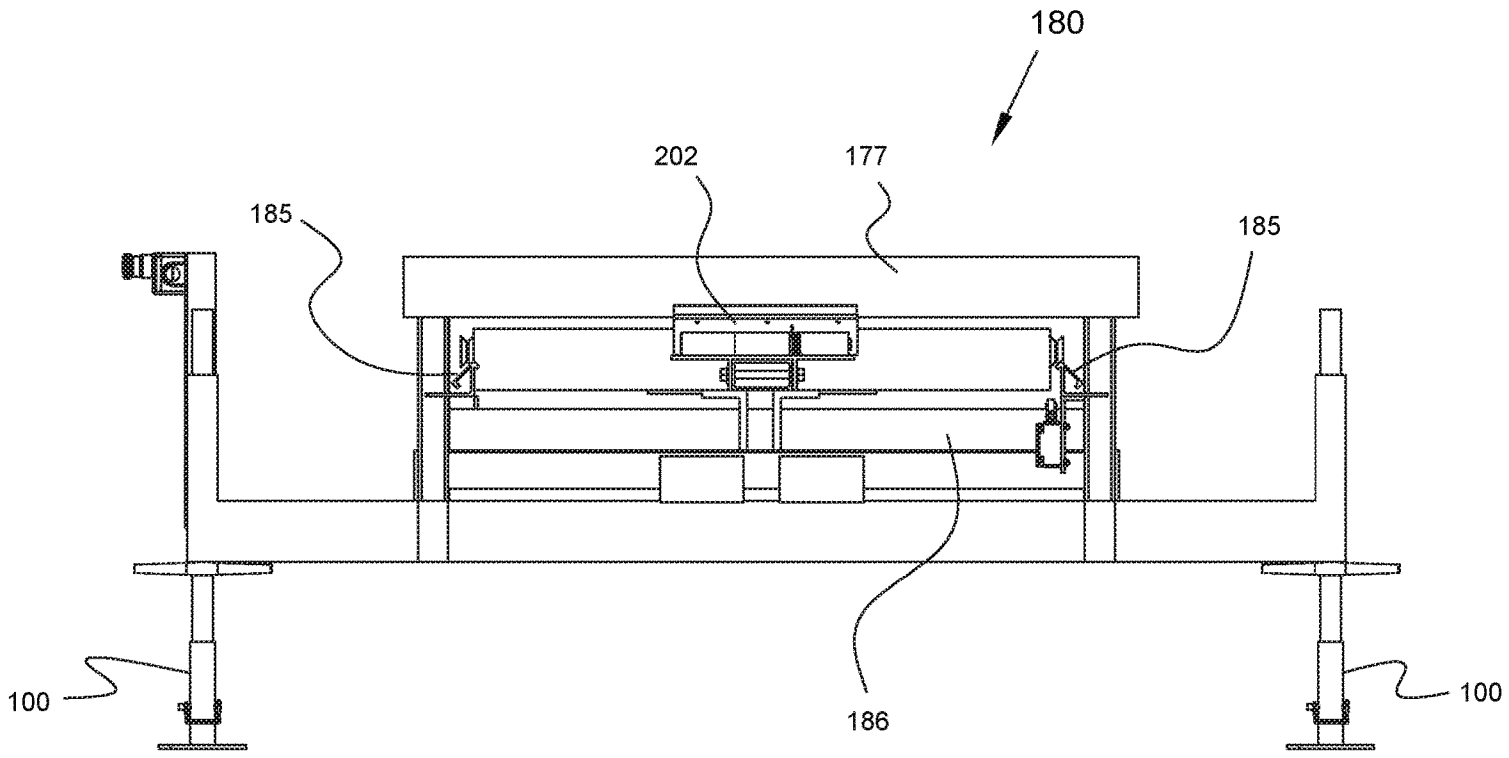
FIG. 29 is a portable toilet loading end view of the conveyor of FIG. 25.
Figure 30:
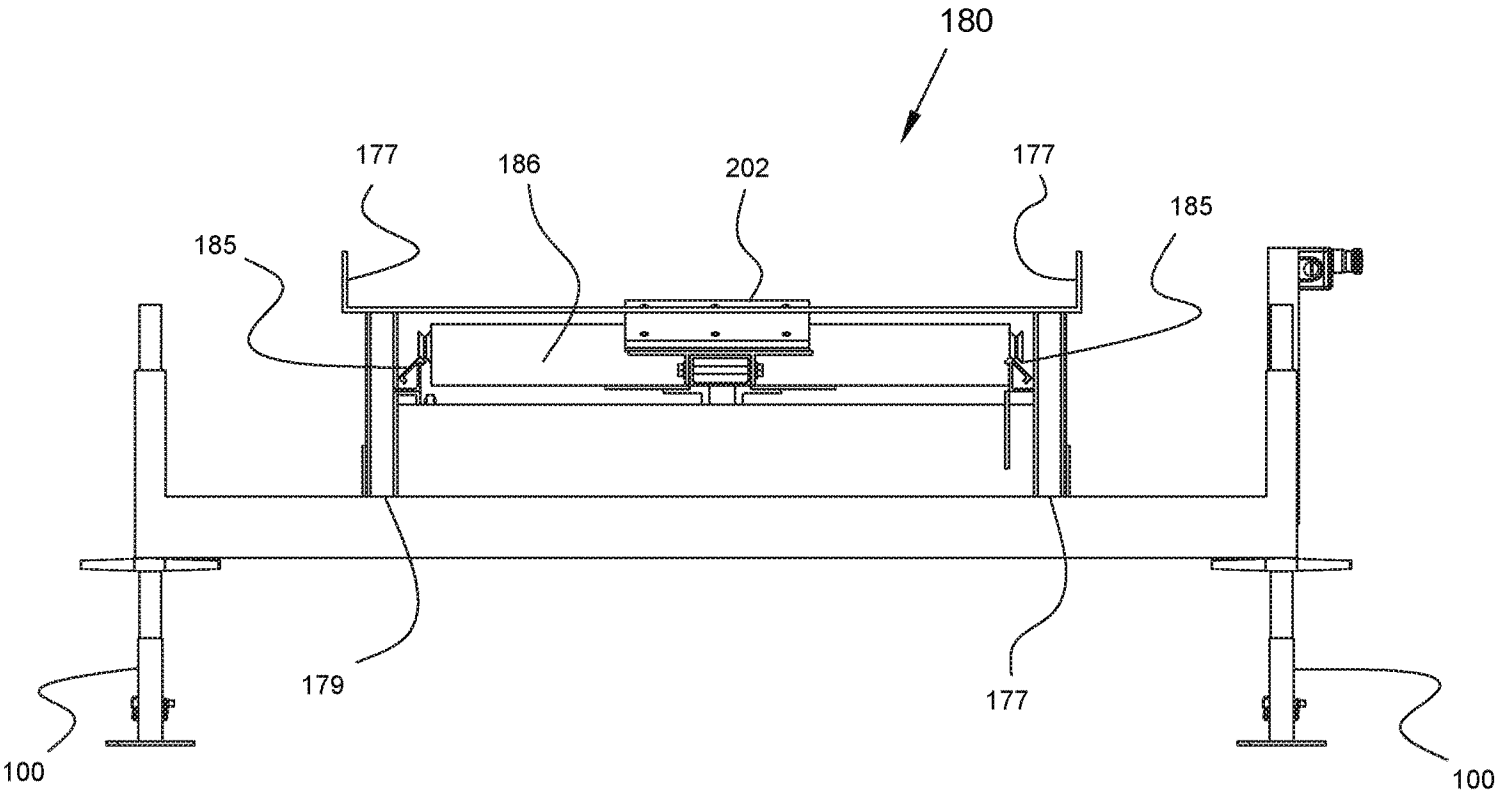
FIG. 30 is a portable toilet exit end view of the conveyor of FIG. 29 where the input conveyor engages the portable toilet lifting member.
Figure 31:
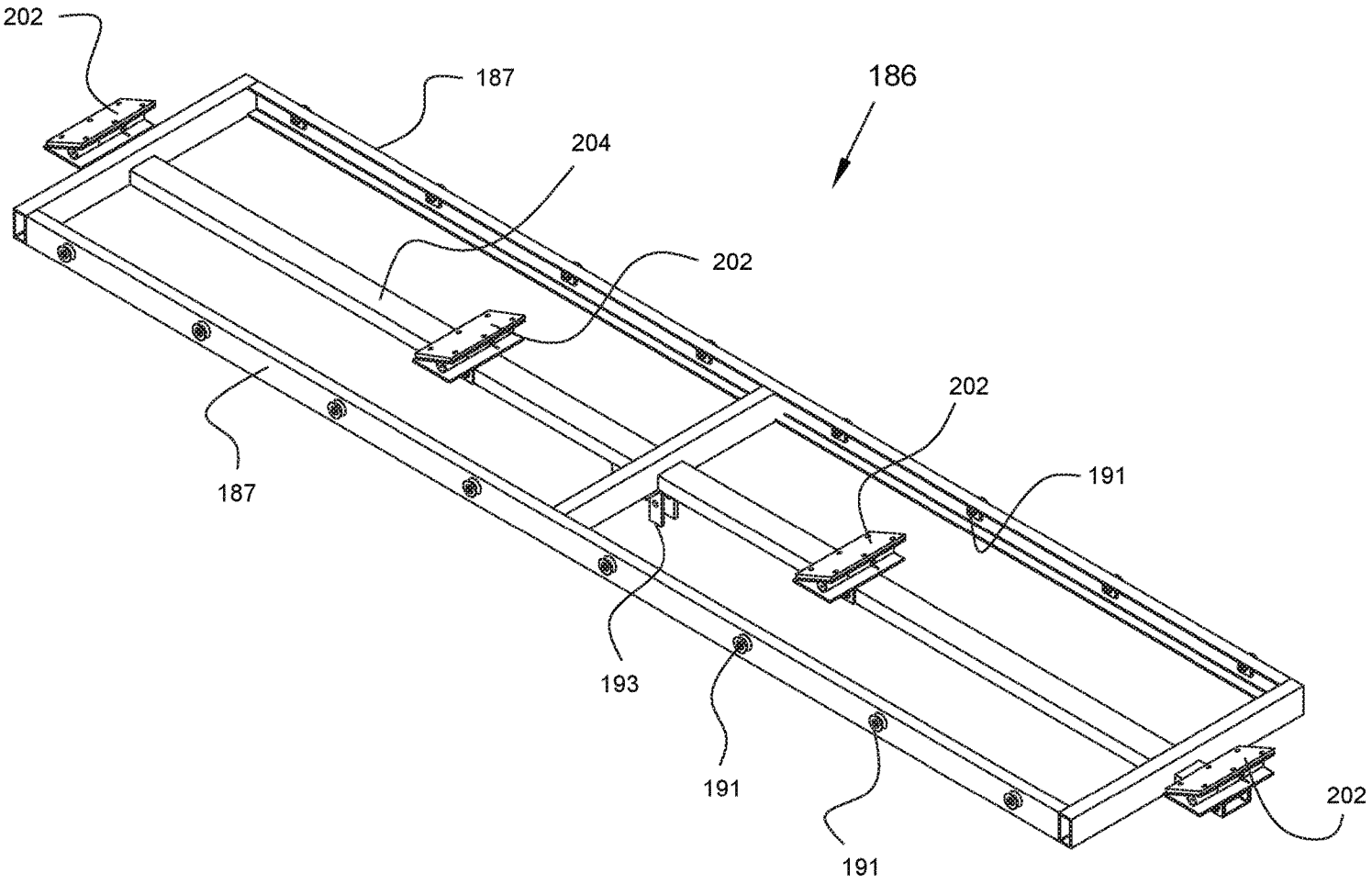
FIG. 31 is a perspective view of an input chasse portion of the input conveyor of FIG. 25.
Figure 32:
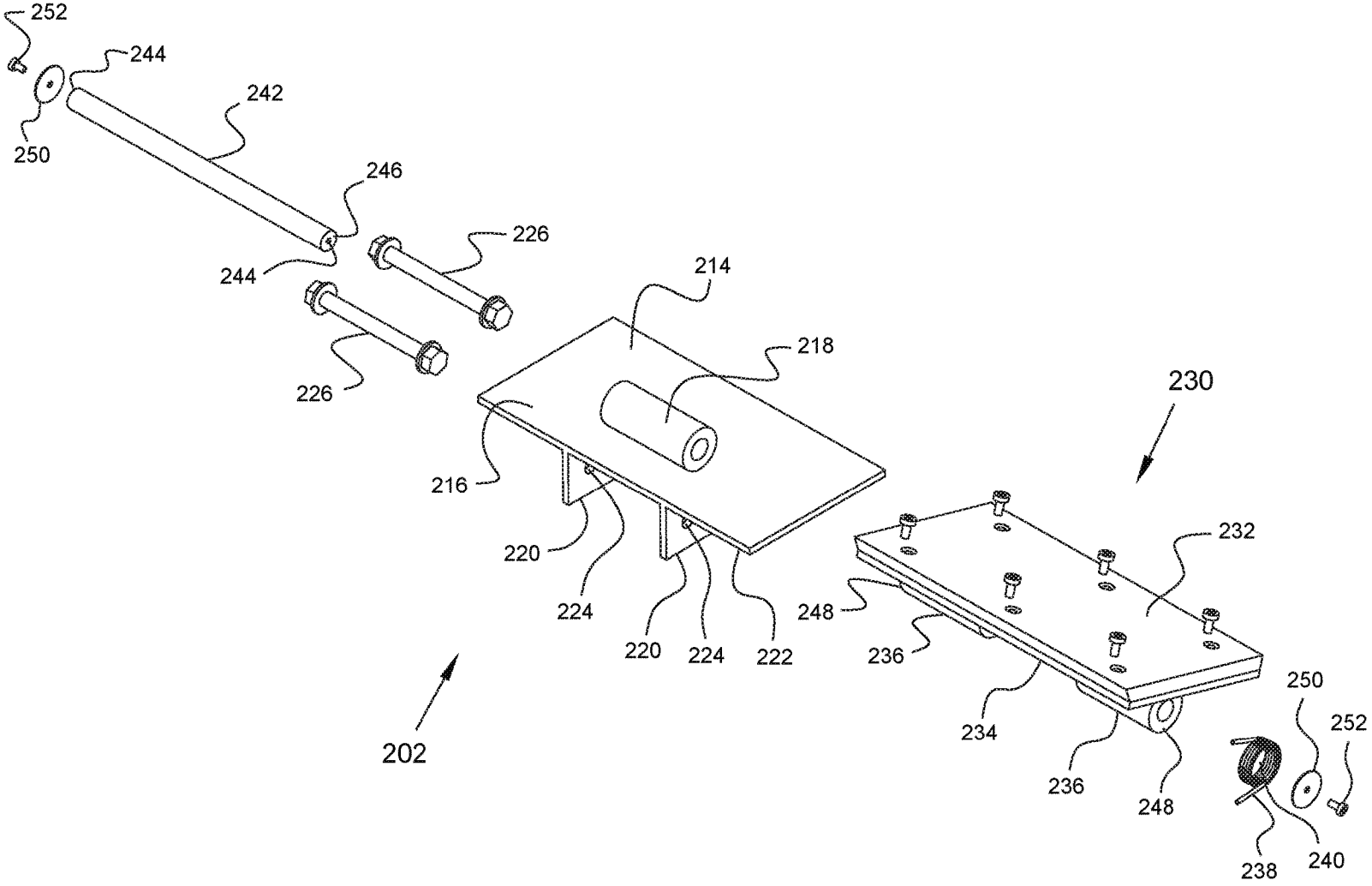
FIG. 32 is a perspective view of a flipper member of the input conveyor of FIG. 25 and the output conveyor of FIG. 35.
Figure 33:
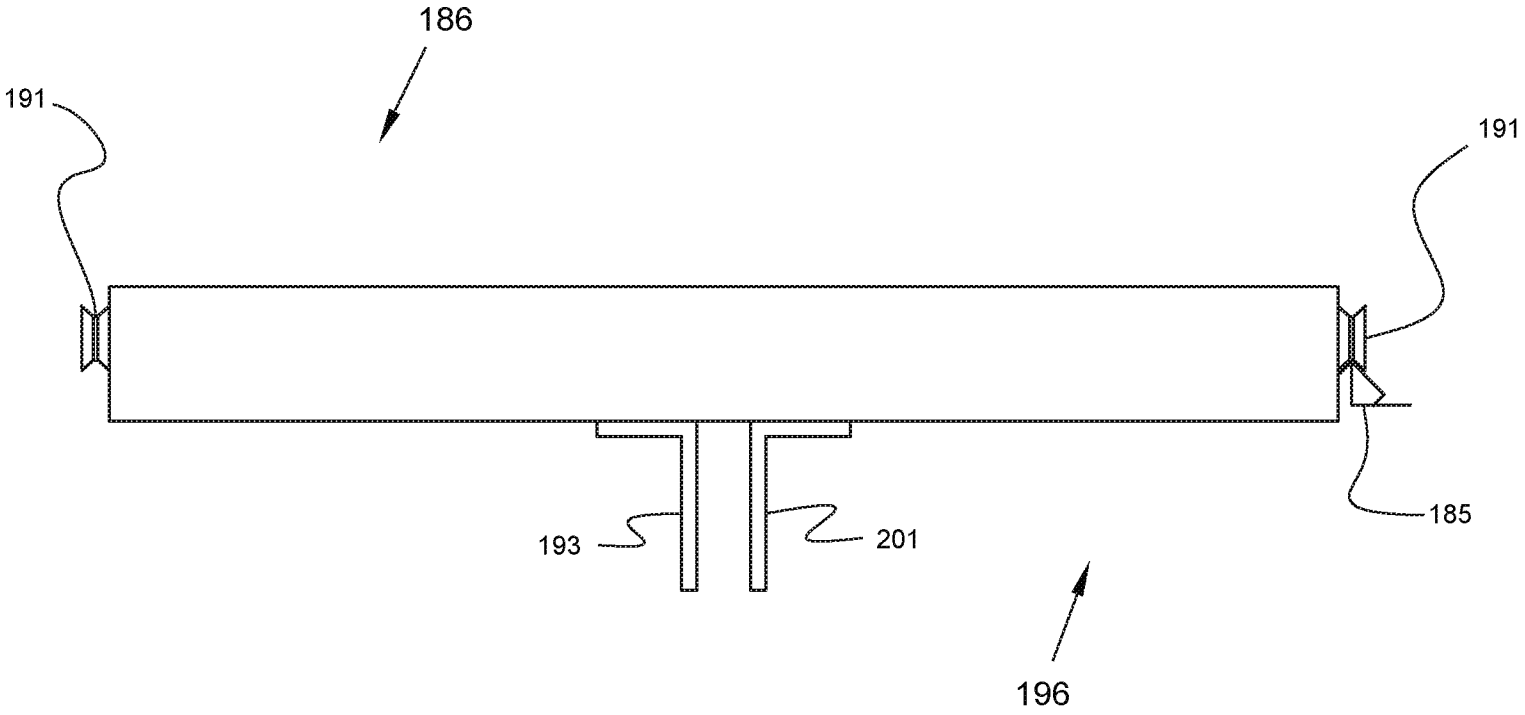
FIG. 33 is side elevation view of a drive bracket for detachably receiving a rod end of a hydraulic cylinder that ultimately horizontally moves the input chasse of FIG. 31.
Figure 34:
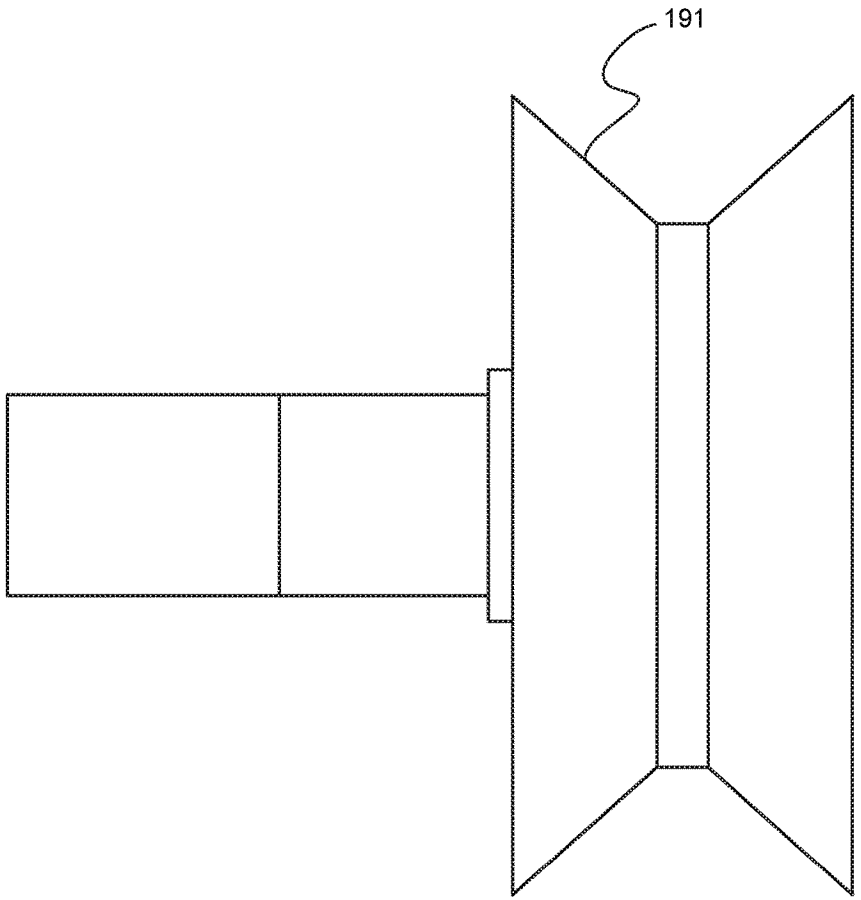
FIG. 34 is a side elevation view of a roller depicted in FIG. 33. The roller promotes horizontal movement of the input chasse of FIG. 31.
Figure 35:
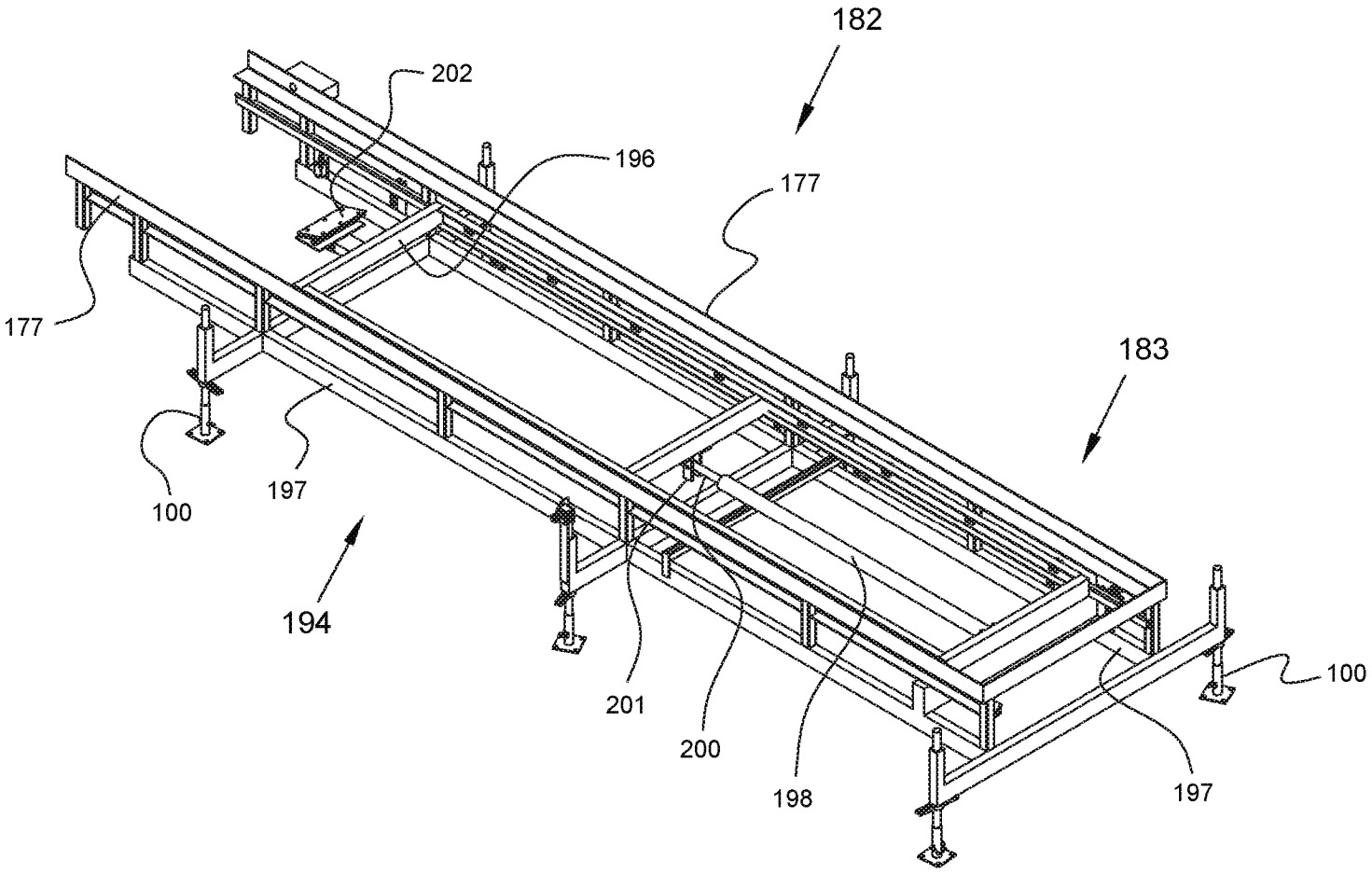
FIG. 35 is a perspective view of a portable toilet output or output conveyor of the device of FIG. 1.
Figure 36:
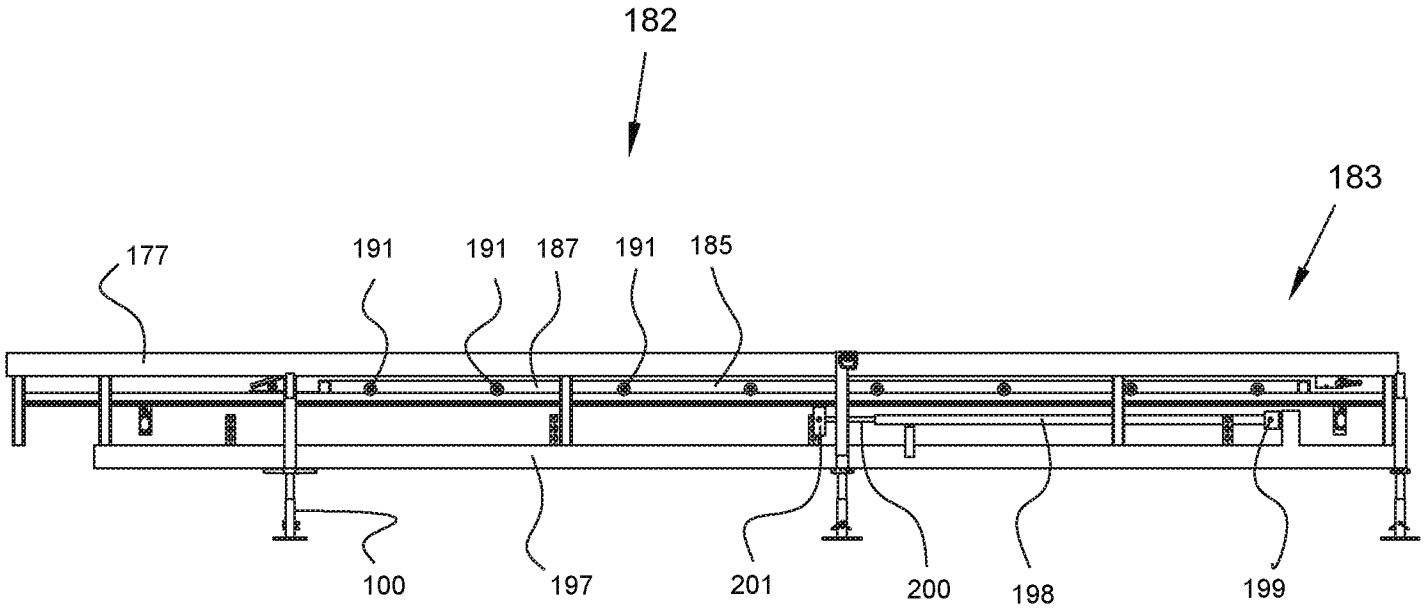
FIG. 36 is a side elevation view of the output conveyor of FIG. 35.
Figure 37:
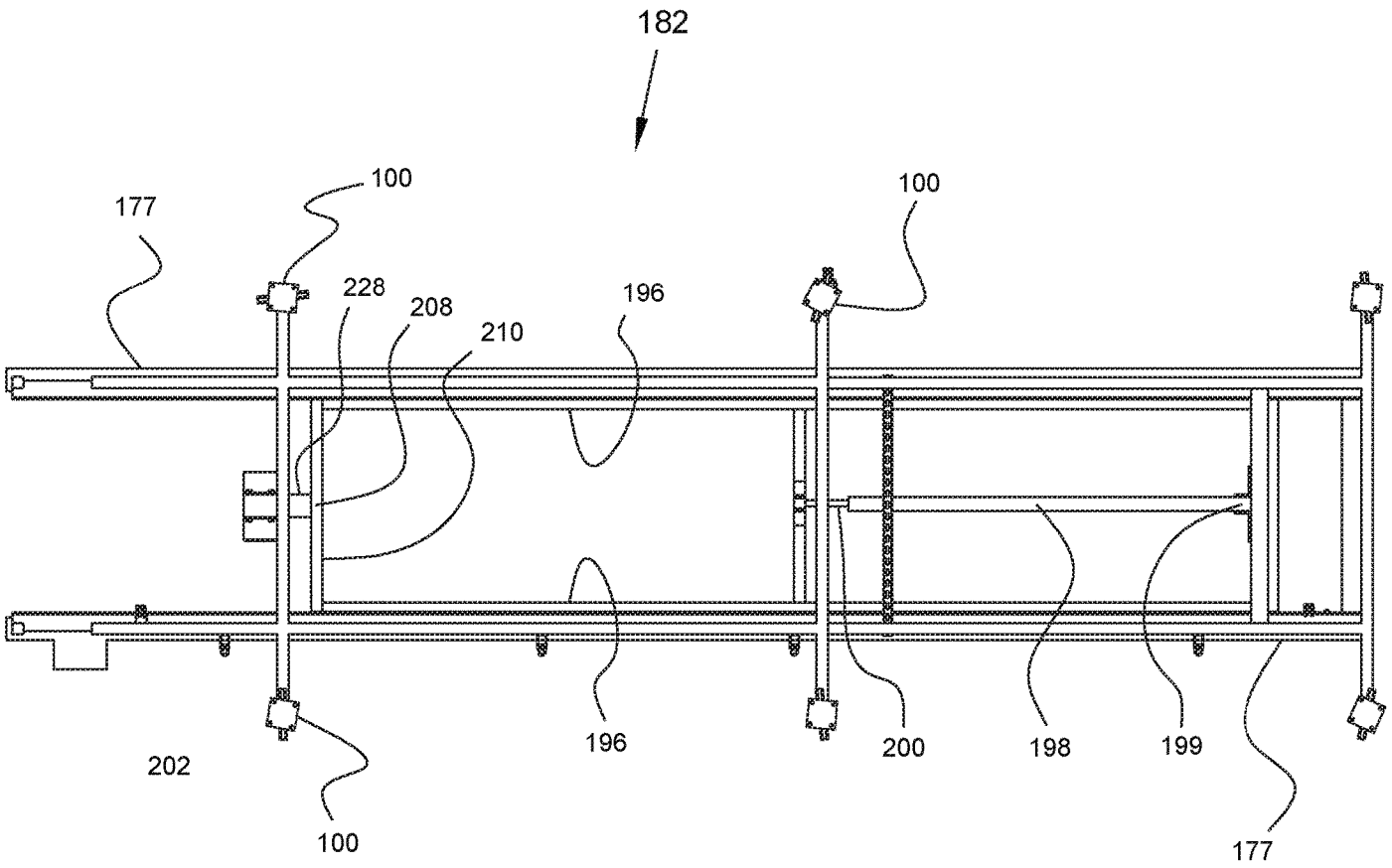
FIG. 37 is a bottom view of the output conveyor of FIG. 36.
Figure 38:
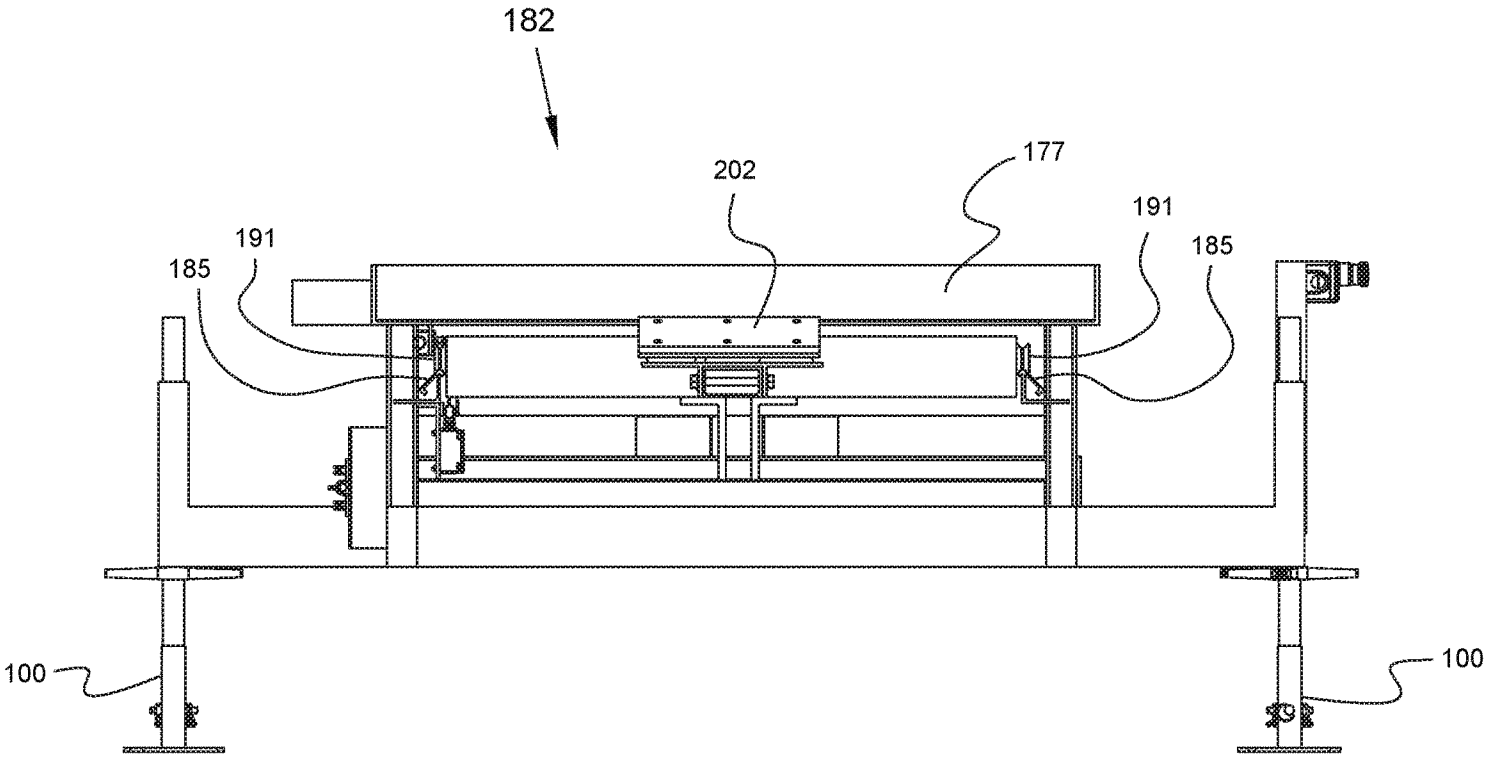
FIG. 38 is a portable toilet receiving end view of the conveyor of FIG. 35 where the output conveyor engages the portable toilet lifting member and a washed portable toilet exiting the portable toilet lifting frame is disposed upon the output conveyor.
Figure 39:
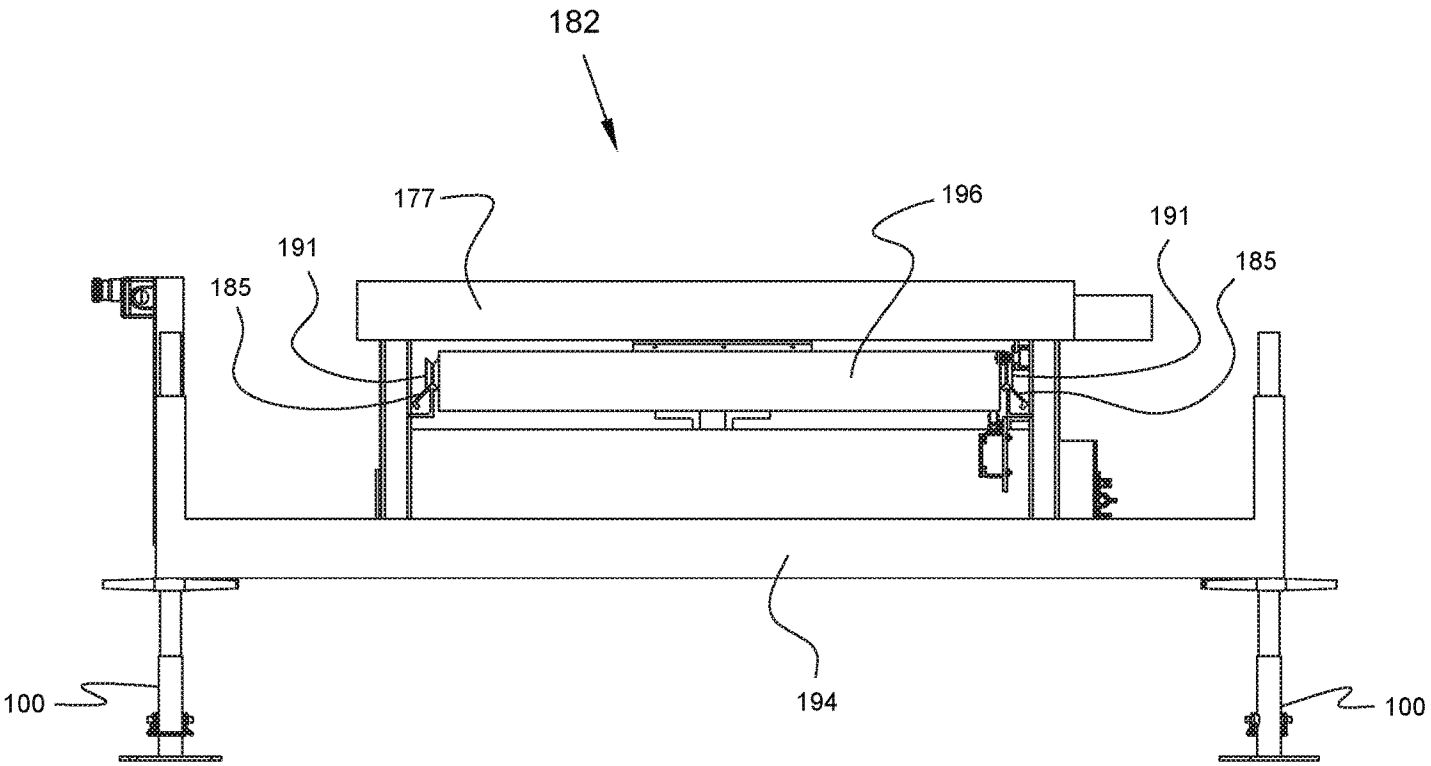
FIG. 39 is a portable toilet exit end view of the output conveyor of FIG. 35 where the washed portable toilet is removed from output conveyor.
Figure 40:
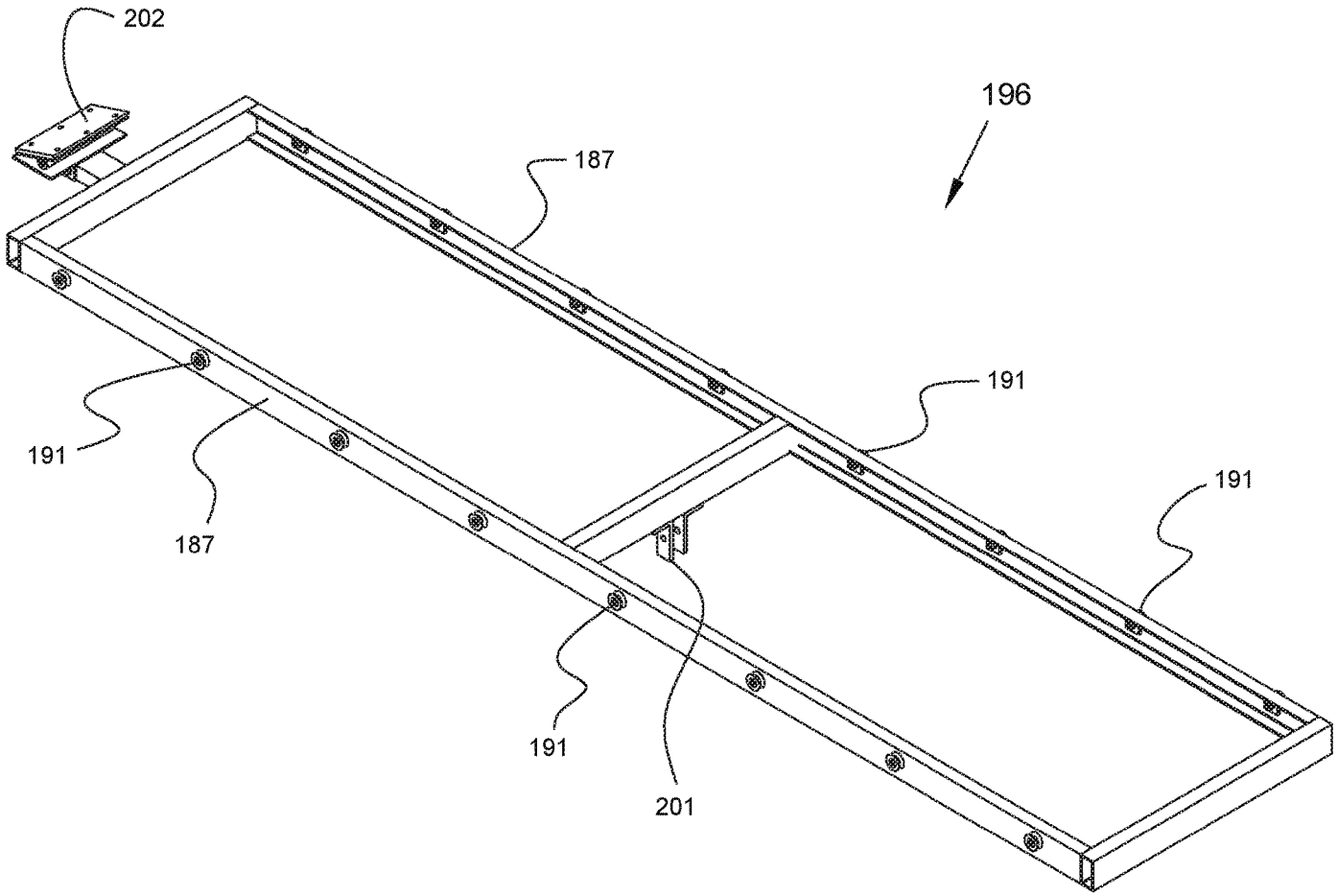
FIG. 40 is a perspective view of an output chasse portion of the output conveyor of FIG. 35.
Figure 41:
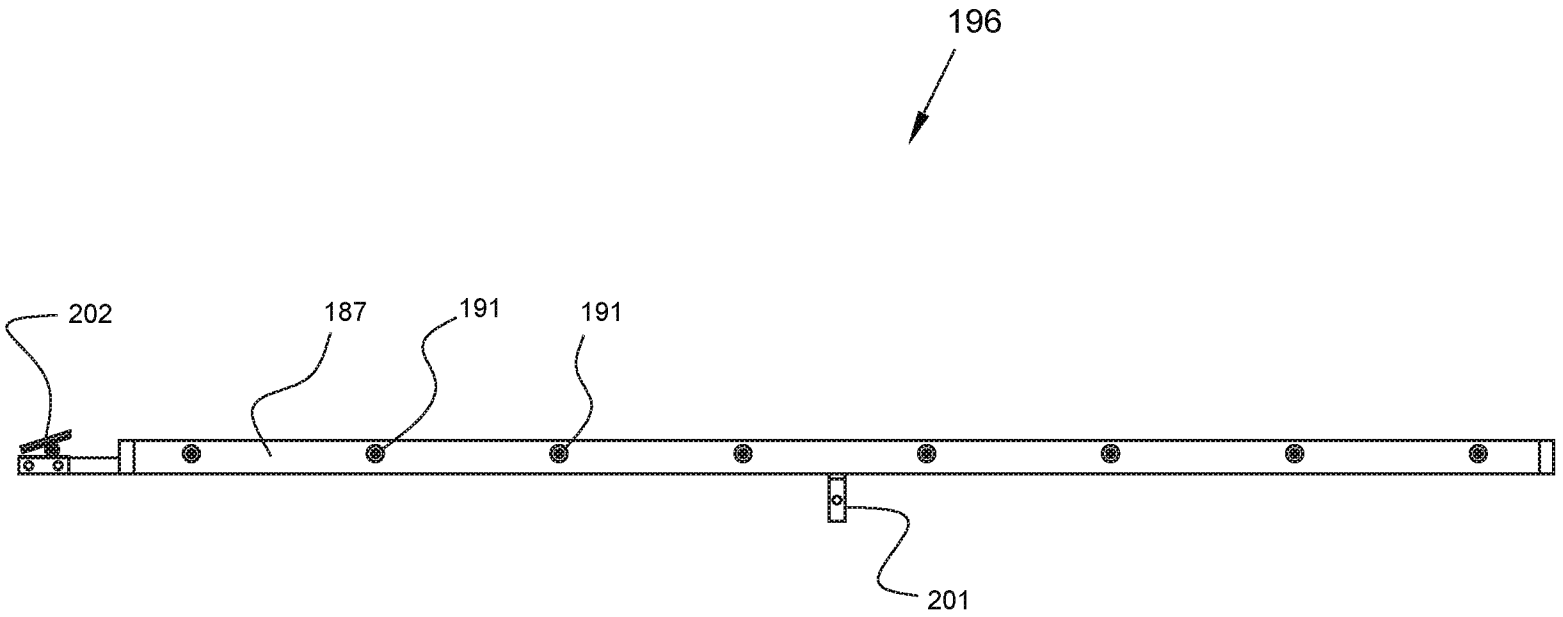
FIG. 41 is a side elevation view of the output chasse of FIG. 40.

Referring to FIGS. 22 and 23, the liquid collection and liquid purifying apparatus 36 for recycling liquid from the washed portable toilet 8 to the liquid storage tank 38 includes a floor portion 156 that includes, a solid and liquid material receiving recess 128 disposed adjacent to a front portion 130 of the portable toilet washing enclosure 14 such that longitudinal walls of the recess 128 extend substantially perpendicular and adjacent to longitudinal walls 160 of the portable toilet washing enclosure 14. The recess 128 includes a front wall 162 adjacent to a front portions 116 of the enclosure 14. The recess 128 has longitudinal and lateral dimensions that enable the solid and liquid material receiving recess 128 to capture substantially all of the solid material, if any, from a cooperatively disposed toilet tank 39 in a portable toilet 8 horizontally disposed inside the portable toilet washing enclosure 14.

The liquid collection and liquid purifying apparatus 36 further includes a central recess 164 disposed such that sloped floor surfaces 166 are disposed on opposite longitudinal sides 168 of the central recess 164, whereby, the liquid from the horizontally disposed portable toilet 8 flows into the solid and liquid receiving recess 128 or the central recess 164.

The liquid collection and liquid purifying apparatus 36 further includes a plurality of vertically disposed first plates 170 having relatively small vertical dimensions disposed in said waste receiving and said central recesses 128 and 164. The first plates 170 promote the separation of solid materials, if any, from the liquid in the waste receiving recess 128 when liquid elevation in the waste receiving recess 128 rises. The rising liquid elevation ultimately flows over a second plate 172 vertically disposed and having a relatively greater vertical dimension than the first plates 170. The second plate 172 separates the solid and liquid material receiving recess 128 from the central recess 164. The second plate 172 promotes the retention of the solid material, if any, in the solid and liquid material receiving recess 128 and promotes the flow of said liquid into the central recess 164, whereupon, the liquid flows over a plurality of first plates 170 in the central recess 164 until engaging a third vertically disposed plate 174 having substantially the same vertical dimension as said second plate 172. The third plate 174 further promotes the separation of solid material, if any, from liquid as the liquid elevation rises and flows over said third plate 174. The rising liquid elevation continues to fill the central recess 164 until the liquid flows over a last first plate 170 to separate the liquid from remaining solid material, if any, thereby purifying the liquid sufficiently to allow the liquid to be pumped from a removal section 176 of the central recess 164 via a suction line 178 inserted into the removal section 176. The suction line 178 is connected to a liquid discharge pump 152 that ultimately urges the liquid from the removal section 176 and into the liquid storage tank 38, whereupon, the liquid is ultimately used to wash internal and external portions of the portable toilet 8. If any solid material accumulates in either recess 128 or 164, the solid material manually removed or removed by a vacuum truck. When the wash cycle (substantially about three minutes) has completed, the portable toilet is removed from the enclosure 14 and vertically disposed upon a portable toilet conveyor apparatus 24.

The dry portion 95 of the portable washing toilet enclosure 14 further includes a hydraulic oil supply system having a hydraulic oil storage tank (not depicted) disposed outside the enclosure 14 that supplies hydraulic oil to a pump (driven by an electric motor 262) inside a tank 260 that urges the hydraulic oil to a hydraulic manifold 264, which includes a plurality of computer controlled two position hydraulic proportional valves 266 that direct hydraulic oil to and from respective hydraulic cylinders (describe above) that control the operations of the portable toilet lifting member 12 and the conveyor apparatus 24. The computer system 94 positions each hydraulic valve 266 such that a maximum oil flow is allowed to and from either side of the corresponding hydraulic cylinder to place the respective cylinder rod and the equipment attached to the rod at a position determined by the computer system 94 to enable a series of portable toilets 8 to be moved initially by the input conveyor 180 until one of the portable toilets 8 is disposed upon the toilet lift member 12; whereupon, the toilet 8 is elevated and horizontally positioned in the washing enclosure 14 with the toilet door 16 open to enable the internal portions of the toilet 8 to be washed together with the outer portions of the toilet 8, until the toilet 8 is repositioned in a vertical position the base frame 98 of the lift member 12, then moved upon the output conveyor 182 until the portable toilet 8 is moved to an end portion 183 of the output conveyor 182 where the toilet 8 is removed for storage.

Referring to FIGS. 24-41, the portable toilet conveyor apparatus 24 for serially moving a plurality of portable toilets 8 to and from the portable toilet lifting member 12, includes a portable toilet input or infeed conveyor 180 for horizontally moving at least one vertically disposed portable toilet 8 from a first position on the conveyor apparatus 24 to a vertical position on the portable toilet lifting member 12, thereby positioning the vertically disposed portable toilet 8 for pivotal movement to a horizontal position inside the portable toilet washing enclosure 12. The conveyor apparatus 24 further includes a portable toilet output or outfeed conveyor 182 for horizontally moving a washed vertically disposed portable toilet 9 from the portable toilet lifting member 12 to a second vertical position on the conveyor apparatus 24, whereupon, the washed vertically disposed portable toilet 9 is removed from the portable toilet output conveyor 182 to a place of storage.

The input conveyor 180 of the conveyor apparatus 24 includes an input base structure 184 having two opposite longitudinally parallel structural steel base beams 179 (separated substantially about forty-eight inches) that provide support for multiple components of the input conveyor 180 detailed below. A plurality of vertically adjustable base stands 100 are secured to the base beams 179 to position the input base structure 184 in a substantially horizontal position and at a predetermined elevation to promote horizontal movement of the portable toilet 8 upon the input conveyor 180. The input base structure 184 includes two opposite longitudinally parallel structural steel support channels 185 integrally joined to structural steel that forms the input conveyor 180. The support channels 185 are laterally separated substantially about forty-two inches and ultimately receive wheels or rollers 191 secured to an input chasse 186 having two opposite longitudinally parallel structural steel toilet support beams 187 separated substantially about forty-two inches to support corresponding back and front bottom portions 76 and 78 (also separated substantially about forty-two inches) of the portable toilet 8. The rollers 191 of the input chasse 186 engage and rotate upon the support channels 185 such that the input chasse 186 horizontally moves upon the rollers 191 when the input chasse 186 is forcibly urged horizontally by a hydraulic cylinder 188 secured via a base 189 to the base structure 184 of the input conveyor 180 and secured to the input chasse 186 via a stem or rod 190.

The output conveyor 182 of the conveyor apparatus 24 includes an output base structure 194 having two opposite longitudinally parallel structural steel base beams 197 (separated substantially about forty-eight inches) that provide support for multiple components of the output conveyor 182 detailed below. A plurality of vertically adjustable base stands 100 are secured to the base beams 197 to position the output base structure 194 in a substantially horizontal position and at a predetermined elevation to promote horizontal movement of the portable toilet 8 upon the output conveyor 182. The output base structure 194 includes two opposite longitudinally parallel structural steel support channels 185 integrally joined to structural steel that forms the output conveyor 182. The support channels 185 are laterally separated substantially about forty-two inches and ultimately receive wheels or rollers 191 secured to an output chasse 196 having two opposite longitudinally parallel structural steel toilet support beams 187 separated substantially about forty-two inches to support corresponding back and front bottom portions 76 and 78 (also separated substantially about forty-two inches) of the portable toilet 8. The rollers 191 of the output chasse 196 engage and rotate upon the support channels 185 such that the output chasse 196 horizontally moves upon the rollers 191 when the output chasse 196 is forcibly urged horizontally by a hydraulic cylinder 198 secured via a base 199 to the base structure 194 of the output conveyor 182 and secured to the output chasse 196 via a stem or rod 200.

Both of the input and output chasses 186 and 196 include at least one and preferably multiple flipper members 202. Flipper members 202 are secured to a center channel 204 longitudinally aligned and equally separated from two outer channels 206 that form the input chasse 186. Flipper members 202 are secured to mid-portions 208 of transverse structural channels 210 perpendicular to and integrally joined to two parallel outer channels 212 that form the output chasse 196. The two outer channels 206 of the input chasse 186 are horizontally and slidably disposed upon the input base structure 184 of the input conveyor 180. The two outer channels 212 of the output chasse 196 are horizontally and slidably disposed upon the output base structure 194 of the output conveyor 182. The flipper members 202 ultimately engage a center portion 79 of either bottom portion 76 and 78 of a portable toilet 8 vertically disposed upon the input base structure 184 of the input conveyor 180, such that the flipper member 202 horizontally moves the portable toilet 8 when the hydraulic cylinder 188 horizontally moves the input chasse 186. The flipper members 202 ultimately engage a center portion 79 of either bottom portion 76 and 78 of a portable toilet 8 vertically disposed upon the output base structure 194 of the output conveyor 182, such that the flipper member 202 horizontally moves the portable toilet 8 when the hydraulic cylinder 198 horizontally moves the output chasse 196. Although the flipper members 202 are depicted and described as being secured to a center channel 204, the location of the flipper members 202 can vary so long as the flipper members 202 engage and grasp the portable toilets 8 and 9 upon the input and output chasses 186 and 196, such that portable toilets 8 and 9 can be horizontally moved in a vertical position upon the input and output conveyors 180 and 182.

The flipper members 202 secured to the input and output chasses 186 and 196 include a baseplate 214 having a planar top surface 216 with a cylindrical retaining pipe 218 integrally joined to a longitudinal mid-portion of the top surface 216. The baseplate 214 includes two mounting plates 220 perpendicularly and laterally joined to a longitudinal mid-portion of a planar bottom surface 222 of the baseplate 214. The mounting plates 220 include bolt apertures 224 for receiving mounting bolts to secure the baseplate 214 to cooperating flipper brackets 228 integrally joined to a center channel 204 of the input chasse 186 and a transverse channel 210 of the output chasse 196. The baseplate 214 is secured to the flipper bracket 228 such that a central axis of the retaining pipe 218 is perpendicular to a central axis of the center channel 204 of the input chasse 186 and parallel to a central axis of the transverse channel 210 of the output chasse 196.

The flipper members 202 further include a pivot member 230 having a planar top surface 232 and a planar bottom surface 234 with two axially separated and axially aligned cylindrical pivot retaining pipes 236 integrally joined to a longitudinal mid-portion of the planar bottom surface 234. The two pivot retaining pipes 236 are axially separated a distance sufficient to snugly receive the retaining pipe 218 of the baseplate 214 between the two pivot retaining pipes 236 such that the two pivot retaining pipes 236 and the retaining pipe 218 are all axially aligned and rotationally secured together, thereby allowing the pivot member 230 to ultimately pivot relative to the baseplate 214 and engage a center portion 79 of a bottom portion 76 and 78 of the portable toilet 8, thereby enabling the flipper member 202 to horizontally move the portable toilet 8 when the corresponding hydraulic cylinder 188 horizontally moves the input chasse 186, and when the corresponding hydraulic cylinder 198 horizontally moves the output chasse 196 of the conveyor apparatus 24.

The flipper members 202 further include a biasing spring 238 for maintaining the position of the pivot member 230 when the pivot member 230 is positioned by a portable toilet 8 engaging the pivot member 230, thereby promoting horizontal movement of the portable toilet 8 upon the input base structure 184 and the output base structure 194. The biasing spring 238 is disposed between one of the pivot retaining pipes 236 of the pivot member 230 and the retaining pipe 218 of the baseplate 214, such that a central axis of a biasing spring aperture 240 is axially aligned with the pivot retaining pipes 236 of the pivot member 230 and the retaining pipe 218 of the baseplate, thereby promoting the insertion of a securing pipe 242 having threaded aperture end portions 244. The securing pipe 242 is dimensioned such that the securing pipe 242 snugly inserts through the pivot retaining pipes 236 and the retaining pipe 218 of the baseplate 214, and such that securing pipe end walls 246 are coplanar with respective end walls 248 of the pivot retaining pipes 236, thereby promoting the retention of the securing pipe 242 relative to the two pivot retaining pipes 236 when retaining washers 250, having diameters substantially the same as the pivot retaining pipes 236, are secured to aperture end portions 244 of the securing pipe 242 when retaining bolts 252 are inserted through the retaining washers 250 and rotationally inserted into the threaded aperture end portions 244 of the securing pipe 242.

Figure 1:
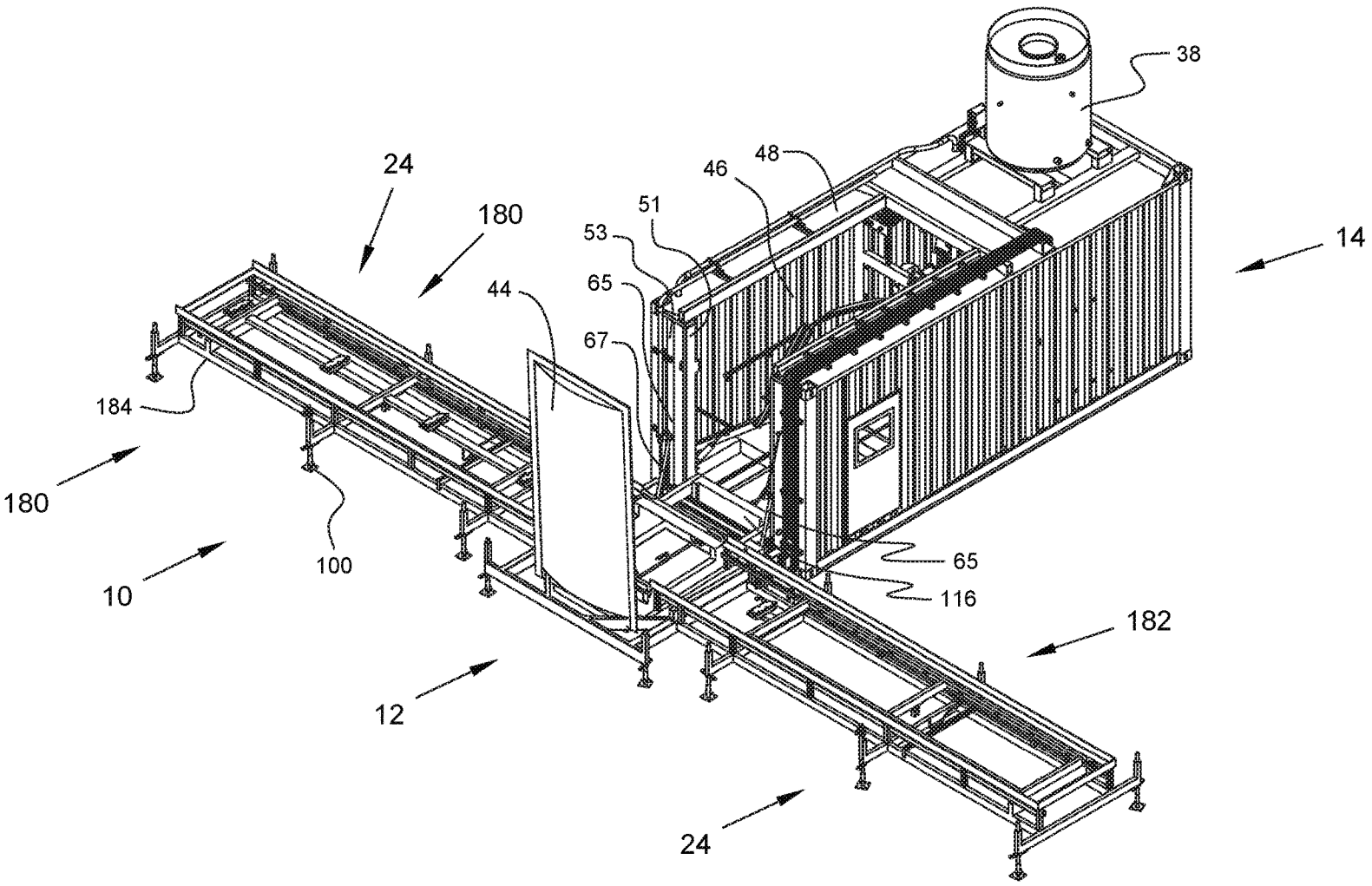
FIG. 1 is a perspective view of a washing device for a portable toilet in accordance with the present invention.
Figure 2:
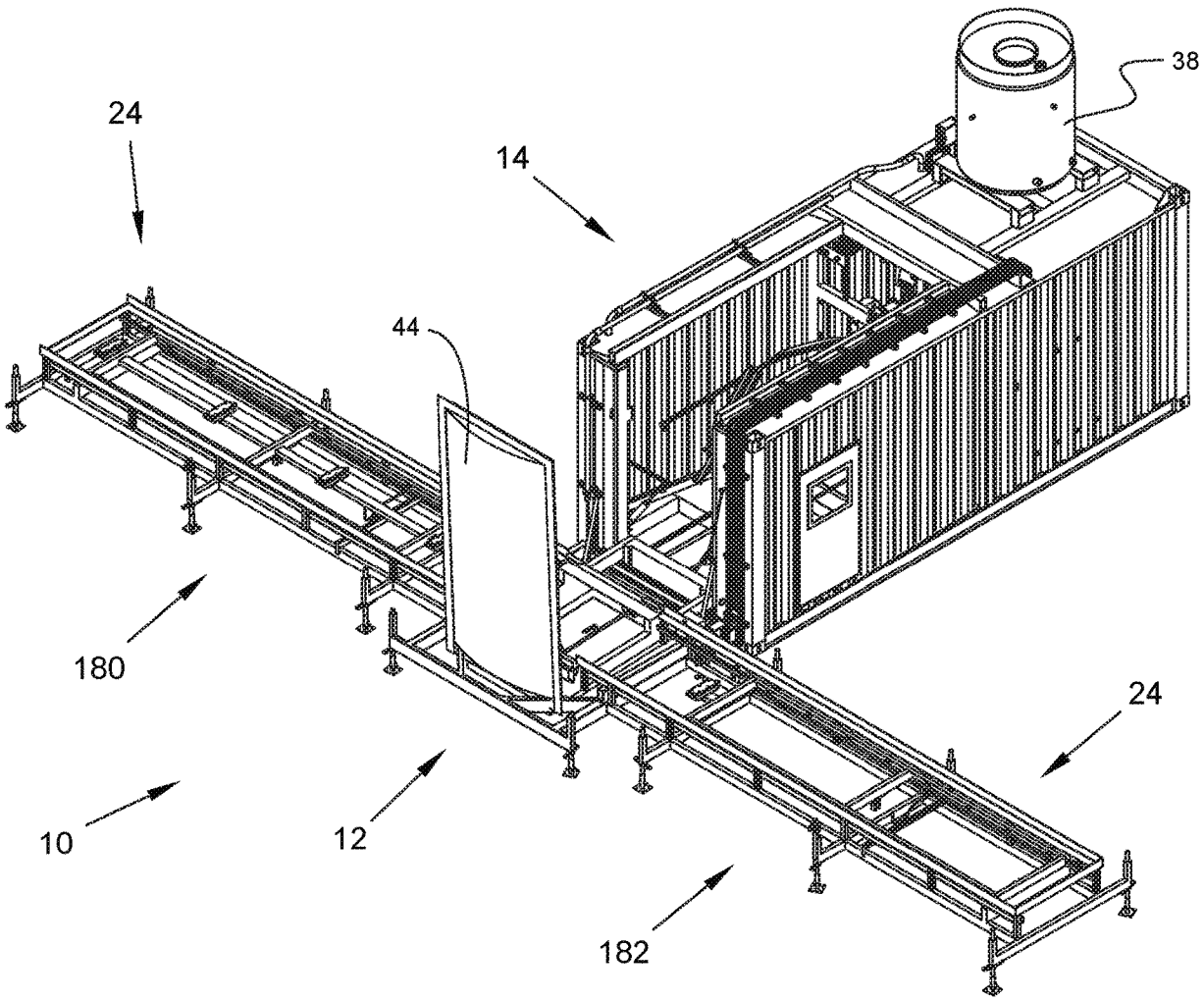
FIG. 2 is a phantom perspective view of the washing device of FIG. 1.
Figure 3:
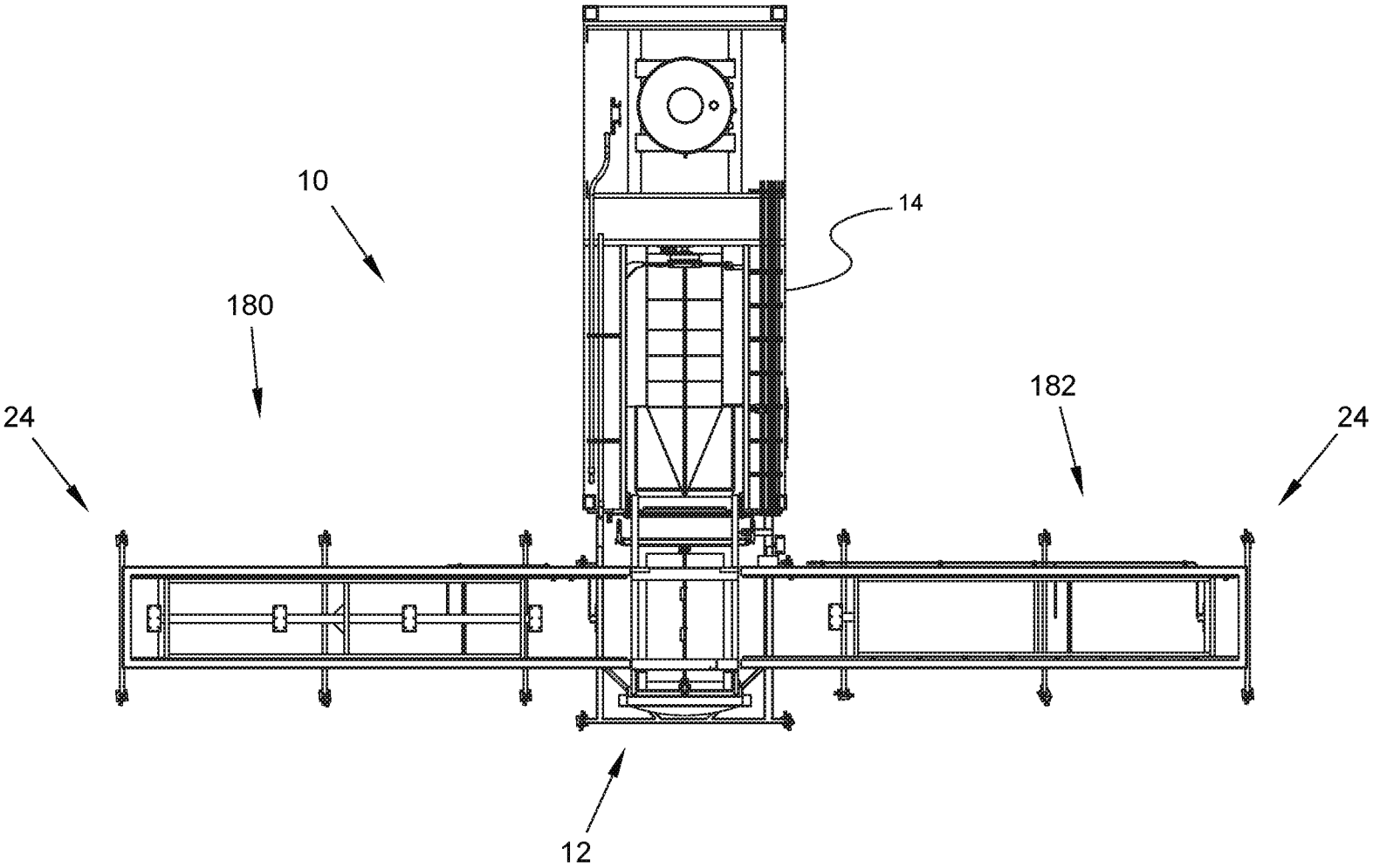
FIG. 3 is top view of the phantom view of FIG. 2.
Figure 4:
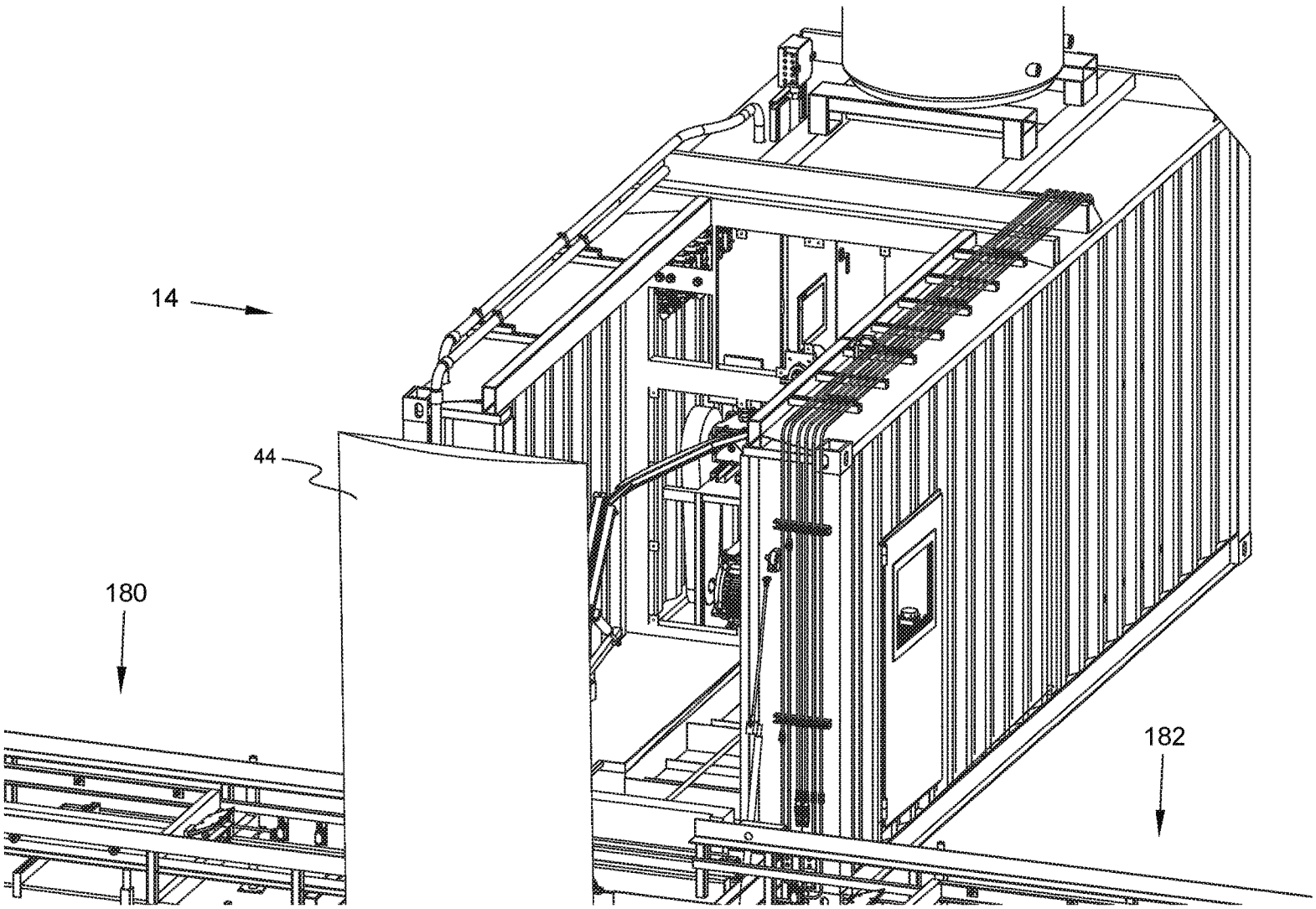
FIG. 4 is front perspective view of the washing enclosure of the device of FIG. 1.
Figure 5:
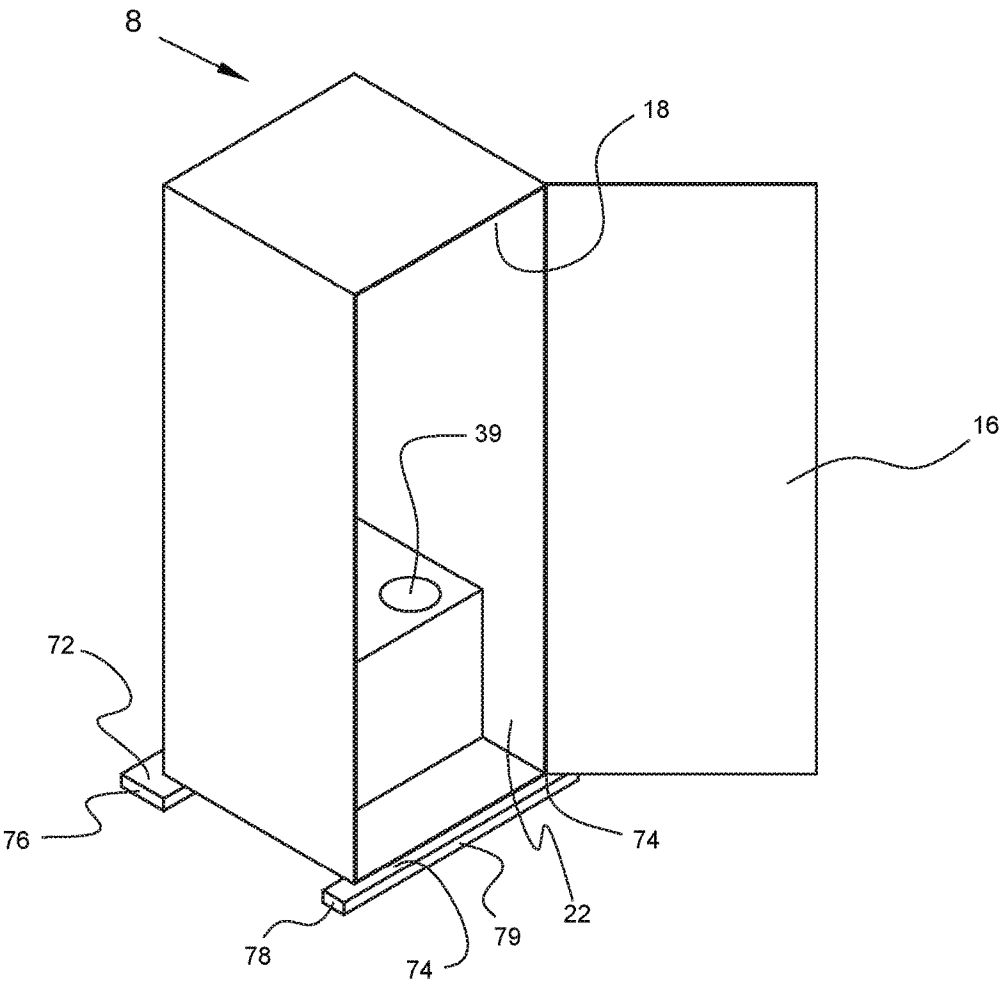
FIG. 5 is a perspective view of a typical portable toilet.
Figure 6:
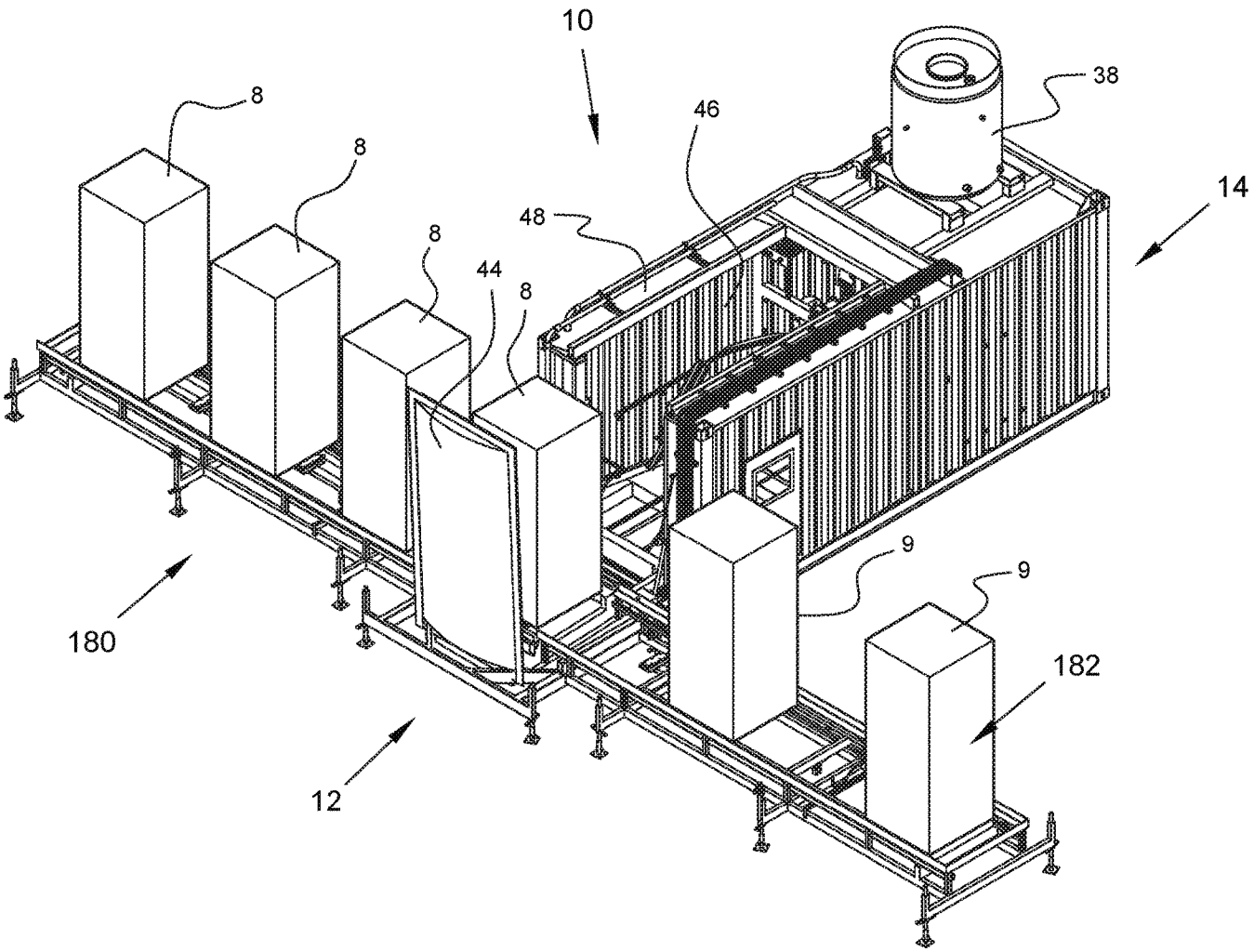
FIG. 6 is the perspective view of the device of FIG. 1, but with multiple portable toilets disposed on the conveyor portion of the device.
Figure 6A:
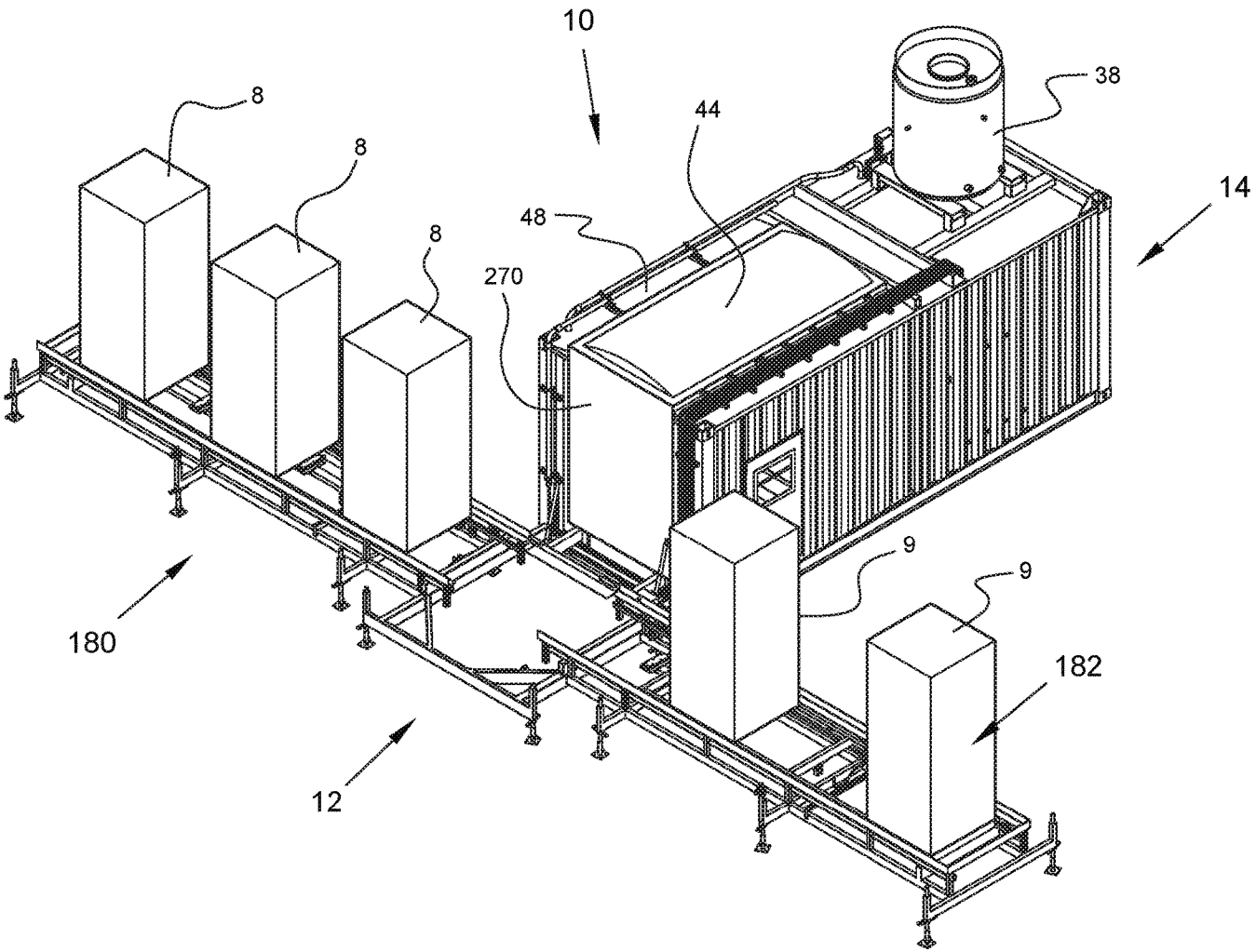
FIG. 6A is the perspective view of FIG. 6, but with the portable toilet lifting member elevated such that a portable toilet is positioned inside the portable toilet washing enclosure.
Figure 7:
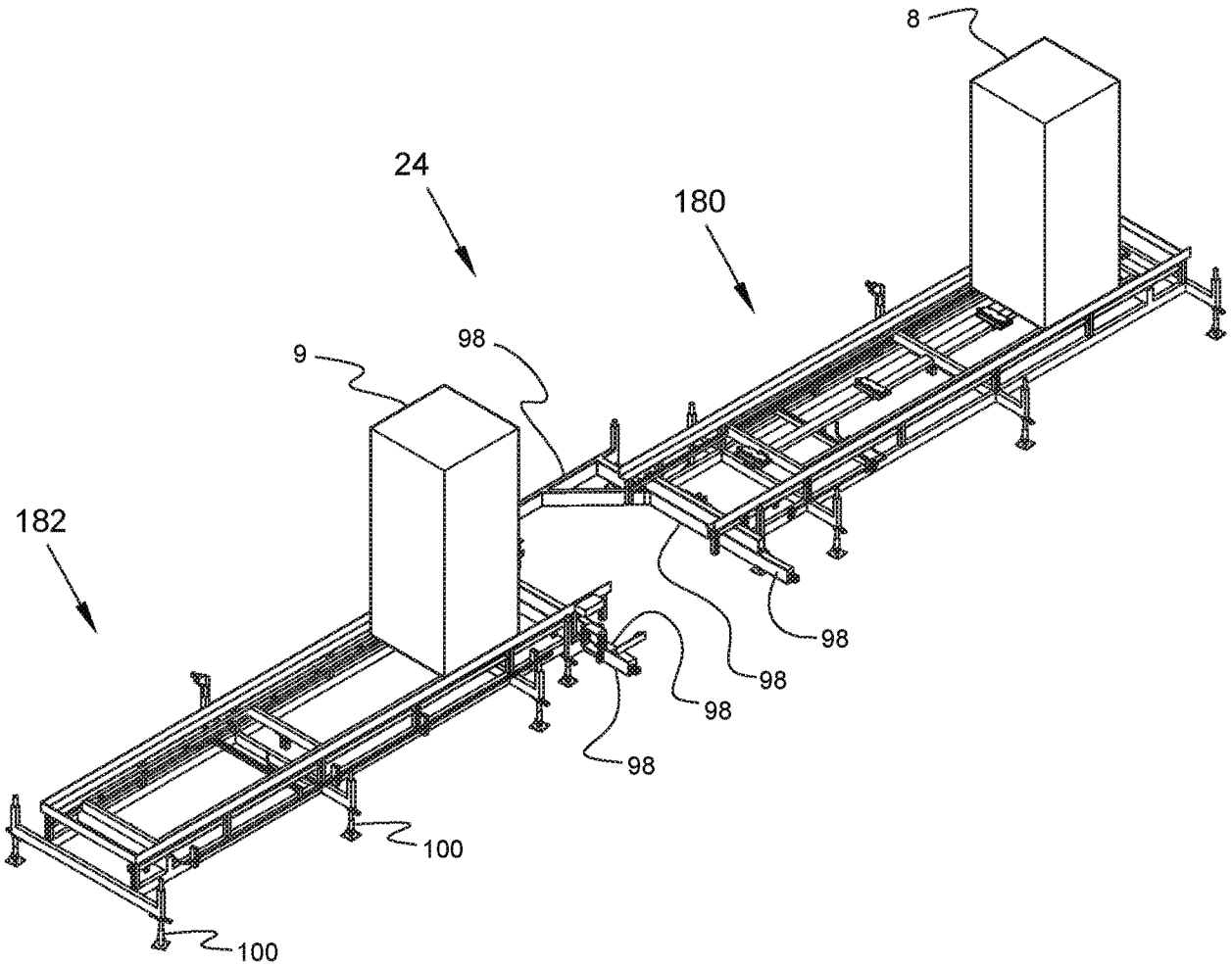
FIG. 7 is a perspective view of only a conveyor portion of the device of FIG. 1, but with two portable toilets disposed upon the conveyor portion.
Figure 8:
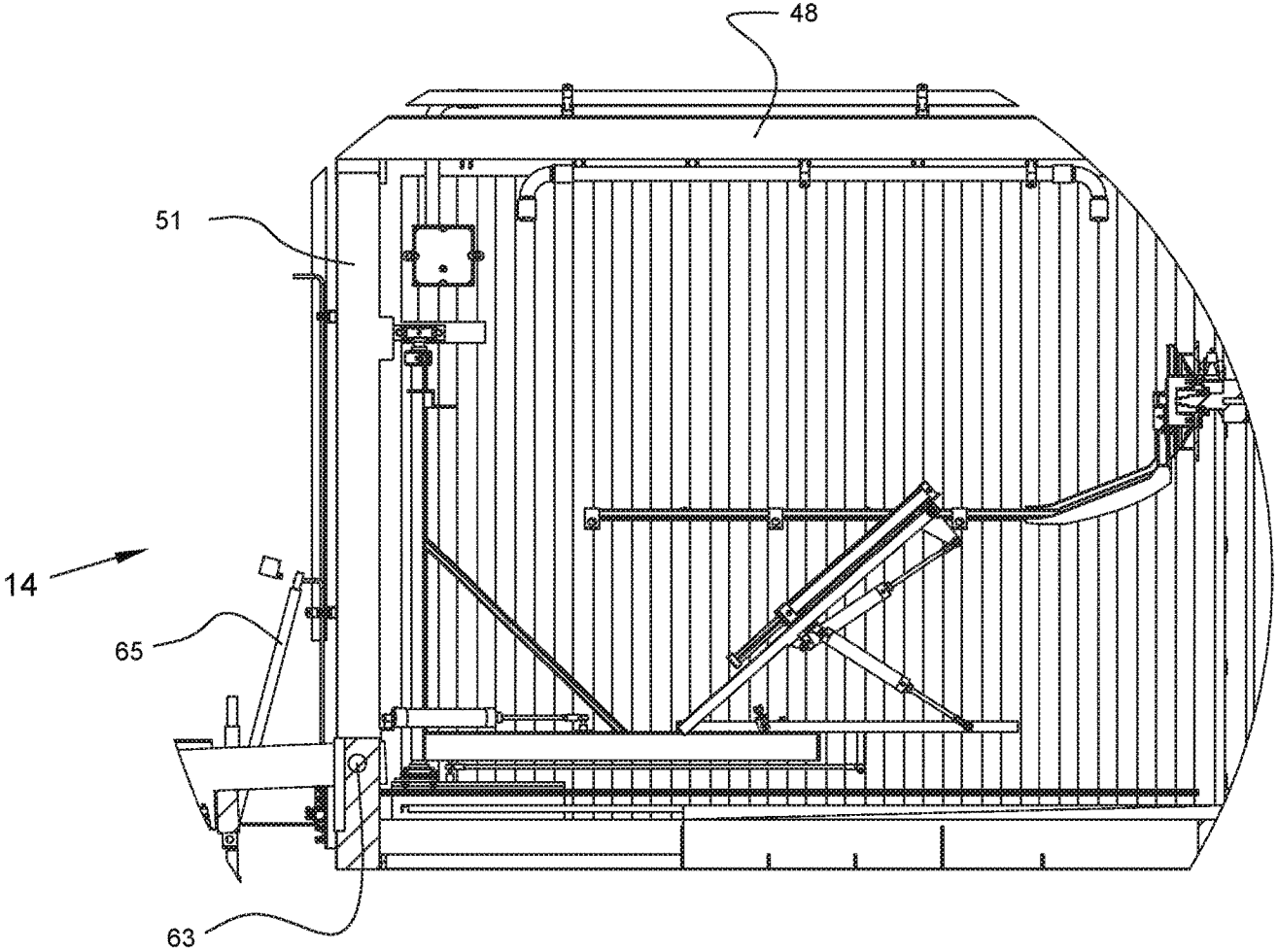
FIG. 8 is a cut-away view of the left side of a wet portion of the washing enclosure of the device of FIG. 1.
Figure 8A:
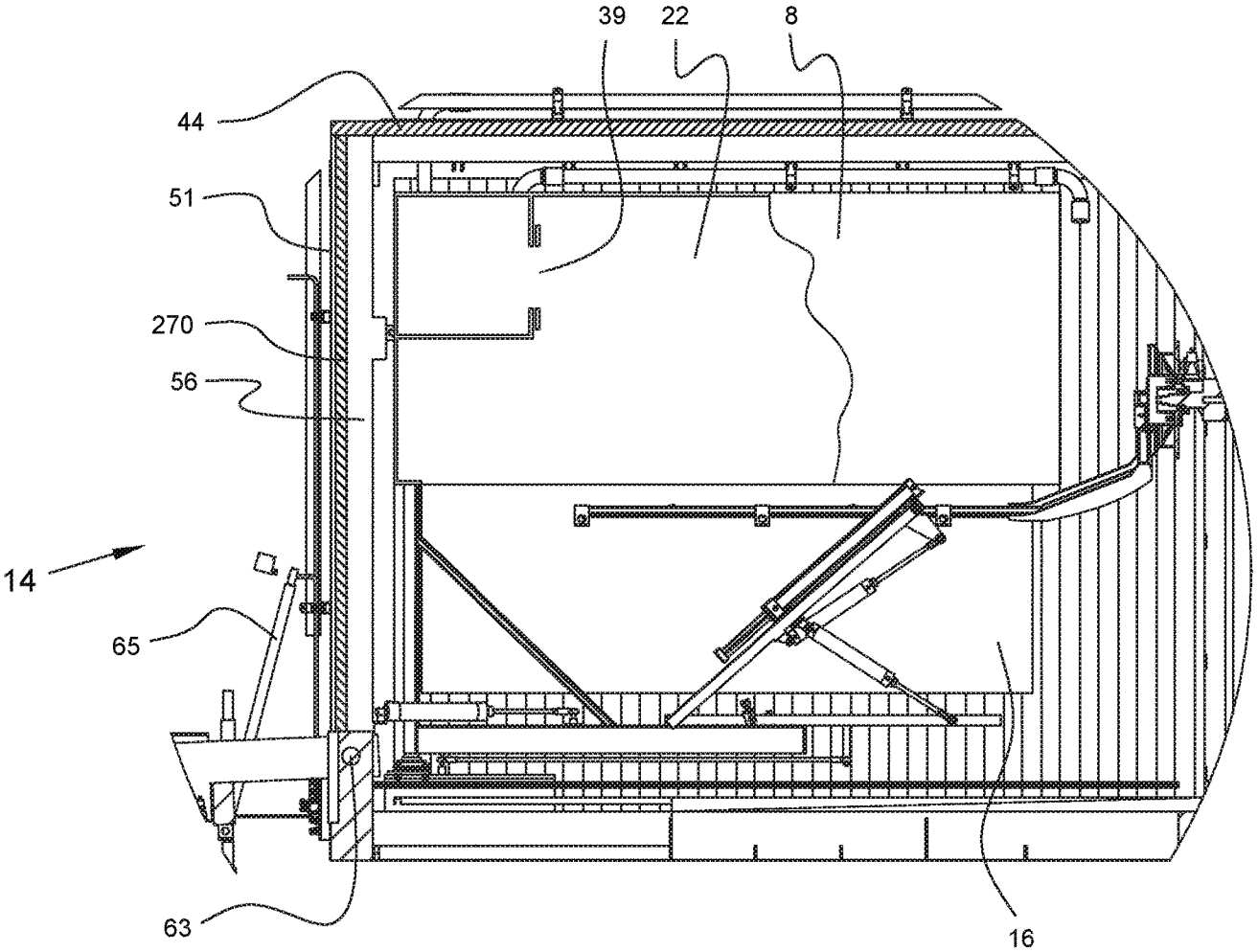
FIG. 8A is the cut-away view of FIG. 8, but with a portable toilet horizontally disposed inside a wet portion of the washing enclosure.

Referring to FIGS. 1-3, in operation a series of portable toilets 8 with five feet of separation between adjacent toilets 8 are disposed upon the input conveyor 180 then lineally moved upon the input conveyor 180 via a series of flipper members 202 secured to a rod or stem portion 190 of a hydraulic cylinder 188, such that the flipper members 202 are lineally urged by the hydraulic cylinder 188 to correspondingly move the portable toilets 8 upon the input conveyor 180 in five feet increments, whereupon, the flipper members 202 pivot to release a corresponding toilet 8 as the flipper members 202 are returned to their original positions relative to the input conveyor 180 by the hydraulic cylinder 188 retracting five feet to its initial position relative to the input conveyor 180. The flipper members 202 then repeat their five feet movement increments toward the portable toilet lifting member 12 to move each of the toilets on the input conveyor 180 five feet closer to the lifting member. The positioning of the toilets 8 upon the input conveyor 180 continues until a toilet 8 is disposed upon the portable toilet lifting member 12.

Within thirty second of a portable toilet 8 being disposed upon the lifting member 12, the toilet 8 is elevated from a vertical position and rotated until the toilet 8 is horizontally disposed in an aperture 46 in the ceiling portion 48 of the enclosure 14, such that the ceiling member 44 of the lifting frame 40 of the lifting member 12 is horizontally disposed and a translucent floor portion 270 of the lifting frame 40 is vertically disposed. Upon completing the washing cycle (about five minutes and described above) for the portable toilet 9 in the enclosure 14, the portable toilet 9 is pivotally removed from the enclosure 14 and the lifting frame 40 is disposed upon the base frame 98 of the lifting member 12, thereby disposing the washed toilet 9 in a vertical position upon the lifting member 12. The total water used to wash the toilet 9 is substantially about 6 gallons of which about one percent or 0.06 gallons of water is lost via leakage from the enclosure 14. The washed portable toilet 9 is urged upon the output conveyor 182 via a series of flipper members 202 secured to a rod or stem portion 200 of a hydraulic cylinder 198, such that the flipper members 202 are lineally urged by the hydraulic cylinder 198 to correspondingly move the washed portable toilets 9 upon the output conveyor 182 in five feet increments, whereupon, the flipper members 202 pivot to release a corresponding toilet as the flipper members 202 are returned to their original positions relative to the output conveyor 182 by the hydraulic cylinder 198 retracting five feet to its initial position relative to the output conveyor. The flipper members 202 then repeat their five feet movement increments toward the end portion 183 of the output conveyor 182 to move each of the toilets 9 on the output conveyor 182 five feet closer to the end portion 183. The positioning of the washed toilets 9 upon the output conveyor 182 continues until a washed toilet 9 is disposed at the end portion 183, whereupon the washed toilet 9 is removed from the output conveyor 182 and placed in storage.

The invention claimed is:

1. A washing device for a portable toilet comprising:

a portable toilet lifting member that elevates a portable toilet from a substantially vertical position and rotates the portable toilet until disposed in a substantially horizontal position in a portable toilet washing enclosure, such that an access door of the portable toilet is open and a portable toilet access aperture of the portable toilet is orientated to enable internal washing members in said portable toilet washing enclosure to discharge a liquid within an internal chamber of the portable toilet to ultimately clean the internal chamber and a toilet tank disposed inside said internal chamber;

an external washing member in said portable toilet washing enclosure for discharging said liquid upon predetermined external wall portions of the portable toilet when the portable toilet is disposed in said substantially horizontal position inside said portable toilet washing enclosure;

a first apparatus for supplying said liquid to said internal washing members in said portable toilet washing enclosure when the portable toilet is disposed in said substantially horizontal position inside said portable toilet washing enclosure;

a second apparatus for supplying said liquid to said external washing member in said portable toilet washing enclosure when the portable toilet is disposed in said substantially horizontal position inside said portable toilet washing enclosure;

a third apparatus for controlling predetermined parameters of said liquid supplied to said internal washing members in said portable toilet washing enclosure via said first apparatus;

a fourth apparatus for controlling predetermined parameters of said liquid supplied to said external washing member in said portable toilet washing enclosure via said second apparatus; and a liquid collection and liquid purifying apparatus for recycling liquid from the washed portable toilet to a liquid storage member, whereby, liquid used to wash a portable toilet horizontally disposed in said portable toilet washing enclosure is gravity urged upon a floor portion of said liquid collection and liquid purifying apparatus, said liquid ultimately being returned to said liquid storage member, the portable toilet ultimately being washed and removed from said portable toilet washing enclosure; whereupon, said portable toilet lifting member returns the cleaned portable toilet to a substantially vertical position, the cleaned portable toilet being transported to storage via manually operated equipment.

2. The device of claim 1 wherein said portable toilet lifting member includes a lifting frame pivotally connected to a cooperating frame portion of said portable toilet washing enclosure, said lifting frame including skid nozzles secured to angle irons integrally joined to a bar secured to a lifting frame of said portable toilet lifting member, said skid nozzles ultimately discharging said liquid upon a skid portion of the portable toilet.

3. The device of claim 2 wherein said portable toilet lifting member includes a ceiling member configured and dimensioned to snugly insert into a cooperating aperture in a ceiling portion of said portable toilet washing enclosure, said ceiling member being pivotally inserted into said cooperating aperture as the portable toilet is pivoted and horizontally disposed into said portable toilet washing enclosure, thereby preventing said liquid from escaping said enclosure via said aperture in said ceiling portion as the horizontally disposed portable toilet is washed with said liquid, resulting in the area outside said enclosure remaining substantially dry as the portable toilet is being washed.

4. The device of claim 2 wherein said lifting frame includes parallel first and second portable toilet support members integrally and transversely joined to top portions of parallel first and second lifting members, said first and second toilet support members having portable toilet first and second retaining walls vertically joined to respective outer longitudinal edge portions of corresponding horizontally disposed first and second plate portions that ultimately engage cooperating top walls of bottom portions of the portable toilet, said first and second retaining walls being separated a distance sufficient to allow a portable toilet to be disposed between said first and second retaining walls when the portable toilet is disposed upon said first and second plate portions.

5. The device of claim 4 wherein said lifting frame includes at least one locking plate integrally and substantially horizontally joined to said second retaining wall such that said at least one locking plate retains a corresponding base portion of a portable toilet disposed upon said second support member irrespective of the orientation of the portable toilet.

6. The device of claim 5 wherein said lifting member includes a portable toilet retaining portion pivotally secured to a first end of said pivoting lifting frame, said portable toilet retaining portion disposed in a first position that allows a portable toilet to be slid upon said first and second support members, said portable toilet retaining portion ultimately being pivoted to a second position that locks a corresponding bottom portion of the portable toilet upon said first support member, thereby maintaining the position of the portable toilet upon the first and second support members of the lifting frame irrespective of the portable toilet being pivoted from a substantially vertical position to a substantially horizontal position inside said portable toilet washing enclosure.

7. The device of claim 6 wherein said portable toilet retaining portion is pivotally urged from a non-retaining position to a retaining position via a stem portion of a drive cylinder that ultimately returns to a non-retaining position after the portable toilet has been cleaned and returned to a vertical position outside said portable toilet washing enclosure.

8. The device of claim 7 wherein said drive cylinder is controlled by a preprogrammed computer system.

9. The device of claim 6 wherein said first and second lifting members are supported via a base frame configured and dimensioned to support said first and second lifting members, said base frame configuration and dimensions allowing said base frame to be disposed between predetermined portions of a portable toilet conveyor structure.

10. The device of claim 9 wherein said portable toilet lifting member includes elevation members for vertically positioning said base frame at a predetermined elevation that cooperates with said portable toilet washing enclosure and said predetermined portions of said portable toilet conveyor structure.

11. The device of claim 10 wherein said elevation members are manually positioned to a predetermined elevation.

12. The device of claim 10 wherein said elevation members are positioned to a predetermined elevation by a programmable control system.

13. The device of claim 10 wherein said elevation members are detachably connected to said base frame via elevation connectors.

14. The device of claim 9 wherein said base frame includes a securing rod rotationally secured to said base frame such that at least one angle iron integrally joined to said securing rod is ultimately rotated to a position that positions a skid nozzle adjacent to a bottom portion of the portable toilet to wash the bottom portion of the portable toilet after the portable toilet has been pivoted to a horizontal position inside said portable toilet washing enclosure.

15. The device of claim 14 wherein said portable toilet lifting member that elevates a portable toilet from a substantially vertical position and rotates the portable toilet until disposed in a substantially horizontal position in a portable toilet washing enclosure, includes a hydraulic cylinder having base end secured to a back portion of said lifting frame, said hydraulic cylinder having a rod end secured to a cooperating back portion of a portable toilet retaining portion such that after said rod end of said hydraulic cylinder urges said portable toilet retaining portion toward a bottom portion of the portable toilet to ultimately secure the portable toilet to said lifting frame, said lifting frame is pivoted relative to said portable toilet washing enclosure until the portable toilet is pivotally rotated to a substantially horizontal position inside said portable toilet washing enclosure.

16. The device of claim 1 wherein said internal washing members in said portable toilet washing enclosure include a toilet seat spray member secured to a computer controlled toilet seat spray cylinder assembly that ultimately positions said toilet seat spray member inside the internal chamber of the portable toilet when the portable toilet is disposed in a substantially horizontal position inside said portable toilet washing enclosure, said toilet seat spray member ultimately directing said liquid upon a toilet seat engaging a top surface portion of a toilet tank inside the internal chamber of the portable toilet, said liquid having sufficient pressure such that when said liquid is directed upon the toilet seat, said liquid urges said toilet seat to pivot into a substantially horizontal position, thereby enabling said liquid discharged from a toilet tank spray nozzle to wash the toilet tank, whereupon, said liquid is gravity urged from the toilet tank into a receiving recess disposed in a front portion of a floor portion of said portable toilet washing enclosure.

17. The device of claim 16 wherein said toilet seat spray member includes at least one nozzle that directs said liquid to pivotally displace the toilet seat from the toilet tank inside the portable toilet, said at least one nozzle ultimately directing said liquid to engage portions of the internal chamber of the portable toilet.

18. The device of claim 16 wherein said toilet seat spray member includes four rotating nozzles that direct said liquid to pivotally displace the toilet seat from the toilet tank inside the portable toilet, said four rotating nozzles ultimately directing said liquid to engage portions of the internal chamber of the portable toilet.

19. The device of claim 17 wherein said at least one nozzle of said toilet seat spray member is manually adjustable.

20. The device of claim 18 wherein said four nozzles of said toilet seat spray member are manually and independently adjustable.

21. The device of claim 1 wherein said internal washing members in said portable toilet washing enclosure include a toilet tank cleaning spray member secured to a computer controlled toilet tank cleaning cylinder assembly that ultimately positions a tank cleaning spray nozzle inside a toilet tank that is inside a bottom portion of the internal chamber of the portable toilet, said tank cleaning spray nozzle being disposed in the toilet tank when the portable toilet is disposed in a substantially horizontal position inside said portable toilet washing enclosure.

22. The device of claim 1 wherein said external washing member for discharging said liquid upon predetermined external wall portions of the portable toilet when the portable toilet is disposed in said substantially horizontal position inside said portable toilet washing enclosure, includes a rotary drive member connected to at least one boom having at least one rotating spinner member having at least one nozzle secured to said spinner member, said rotating spinner member directing said liquid from said nozzle upon external wall portions of a portable toilet, said rotary drive member positioning said at least one boom adjacent to predetermined exterior wall portions of the portable toilet.

23. The device of claim 1 wherein said external washing member for discharging said liquid upon predetermined external portions of the portable toilet when the portable toilet is disposed in said substantially horizontal position inside said portable toilet washing enclosure, includes a rotary drive member connected to multiple booms having multiple rotating spinner members having multiple nozzles secured to said spinner member, said rotating spinner members directing said liquid from said multiple nozzles upon external portions of a portable toilet, said rotary drive member positioning said multiple booms adjacent to predetermined exterior surface portions of the portable toilet.

24. The device of claim 1 wherein said first apparatus for supplying said liquid to said internal washing members in said portable toilet washing enclosure when the portable toilet is disposed in said substantially horizontal position inside said portable toilet washing enclosure, includes a water storage tank containing water with a cleaning agent for supplying said liquid to a relative high pressure water pump driven by an electric motor, said high pressure water pump urging water through a first control valve that directs water to said toilet seat spray member that pivots the toilet seat to a horizontal position when the portable toilet is disposed in a substantially horizontal position inside said portable toilet washing enclosure, said high pressure water pump urging water through a third control valve that directs water to a power washer member that washes the internal chamber of the portable toilet, said third control valve directing water to spinner nozzles secured to said external washer member for washing outer walls of the portable toilet.

25. The device of claim 11 wherein said water storage tank is elevated upon and secured to a top portion of said portable toilet washing enclosure.

26. The device of claim 24 wherein said second apparatus for supplying said liquid to said washing members in said portable toilet washing enclosure when the portable toilet is disposed in said substantially horizontal position inside said portable toilet washing enclosure, includes a second water control valve that directs 1200 psi water to said toilet tank wash spray member when said spray member is inside said toilet tank, said second water control valve also directing 1200 psi water to said skid nozzles adjacent to the bottom portion of the portable toilet when the toilet 8 is horizontally disposed inside said toilet washing enclosure 14, said second water control valve being open and closed by an electronic signal from said computer control system in said enclosure, said computer control system together with said second water control valve controlling the positioning and water discharge time for both said toilet tank wash spray member and said skid nozzles.

27. The device of claim 1 wherein said third apparatus for controlling predetermined parameters of said liquid supplied to said internal washing members in said portable toilet washing enclosure via said first apparatus, includes a computer having first inputs and first outputs for controlling liquid parameters for washing the internal chamber of the portable toilet.

28. The device of claim 1 wherein said fourth apparatus for controlling predetermined parameters of said liquid supplied to said external washing members in said portable toilet washing enclosure via said second apparatus, includes a computer having second inputs and second outputs for controlling liquid parameters for washing external portions of the portable toilet.

29. The device of claim 1 wherein said liquid collection and liquid purifying apparatus for recycling liquid from the washed portable toilet to said liquid storage tank includes a recycle pump driven by an electric motor controlled by a level switch in a floor portion of said portable toilet washing enclosure, said recycle pump ultimately removing liquid from said floor portion and urging said liquid to said elevated liquid storage tank, whereupon said liquid is ultimately used to clean a portable toilet.

30. The device of claim 1 wherein said liquid collection and liquid purifying apparatus for recycling liquid from the washed portable toilet to said liquid storage tank includes a floor portion comprising:

a solid and liquid material receiving recess disposed adjacent to a front portions of said portable toilet washing enclosure such that longitudinal walls of said waste receiving recess extend substantially perpendicular and adjacent to longitudinal walls of said portable toilet washing enclosure, said recess having a front wall adjacent to a front wall of said enclosure, said recess having longitudinal and lateral dimensions that enable said solid and liquid material receiving recess to capture substantially all of the solid material from a cooperatively disposed toilet tank in a portable toilet horizontally disposed inside said portable toilet washing enclosure;

a central recess disposed such that sloped floor surfaces are disposed on opposite longitudinal sides of said central recess, whereby, said liquid from the horizontally disposed portable toilet flow into said waste receiving recess or said central recess;

a plurality of vertically disposed first plates having relatively small vertical dimensions disposed in said waste receiving and said central recesses, said first plates promoting the separation of solid materials from said liquid in said waste receiving recess when liquid elevation in said waste receiving recess rises, said rising liquid elevation ultimately flowing over a second plate vertically disposed and having a relatively greater vertical dimension than said first plates, said second plate separating said solid and liquid material receiving recess from said central recess, said second plate promoting the retention of the solid material in said solid and liquid material receiving recess and promoting the flow of said liquid into said central recess, whereupon, said liquid flows over a plurality of first plates in said central recess until engaging a third vertically disposed plate having substantially the same vertical dimension as said second plate, said third plate further promoting the separation of the solid material from said liquid as the liquid elevation rises and flows over said third plate, said rising liquid elevation continuing to fill said central recess until said liquid flows over a last first plate to separate said liquid from remaining solid material, thereby purifying said liquid sufficiently to allow said liquid to be pumped from a removal section of said central recess via a suction line inserted into said removal section, said suction line being connected to a liquid discharge pump that ultimately urges said liquid into said liquid storage tank, whereupon, said liquid is ultimately used to wash internal and external portions of the portable toilet.

31. The device of claim 30 wherein solid material disposed in said floor portion is ultimately removed.

32. The device of claim 31 wherein the portable toilet is vertically disposed upon a portable toilet conveyor apparatus.

33. The device of claim 32 wherein said conveyor apparatus includes elements for serially moving a plurality of portable toilets to said portable toilet lifting member, said conveyor apparatus comprising:

a portable toilet input conveyor for horizontally moving at least one vertically disposed portable toilet from a first position on said conveyor apparatus to a vertical position on said portable toilet lifting member, thereby positioning the vertically disposed portable toilet for pivotal movement to a horizontal position inside said portable toilet washing enclosure; and a portable toilet output conveyor for horizontally moving a washed vertically disposed portable toilet from said portable toilet lifting member to a second vertical position on said conveyor apparatus, whereupon, the washed vertically disposed portable toilet is removed from said portable toilet output conveyor to a place of storage.

34. The conveyor apparatus of claim 33 wherein said input conveyor includes an input base structure having a plurality of vertically adjustable base stands positioning said input base structure in a substantially horizontal position to promote horizontal movement of the portable toilet disposed upon said input base structure of said input conveyor.

35. The conveyor apparatus of claim 34 wherein said input conveyor includes an input chasse supported by said input base structure such that said input chasse horizontally moves upon said input base structure when said input chasse is horizontally urged to move by a hydraulic cylinder.

36. The conveyor apparatus of claim 35 wherein said input chasse includes at least one flipper member secured to a center channel longitudinally aligned and equally separated from two outer channels that form said input chasse, said two outer channels being horizontally and slidably disposed upon said input base structure, said at least one flipper member ultimately engaging a center portion of a base portion of a portable toilet vertically disposed upon said input base structure of said input conveyor, such that said at least one flipper member horizontally moves the portable toilet when said hydraulic cylinder horizontally moves said input chasse.

37. The conveyor apparatus of claim 33 wherein said output conveyor includes an output base structure having a plurality of vertically adjustable base stands positioning said output base structure in a substantially horizontal position to promote horizontal movement of the portable toilet disposed upon said output base structure of said output conveyor.

38. The conveyor apparatus of claim 37 wherein said output conveyor includes an output chasse supported by said output base structure such that said output chasse horizontally moves upon said output base structure when said output chasse is horizontally urged to move by a hydraulic cylinder.

39. The conveyor apparatus of claim 38 wherein said output chasse includes at least one flipper member secured to a center channel longitudinally aligned and equally separated from two outer channels that form said output chasse, said two outer channels being horizontally and slidably disposed upon said output base structure, said at least one flipper member ultimately engaging a center portion of a base portion of a portable toilet vertically disposed upon said output base structure of said output conveyor, such that said at least one flipper member horizontally moves the portable toilet when said hydraulic cylinder horizontally moves said output chasse.

40. The conveyor apparatus of claim 36 wherein said at least one flipper member comprises:

a baseplate having a planar top surface with a cylindrical retaining pipe integrally joined to a longitudinal mid-portion of the top surface, said baseplate having two mounting plates perpendicularly and laterally joined to a longitudinal mid-portion of a planar bottom surface of said baseplate, said mounting plates having bolt apertures for receiving mounting bolts to secure said baseplate to a cooperating flipper bracket integrally joined to said center channel of said input chasse, said baseplate being secured to said flipper bracket such that a central axis of said retaining pipe is perpendicular to a central axis of said center channel of said input chasse;

a pivot member having a planar top surface and a planar bottom surface with two axially separated and axially aligned cylindrical pivot retaining pipes integrally joined to a longitudinal mid-portion of said planar bottom surface, said two pivot retaining pipes being axially separated a distance sufficient to snugly receive said retaining pipe of said baseplate between said two pivot retaining pipes such that said two pivot retaining pipes and said retaining pipe are all axially aligned and rotationally secured together, thereby allowing said pivot member to ultimately pivot relative to said baseplate and engage a center portion of a bottom portion of the portable toilet, thereby enabling said flipper member to horizontally move the portable toilet when the corresponding hydraulic cylinder horizontally moves said input chasse of said conveyor apparatus; and a biasing spring for maintaining the position of said pivot member when said pivot member is positioned by a portable toilet engaging said pivot member, thereby promoting horizontal movement of the portable toilet upon said input base structure, said biasing spring being disposed between one of said pivot retaining pipes of said pivot member and said retaining pipe of said baseplate such that a central axis of a biasing spring aperture is axially aligned with said pivot retaining pipes of said pivot member and said retaining pipe of said baseplate, thereby promoting the insertion of a securing pipe having threaded inner end portions, said securing pipe being dimensioned such that said securing pipe snugly inserts through the pivot retaining pipes and the retaining pipe of said baseplate, and said securing pipe end walls are coplanar with respective end walls of said pivot retaining pipes, thereby promoting the retention of said securing pipe relative to said two pivot retaining pipes when retaining washers having diameters substantially the same as the pivot retaining pipes are secured to end portions of the securing pipe when retaining bolts are inserted through said retaining washers and rotationally inserted into said end portions of said securing pipe.

41. The conveyor apparatus of claim 39 wherein said at least one flipper member comprises:

a baseplate having a planar top surface with a cylindrical retaining pipe integrally joined to a longitudinal mid-portion of the top surface, said baseplate having two mounting plates perpendicularly and laterally joined to a longitudinal mid-portion of a planar bottom surface of said baseplate, said mounting plates having bolt apertures for receiving mounting bolts to secure said baseplate to a cooperating flipper bracket integrally joined to said center channel of said output chasse, said baseplate being secured to said flipper bracket such that a central axis of said retaining pipe is perpendicular to a central axis of said center channel of said output chasse;

a pivot member having a planar top surface and a planar bottom surface with two axially separated and axially aligned cylindrical pivot retaining pipes integrally joined to a longitudinal mid-portion of said planar bottom surface, said two pivot retaining pipes being axially separated a distance sufficient to snugly receive said retaining pipe of said baseplate between said two pivot retaining pipes such that said two pivot retaining pipes and said retaining pipe are all axially aligned and rotationally secured together, thereby allowing said pivot member to ultimately pivot relative to said baseplate and engage a center portion of a bottom portion of the portable toilet, thereby enabling said flipper member to horizontally move the portable toilet when the corresponding hydraulic cylinder horizontally moves said output chasse of said conveyor apparatus; and a biasing spring for maintaining the position of said pivot member when said pivot member is positioned by a portable toilet engaging said pivot member, thereby promoting horizontal movement of the portable toilet upon said output base structure, said biasing spring being disposed between one of said pivot retaining pipes of said pivot member and said retaining pipe of said baseplate such that a central axis of a biasing spring aperture is axially aligned with said pivot retaining pipes of said pivot member and said retaining pipe of said baseplate, thereby promoting the insertion of a securing pipe having threaded inner end portions, said securing pipe being dimensioned such that said securing pipe snugly inserts through the pivot retaining pipes and the retaining pipe of said baseplate, and said securing pipe end walls are coplanar with respective end walls of said pivot retaining pipes, thereby promoting the retention of said securing pipe relative to said two pivot retaining pipes when retaining washers having diameters substantially the same as the pivot retaining pipes are secured to end portions of the securing pipe when retaining bolts are inserted through said retaining washers and rotationally inserted into said end portions of said securing pipe.

42. A washing device for portable toilets comprising:

a portable toilet lifting member that elevates a portable toilet from a substantially vertical position and rotates the portable toilet until disposed in a substantially horizontal position in a portable toilet washing enclosure, such that an access door of the portable toilet is open and a portable toilet access aperture of the portable toilet is orientated to enable internal washing members in said portable toilet washing enclosure to discharge a liquid within an internal chamber of the portable toilet to ultimately clean the internal chamber and a toilet tank disposed inside said internal chamber;

an external washing member in said portable toilet washing enclosure for discharging said liquid upon predetermined external wall portions of the portable toilet when the portable toilet is disposed in said substantially horizontal position inside said portable toilet washing enclosure;

a first apparatus for supplying said liquid to said internal washing members in said portable toilet washing enclosure when the portable toilet is disposed in said substantially horizontal position inside said portable toilet washing enclosure;

a second apparatus for supplying said liquid to said external washing member in said portable toilet washing enclosure when the portable toilet is disposed in said substantially horizontal position inside said portable toilet washing enclosure;

a third apparatus for controlling predetermined parameters of said liquid supplied to said internal washing members in said portable toilet washing enclosure via said first apparatus;

a fourth apparatus for controlling predetermined parameters of said liquid supplied to said external washing member in said portable toilet washing enclosure via said second apparatus;

a liquid collection and liquid purifying apparatus for recycling liquid from the washed portable toilet to a liquid storage member, whereby, liquid used to wash a portable toilet horizontally disposed in said portable toilet washing enclosure is gravity urged upon a floor portion of said liquid collection and liquid purifying apparatus, said liquid ultimately being returned to said liquid storage member, the portable toilet ultimately being washed and removed from said portable toilet washing enclosure; whereupon, said portable toilet lifting member returns the cleaned portable toilet to a substantially vertical position, the cleaned portable toilet being transported to storage via manually operated equipment;

a portable toilet input conveyor for horizontally moving at least one vertically disposed portable toilet from a first position on said conveyor apparatus to a vertical position on said portable toilet lifting member, thereby positioning the vertically disposed portable toilet for pivotal movement to a horizontal position inside said portable toilet washing enclosure; and a portable toilet output conveyor for horizontally moving a washed vertically disposed portable toilet from said portable toilet lifting member to a second vertical position on said conveyor apparatus, whereupon, the washed vertically disposed portable toilet is removed from said portable toilet output conveyor to a place of storage.

43. A portable toilet washing device comprising:

a portable toilet lifting member that elevates a portable toilet from a substantially vertical position and rotates the portable toilet until disposed in a substantially horizontal position in a portable toilet washing enclosure, such that an access door of the portable toilet is open and a portable toilet access aperture of the portable toilet is orientated to enable internal washing members in said portable toilet washing enclosure to discharge a liquid within an internal chamber of the portable toilet to ultimately clean the internal chamber and a toilet tank disposed inside said internal chamber; and a liquid collection and liquid purifying apparatus for recycling liquid from the washed portable toilet to a liquid storage member, whereby, liquid used to wash a portable toilet horizontally disposed in said portable toilet washing enclosure is gravity urged upon a floor portion of said liquid collection and liquid purifying apparatus, said liquid ultimately being purified and returned to said liquid storage member, the cleaned portable toilet being removed from said portable toilet washing enclosure by said portable toilet lifting member; whereupon, said portable toilet lifting member vertically disposes the portable toilet upon a predetermined site proximate to said portable toilet washing enclosure, thereby enabling the portable toilet to be manually removed to a storage area until transported to a location for use.

* * * * *